US012571183B2

(12) United States Patent
Kurosawa

(10) Patent No.: US 12,571,183 B2
(45) Date of Patent: Mar. 10, 2026

(54) EXCAVATOR

(71) Applicant: SUMITOMO CONSTRUCTION MACHINERY CO., LTD., Tokyo (JP)

(72) Inventor: Ryota Kurosawa, Chiba (JP)

(73) Assignee: SUMITOMO CONSTRUCTION MACHINERY CO., LTD., Tokyo (JP)

( * ) Notice: Subject to any disclaimer, the term of this patent is extended or adjusted under 35 U.S.C. 154(b) by 966 days.

(21) Appl. No.: 17/448,411

(22) Filed: Sep. 22, 2021

(65) Prior Publication Data

US 2022/0002970 A1 Jan. 6, 2022

Related U.S. Application Data

(63) Continuation of application No. PCT/JP2020/014353, filed on Mar. 27, 2020.

(30) Foreign Application Priority Data

Mar. 27, 2019 (JP) ..... 2019-061772
Mar. 27, 2019 (JP) ..... 2019-061773

(51) Int. Cl.

| | |
|---|---|
| ***E02F 9/20*** | (2006.01) |
| ***E02F 3/43*** | (2006.01) |
| ***E02F 9/22*** | (2006.01) |
| ***E02F 9/26*** | (2006.01) |

(52) U.S. Cl.

CPC ..... *E02F 9/2025* (2013.01); *E02F 3/435* (2013.01); *E02F 9/2004* (2013.01); *E02F 9/261* (2013.01); *E02F 9/2232* (2013.01); *E02F 9/2285* (2013.01); *E02F 9/2292* (2013.01); *E02F 9/2296* (2013.01)

(58) Field of Classification Search

CPC ..... E02F 9/2025

See application file for complete search history.

(56) References Cited

U.S. PATENT DOCUMENTS

| | | | | |
|---|---|---|---|---|
| 6,247,538 | B1 | 6/2001 | Takeda et al. | |
| 9,703,002 | B1 * | 7/2017 | Olsson | G01V 3/12 |
| 12,092,467 | B1 * | 9/2024 | Ebrahimi Afrouzi | G01C 21/32 |

(Continued)

FOREIGN PATENT DOCUMENTS

| | | |
|---|---|---|
| JP | 2696442 | 1/1998 |
| JP | H10-088625 | 4/1998 |

(Continued)

OTHER PUBLICATIONS

Google Machine translation of Japanese Patent Pub. No. JP2016089559A to Ozaka that was filed in in 2014.*

(Continued)

*Primary Examiner* — Jean Paul Cass

(74) *Attorney, Agent, or Firm* — IPUSA, PLLC

(57) ABSTRACT

An excavator includes a lower traveling body; an upper turning body turnably mounted to the lower traveling body; an acquisition device mounted to the upper turning body and configured to acquire information including a status around the excavator; and a control device configured to recognize a reference object that is in a stopped state or at a fixed position around the excavator based on the information acquired by the acquisition device, and to estimate a turning angle of the upper turning body based on a change in a position of the reference object as viewed from the upper turning body.

16 Claims, 20 Drawing Sheets

(56) References Cited

U.S. PATENT DOCUMENTS

| | | | | |
|---|---|---|---|---|
| 2012/0327261 | A1* | 12/2012 | Tafazoli Bilandi | E02F 9/24 348/E5.022 |
| 2013/0261885 | A1 | 10/2013 | Hargrave, Jr. et al. | |
| 2015/0308070 | A1 | 10/2015 | Deines | |
| 2018/0063427 | A1 | 3/2018 | Ali et al. | |
| 2018/0347150 | A1 | 12/2018 | Moriki et al. | |
| 2020/0299929 | A1 | 9/2020 | Ohiwa et al. | |
| 2022/0412050 | A1* | 12/2022 | Hoaby | E02F 9/2012 |

FOREIGN PATENT DOCUMENTS

| | | | | |
|---|---|---|---|---|
| JP | H11-050495 | | 2/1999 | |
| JP | 2008-101416 | | 5/2008 | |
| JP | 2008-240362 | | 10/2008 | |
| JP | 2012-082608 | | 4/2012 | |
| JP | 2012-107395 | | 6/2012 | |
| JP | 2016-089559 | | 5/2016 | |
| JP | 2017-032276 | | 2/2017 | |
| JP | 2017-058272 | | 3/2017 | |
| JP | 2017-096006 | | 6/2017 | |
| WO | 2017/221904 | | 12/2017 | |
| WO | WO-2018147340 | A1 * | 8/2018 | E02F 9/20 |
| WO | WO-2020196895 | A1 * | 10/2020 | E02F 3/43 |
| WO | WO-2024143349 | A1 * | 7/2024 | |

OTHER PUBLICATIONS

Google Machine translation of Japanese Patent Pub. No. JP 2012107395 A to Izumikawa that was filed in 2010.*

Google Machine translation of WO2017221904A1 (2016).*

International Search Report for PCT/JP2020/014353 mailed on Jun. 16, 2020.

* cited by examiner

EXCAVATOR

CROSS-REFERENCE TO RELATED APPLICATIONS

The present application is a continuation application of International Application No. PCT/JP2020/014353 filed on Mar. 27, 2020, which claims priority to Japanese Patent Application No. 2019-061772, filed Mar. 27, 2019, and Japanese Patent Application No. 2019-061773, filed Mar. 27, 2019. The contents of these applications are incorporated herein by reference in their entirety.

BACKGROUND

1. Technical Field

The present invention relates to an excavator.

2. Description of the Related Art

For example, a technique is known in which a relative angle of an upper turning body relative to a lower traveling body is obtained by providing an imaging device for capturing an image of the lower traveling body and detecting a predetermined portion of the lower traveling body from the captured image captured by the imaging device.

SUMMARY

According to an embodiment of the present invention, there is provided an excavator including a lower traveling body; an upper turning body turnably mounted to the lower traveling body; an acquisition device mounted to the upper turning body and configured to acquire information including a status around the excavator; and a control device configured to recognize a reference object that is in a stopped state or at a fixed position around the excavator based on the information acquired by the acquisition device, and to estimate a turning angle of the upper turning body based on a change in a position of the reference object as viewed from the upper turning body.

Further, in another embodiment of the present disclosure, there is provided an excavator including a lower traveling body; an upper turning body turnably mounted to the lower traveling body; an acquisition device mounted to the upper turning body and configured to acquire information including a status around the excavator; and a control device configured to recognize an object around the excavator and to identify a position of the own machine with respect to the object, based on the information acquired by the acquisition device.

DETAILED DESCRIPTION

In the conventional technology, for example, when an excavator performs work, the positional relationship between an attachment that is a working device and an object including a work target (e.g., a dump truck in which earth and sand is loaded) around the excavator, is important. Therefore, even if the excavator determines the relative angle of the upper turning body with respect to the lower traveling body, there is a possibility that the excavator cannot recognize the positional relationship between the attachment and the object around the excavator, more specifically, the orientation of the upper turning body based on the object around the excavator (i.e., the angle in a top view).

Therefore, it is desirable to provide a technique in an excavator, by which the positional relationship between the own machine (i.e., the excavator in question) and an object around the own machine can be reliably identified.

Hereinafter, embodiments will be described with reference to the drawings.

[Overview of Excavator]

First, an outline of an excavator 100 according to the present embodiment will be described with reference to FIG. 1.

Figure 1:
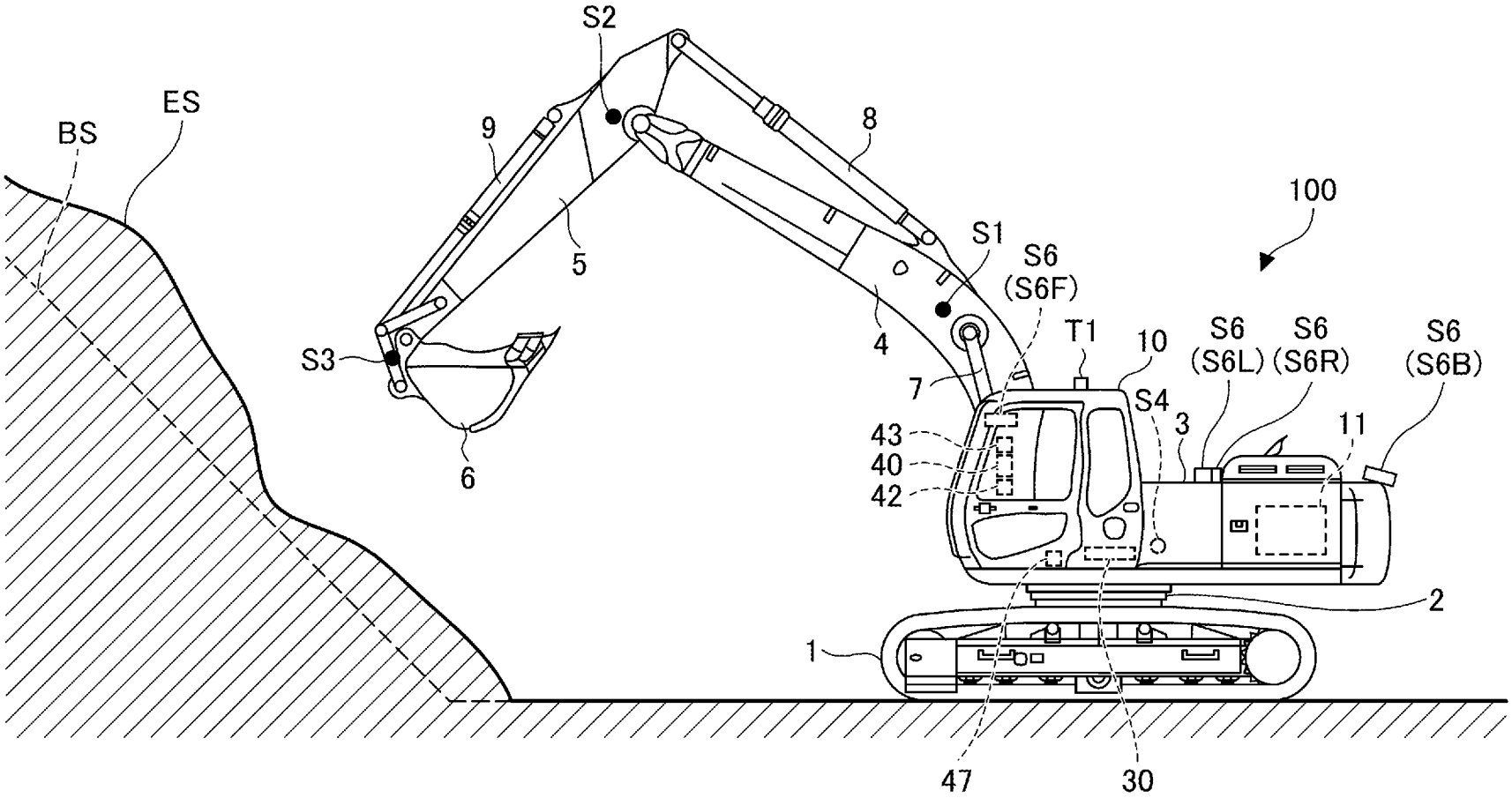
FIG. 1 is a schematic block diagram illustrating an example of a device management system according to embodiments of the present invention.

FIG. 1 is a side view of the excavator 100 that is a drilling machine according to the present embodiment.

FIG. 1 illustrates the excavator 100 located on a horizontal plane facing an upward tilt surface ES to be worked on, and an upward slope surface BS (that is, the slope shape of the upward tilt surface ES after being worked on) that is an example of an aim work surface to be described later (see FIGS. 8A and 8B).

The excavator 100 according to the present embodiment includes a lower traveling body 1; an upper turning body 3 that is mounted to the lower traveling body 1 in a turnable manner via a turning mechanism 2; a boom 4, an arm 5, and a bucket 6 configuring attachments (work machines), and a cabin 10.

In the lower traveling body 1, a crawler on the left and a crawler on the right, forming a pair, are hydraulically driven by traveling hydraulic motors 1L and 1R, respectively, to cause the excavator 100 to travel. That is, a pair of the traveling hydraulic motors 1L and 1R that is a driving unit drives the lower traveling body 1 (crawlers) as a driven unit.

The upper turning body 3 is driven by a turning hydraulic motor 2A to turn relative to the lower traveling body 1. That is, the turning hydraulic motor 2A that is a driving unit, is a turning driving unit that drives the upper turning body 3 that is the driven unit, and can change the orientation of the upper turning body 3 (that is, the orientation of the attachment).

The upper turning body 3 may be electrically driven by an electric motor (hereinafter, referred to as a "turning electric motor") instead of the turning hydraulic motor 2A. That is, similar to the turning hydraulic motor 2A, the turning electric motor is a turning driving unit that drives the upper turning body 3 that is a driven unit, and can change the orientation of the upper turning body 3.

The boom 4 is pivotally mounted to the front center of the upper turning body 3 so as to be elevated, the arm 5 is pivotally mounted to the leading end of the boom 4 so as to turn upward and downward, and the bucket 6 that is the end attachment is pivotally mounted to the leading end of the arm 5 so as to turn upward and downward. The boom 4, the arm 5, and the bucket 6 are hydraulically driven by a boom cylinder 7, an arm cylinder 8, and a bucket cylinder 9, respectively, as hydraulic actuators.

The bucket 6 is an example of an end attachment, and another end attachment, such as a slope bucket, a dredging bucket, a breaker, or the like, may be attached to the leading end of the arm 5 instead of the bucket 6, depending on the work contents or the like.

The cabin 10 is an operator's cabin where an operator is seated, and is mounted on the front left side of the upper turning body 3.

[Example of Configuration of Excavator]

Next, one example of a specific configuration of the excavator 100 according to the present embodiment will be described with reference to FIG. 2 in addition to FIG. 1, and more specifically, an example of the configuration concerning the method of estimating the turning angle of the excavator 100 (own machine, i.e., the excavator in question) described below, will be described.

Figure 2:
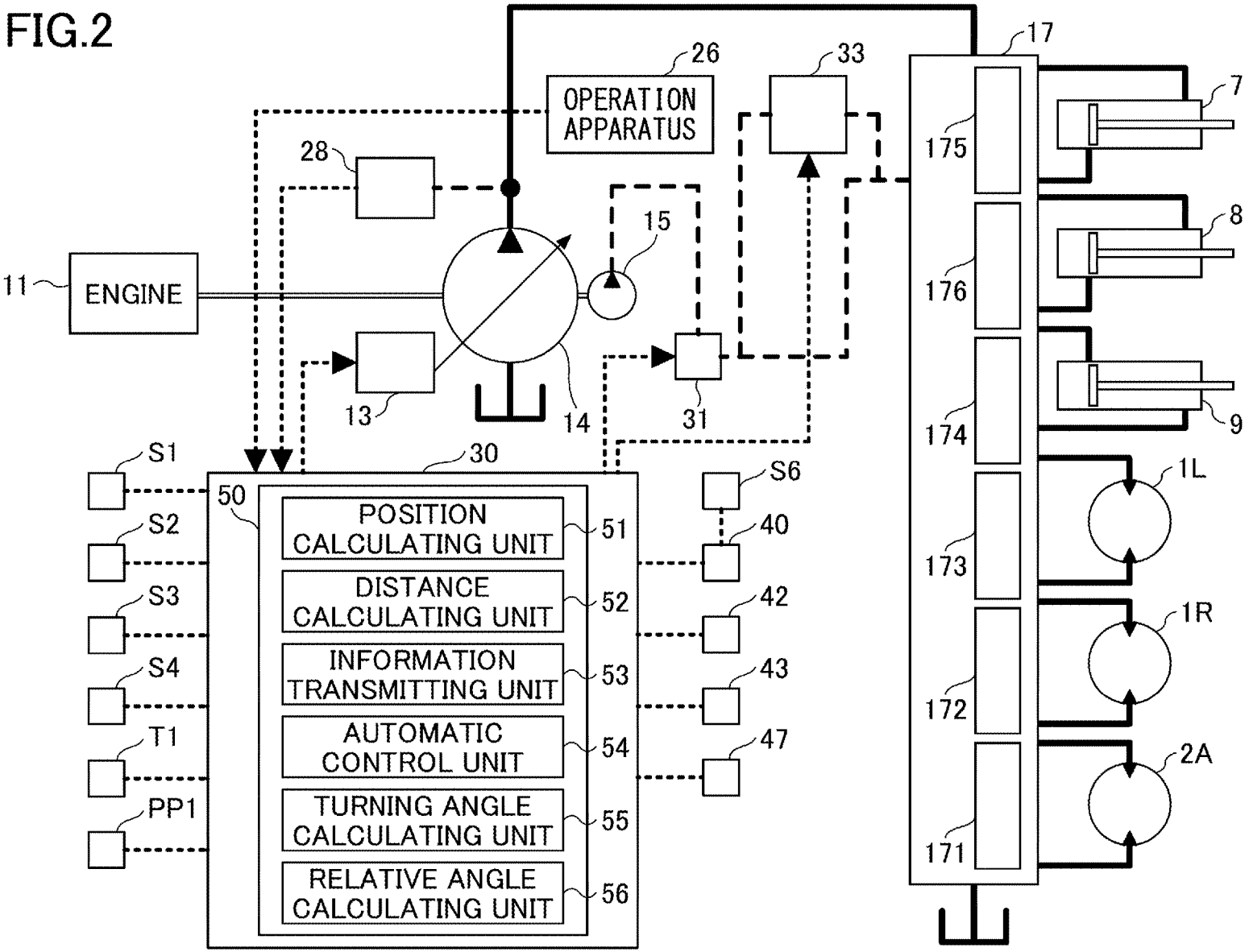
FIG. 2 is a diagram schematically illustrating an example of a configuration of an excavator.

FIG. 2 is a diagram schematically illustrating an example of the configuration of the excavator 100 according to the present embodiment.

Note that in FIG. 2, the mechanical power system, the hydraulic oil line, the pilot line, and the electrical control line are indicated as double, solid, dashed, and dotted lines, respectively. Hereinafter, the same applies to FIGS. 3, 4 (FIGS. 4A to 4C) and 12, which will be described later.

As described above, the hydraulic drive system of the excavator 100 according to the present embodiment includes a hydraulic actuator that is a driving unit including the traveling hydraulic motors 1L and 1R, the turning hydraulic motor 2A, the boom cylinder 7, the arm cylinder 8, and the bucket cylinder 9 that are for hydraulically driving the lower traveling body 1, the upper turning body 3, the boom 4, the arm 5, and the bucket 6, respectively. Further, the hydraulic driving system of the excavator 100 according to the present embodiment includes an engine 11, a regulator 13, a main pump 14, and a control valve 17.

The engine 11 is the main power source in the hydraulic driving system, and is a diesel engine fueled with diesel oil, for example. For example, the engine 11 is mounted at the back of the upper turning body 3. The engine 11 constantly rotates at a predetermined target revolution speed under direct or indirect control by a controller 30 described below, to drive the main pump 14 and the pilot pump 15.

The regulator 13 controls the discharge amount of the main pump 14. For example, the regulator 13 adjusts the angle (hereinafter, a "tilt angle") of the swash plate of the main pump 14 in response to control commands from the controller 30. The regulator 13 includes regulators 13L, 13R, for example, as described below.

The main pump 14, for example, is mounted at the back of the upper turning body 3, similar to the engine 11, to supply hydraulic oil to the control valve 17 through a high pressure hydraulic line. The main pump 14 is driven by the engine 11 as described above. The main pump 14 is, for example, a variable capacity hydraulic pump, and as described above, under the control of the controller 30, the tilt angle of the swash plate is adjusted by the regulator 13, thereby adjusting the stroke length of the piston and controlling the discharge flow rate (discharge pressure). The main pump 14 includes main pumps 14L, 14R, for example, as described below.

The control valve 17, for example, is mounted in a central portion of the upper turning body 3 and is a hydraulic control device that controls the hydraulic driving system in response to an operation performed by an operator with respect to an operation apparatus 26. As described above, the control valve 17 is connected to the main pump 14 via a high pressure hydraulic line, and selectively supplies hydraulic oil supplied from the main pump 14 to a hydraulic actuator (the traveling hydraulic motors 1L, 1R, the turning hydraulic motor 2A, the boom cylinder 7, the arm cylinder 8, and the bucket cylinder 9) depending on the state of the operation of the operation apparatus 26. Specifically, the control valve 17 includes control valves 171 to 176 for controlling the flow rate and flow direction of hydraulic oil supplied from the main pump 14 to each of the hydraulic actuators. More specifically, the control valve 171 corresponds to the traveling hydraulic motor 1L, the control valve 172 corresponds to the traveling hydraulic motor 1R, and the control valve 173 corresponds to the turning hydraulic motor 2A. The control valve 174 corresponds to the bucket cylinder 9, the control valve 175 corresponds to the boom cylinder 7, and the control valve 176 corresponds to the arm cylinder 8. The control valve 175 also includes control valves 175L and 175R, for example, as described below, and the control valve 176 includes control valves 176L and 176R, for example, as described below. The control valves 171 to 176 are described in detail below (see FIG. 3).

The operation system of the excavator 100 according to the present embodiment includes a pilot pump 15 and the operation apparatus 26.

The pilot pump 15, for example, is mounted at the back of the upper turning body 3 and supplies pilot pressure to various hydraulic devices such as a proportional valve 31 via a pilot line. The pilot pump 15 is, for example, a fixed capacitive hydraulic pump driven by the engine 11 as described above.

The operation apparatus 26 is provided near the operator's seat of the cabin 10 and is operation input means for the operator to perform the operations on driven units of the excavator 100 (the lower traveling body 1, the upper turning body 3, the boom 4, the arm 5, the bucket 6, and the like). That is, the operation apparatus 26 is operation input means for the operator to operate the hydraulic actuators (that is, the traveling hydraulic motors 1L and 1R, the turning hydraulic motors 2A, the boom cylinder 7, the arm cylinder 8, the bucket cylinder 9, and the like) driving the respective driven units. For example, the operation apparatus 26 is an electric type and outputs an electrical signal (hereinafter, "operation signal") corresponding to the operation content thereof, which operation signal is input to the controller 30. The controller 30 outputs a control command corresponding to the operation signal to the proportional valve 31, and accordingly, pilot pressure corresponding to the operation content of the operation apparatus 26 is supplied from the proportional valve 31 to the control valve 17. Thus, the control valve 17 can implement the motion of the excavator 100 according to the operation content of the operator with respect to the operation apparatus 26. The operation apparatus 26 includes, for example, a lever device for operating the arm 5 (the arm cylinder 8). The operation apparatus 26 also includes lever devices 26A to 26C (see FIGS. 4A to 4C) which operate, for example, the boom 4 (the boom cylinder 7), the bucket 6 (the bucket cylinder 9), and the upper turning body 3 (the turning hydraulic motor 2A). The operation apparatus 26 includes, for example, a lever device or a pedal device for operating the pair of left and right crawlers (the traveling hydraulic motors 1L and 1R) of the lower traveling body 1.

The operation apparatus 26 may be a hydraulic pilot type. In this case, to the operation apparatus 26, the pilot pressure as the source pressure is supplied from the pilot pump 15 through the pilot line, and pilot pressure according to the operation content with respect to the operation apparatus 26 is output to the pilot line on the secondary side and supplied to the control valve 17 via the shuttle valve. The control valves 171 to 176 in the control valve 17 may be electromagnetic solenoid spool valves driven by commands from the controller 30, or solenoid valves that operate in response to electrical signals from the controller 30 may be positioned between the pilot pump 15 and the pilot port of each of the control valves 171 to 176. In these cases, the controller 30 controls the solenoid valves and increases or decreases the pilot pressure in response to an operation signal corresponding to an operation amount (e.g., a lever operation amount) of the electrically operated operation apparatus 26 to operate the control valves 171 to 176 according to the operating content with respect to the operation apparatus 26.

The control system of the excavator 100 according to the present embodiment includes the controller 30, a discharge pressure sensor 28, the proportional valve 31, a decompression proportional valve 33, a display device 40, an input device 42, a sound output device 43, and a storage device 47. Further, the control system of the excavator 100 according to the present embodiment includes a boom angle sensor S1, an arm angle sensor S2, a bucket angle sensor S3, a machine tilt sensor S4, an imaging device S6, a positioning device PP1, and a communication device T1.

The controller 30 (an example of a control device) is provided, for example, in the cabin 10, to perform various kinds of control for the excavator 100. The controller 30 may implement functions thereof by any hardware, or combinations of hardware and software or the like. For example, the controller 30 is configured mainly as a microcomputer including a CPU (Central Processing Unit), a memory device such as a RAM (Random Access Memory), a non-volatile auxiliary storage device such as a ROM (Read Only Memory), and an interface device relating to various inputs and outputs. Further, for example, the controller 30 may include computing circuitry, such as a Graphics Processing Unit (GPU), an Application Specific Integrated Circuit (ASIC), a Field-Programmable Gate Array (FPGA), or the like, operating in conjunction with the CPU. The controller 30 implements various functions by executing, for example, various programs installed in the auxiliary storage device on the CPU.

For example, the controller 30 sets a target revolution speed and performs drive control for constant rotation of the engine 11 based on a work mode and the like preset by a predetermined operation by an operator and the like.

For example, the controller 30 outputs a control command to the regulator 13 as needed to change the discharge amount of the main pump 14.

For example, the controller 30 controls the machine guidance function that guides the manual operation to the excavator 100 through the operation apparatus 26 by, for example, an operator. Further, the controller 30 controls the machine control function that automatically assists the operator in manually operating the excavator 100 through the operation apparatus 26, for example. That is, the controller 30 includes the machine guidance unit 50 as a function unit of the machine guidance function and the machine control function.

Some of the functions of the controller 30 may be implemented by other controllers (control devices). That is, the functions of the controller 30 may be implemented in a manner that is distributed over a plurality of controllers. For example, the machine guidance function and the machine control function (the functions of the machine guidance unit 50) may be implemented by an exclusive-use controller (control device).

The discharge pressure sensor 28 detects the discharge pressure of the main pump 14. A detection signal corresponding to the discharge pressure detected by the discharge pressure sensor 28 is loaded into the controller 30. The discharge pressure sensor 28 includes discharge pressure sensors 28L and 28R, for example, as described below.

The proportional valve 31 is provided on the pilot line connecting the pilot pump 15 to the control valve 17. The proportional valve 31 is configured, for example, to change the flow area thereof (the cross-sectional area in which hydraulic oil is allowed to flow). The proportional valve 31 operates in response to a control command input from the controller 30. Thus, the controller 30 can apply a pilot pressure according to the operation content of the operation apparatus 26, to the pilot port of the corresponding control valve in the control valve 17 via the proportional valve 31 in response to an operation content signal input from the operation apparatus 26. Further, the controller 30 may supply hydraulic oil discharged from the pilot pump 15 to the pilot port of the corresponding control valve in the control valve 17 via the proportional valve 31, even if the operation apparatus 26 (specifically, the lever devices 26A to 26C) is not operated by an operator. The proportional valve 31 includes proportional valves 31AL, 31AR, 31BL, 31BR, 31CL, 31CR, as described below, for example.

Further, the proportional valve 31 can switch the operation with respect to the operation apparatus 26, that is, the operation with respect to various driven elements of the excavator 100, between an enabled state and a disabled state, by reducing the cross-sectional area through which the hydraulic oil can flow to zero regardless of the operation state with respect to the operation apparatus 26 or by changing the cross-sectional area to a flow path area corresponding to the operation state. Thus, the controller 30 can limit (stop) the motion of the excavator 100 by outputting a control command to the proportional valve 31.

Further, when the operation apparatus 26 is a hydraulic pilot type, a pilot line between the pilot pump 15 and the operation apparatus 26 may be provided with a hydraulic control valve that switches the state of the pilot line between a communication state and a blocked state (non-communication state), in response to a control command from the controller 30. The hydraulic control valve may be, for example, a gate lock valve configured to operate in response to control commands from controller 30. For example, when a gate lock lever provided near the entrance of the cabin 10 where an operator is seated is pulled up, the gate lock valve switches to the communication state, and the state of an operation to the operation apparatus 26 becomes the enabled state (operable state). When the gate lock lever is pushed down, the gate lock valve switches to the blocked state, and the state of an operation to the operation apparatus 26 becomes the disabled state (inoperable state). Thus, the controller 30 can limit (stop) the motion of the excavator 100 by outputting a control command to the corresponding hydraulic control valve.

Note that, as the operation apparatus 26, if a hydraulic pilot type is employed instead of an electric type, the pilot line on the secondary side of the proportional valve 31 is connected to the control valve 17 via the shuttle valve described above. In this case, the pilot pressure supplied from the shuttle valve to the control valve 17 is the higher pilot pressure between the pilot pressure, which is in accordance with the operation content, output from the operation apparatus 26, and a predetermined pilot pressure, which is unrelated to the operation content of the operation apparatus 26, output from the proportional valve 31.

The decompression proportional valve 33 is disposed in the pilot line between the proportional valve 31 and the control valve 17. The controller 30 reduces the pilot pressure by discharging the hydraulic oil on the pilot line into the tank, when the controller 30 determines that a braking operation to decelerate or stop the hydraulic actuator is necessary, based on a signal from an object detection device (e.g., the imaging device S6). This allows the control valve spool in the control valve 17 to move in the neutral direction, regardless of the state of the proportional valve 31. Accordingly, the decompression proportional valve 33 is effective when the braking characteristic is desired to be improved. The decompression proportional valve 33 includes, for example, decompression proportional valves 33AL, 33AR, 33BL, 33BR, 33CL, and 33CR as described below.

As the operation apparatus 26, when the hydraulic pilot type is adopted instead of the electric type, the decompression proportional valve 33 is omitted.

The display device 40 is provided at a location within the cabin 10 where the display device 40 is readily visible from a seated operator and displays various information images under the control of the controller 30. The display device 40 may be, for example, a liquid crystal display or an organic electroluminescent (EL) display. The display device 40 may be connected to the controller 30 via in-vehicle communication networks such as CAN (Controller Area Network) or may be connected to the controller 30 via a one-to-one exclusive-use line.

The input device 42 accepts various inputs from an operator in the cabin 10, and outputs a signal according to the accepted input, to the controller 30. For example, the input device 42 is positioned within reach of a seated operator in the cabin 10 and includes an operation input device for accepting operation inputs from the operator. The operation input device includes a touch panel mounted on a display of the display device 40 for displaying various information images, a knob switch mounted on the leading end of a lever portion of the lever devices 26A to 26C, a button switch, a lever, a toggle, a rotating dial, and the like mounted around the display device 40. Further, the input device 42 may include, for example, a sound input device or a gesture input device for accepting the sound input or gesture input from an operator in the cabin 10. The sound input device includes, for example, a microphone provided in the cabin 10. The sound input device includes, for example, an imaging device disposed within the cabin 10, that is capable of capturing an image of the operator's appearance. A signal corresponding to the input content to the input device 42 is loaded into the controller 30.

The sound output device 43 is provided, for example, in the cabin 10, and outputs predetermined sounds under the control of the controller 30. The sound output device 43 may be, for example, a speaker, a buzzer, or the like. The sound output device 43 outputs various types of information by sound, i.e., outputs auditory information, in accordance with a control command from the controller 30.

The storage device 47 is provided in the cabin 10, for example, for storing various kinds of information under the control of the controller 30. The storage device 47 is a non-volatile storage medium such as, for example, a semiconductor memory. The storage device 47 may store information output by the various devices during operation of the excavator 100 and may store information acquired through the various devices before operation of the excavator 100 is started. The storage device 47 may store, for example, data relating to an aim work surface acquired through the communication device T1 or the like or set through the input device 42 or the like. The aim work surface may be set (stored) by an operator of the excavator 100 or may be set by a construction manager or the like.

The boom angle sensor S1 is mounted to the boom 4 and detects the depression/elevation angle of the boom 4 relative to the upper turning body 3 (hereinafter, the "boom angle"), for example, the angle of a straight line connecting the fulcrums points at both ends of the boom 4 relative to the turning plane of the upper turning body 3 in a side view. The boom angle sensor S1 may include, for example, a rotary encoder, an acceleration sensor, a 6-axis sensor, an IMU (Inertial Measurement Unit), or the like. Further, the boom angle sensor S1 may include a potentiometer using a variable resistor and a cylinder sensor for detecting the stroke amount of a hydraulic cylinder (the boom cylinder 7) corresponding to the boom angle. The same applies to the arm angle sensor S2 and the bucket angle sensor S3. A detection signal corresponding to the boom angle output by the boom angle sensor S1 is loaded into the controller 30.

The arm angle sensor S2 is mounted to the arm 5 and detects the rotation angle of the arm 5 with respect to the boom 4 (hereinafter, an "arm angle"), for example, the angle formed between a straight line connecting the fulcrum points at both ends of the boom 4 and a straight line connecting the fulcrum points at both ends of the arm 5 in a side view. A detection signal corresponding to the arm angle output by the arm angle sensor S2 is loaded into the controller 30.

The bucket angle sensor S3 is mounted to the bucket 6 and detects the rotation angle (hereinafter, a "bucket angle") of the bucket 6 with respect to the arm 5, for example, the angle formed between a straight line connecting the fulcrum points at both ends of the arm 5 and a straight line connecting the fulcrum point and the leading end (claw tip) of the bucket 6 in a side view. A detection signal corresponding to the bucket angle output by the bucket angle sensor S3 is loaded into the controller 30.

The machine tilt sensor S4 detects the tilt state of the machine (the upper turning body 3 or the lower traveling body 1) relative to a predetermined plane (for example, a horizontal plane). For example, the machine tilt sensor S4 is mounted on the upper turning body 3 and detects the tilt angle of the excavator 100 (i.e., the upper turning body 3) about the two axes in the frontward-backward direction and the left-right direction (hereinafter, a "front-back tilt angle" and a "left-right tilt angle"). The machine tilt sensor S4 may include, for example, a rotary encoder, an acceleration sensor, a 6-axis sensor, an IMU, or the like. A detection signal corresponding to the tilt angle (front-back tilt angle and left-right tilt angle) output by the machine tilt sensor S4 is loaded into the controller 30.

The imaging device S6 captures the surroundings of the excavator 100, and acquires image information representing the appearance of the area around the excavator 100. The imaging device S6 includes a camera S6F for capturing images in front of the excavator 100, a camera S6L for capturing images on the left of the excavator 100, a camera S6R for capturing images on the right of the excavator 100, and a camera S6B for capturing images behind the excavator 100.

The camera S6F (an example of an acquisition device) is mounted, for example, on the ceiling of the cabin 10, i.e., inside the cabin 10. The camera S6F (an example of an acquisition device) may be mounted on the outside of the cabin 10, such as the roof of the cabin 10, the side surface of the boom 4, or the like. The camera S6L (an example of an acquisition device) is mounted on the left end of the upper surface of the upper turning body 3, the camera S6R (an example of an acquisition device) is mounted on the right end of the upper surface of the upper turning body 3, and the camera S6B (an example of an acquisition device) is mounted on the back end of the upper surface of the upper turning body 3.

The imaging device S6 (the cameras S6F, S6B, S6L, and S6R) is, for example, a monocular wide angle camera having a very wide angle of view. The imaging device S6 may be a stereo camera, a distance image camera, or a depth camera. An image captured by the imaging device S6 is loaded into the controller 30 via the display device 40.

Further, the imaging device S6 (the cameras S6F, S6B, S6L, and S6R) may be replaced by or additionally provided with other sensors capable of acquiring information representing the appearance of the surroundings of the excavator 100. The other sensors may be, for example, ultrasonic sensors, millimeter wave radars, LIDAR (Light Detection and Ranging), infrared sensors, and the like. Specifically, the other sensors may receive a reflected signal of the output signal output to the surroundings of the excavator 100, to calculate the distance to the object around the excavator 100 using point group data or the like. The imaging device S6 and/or other sensors may function as an object detection device. In this case, the imaging device S6 and/or other sensors may detect an object that is a predetermined detection target that is present around the excavator 100. The object that is a detection target may include, for example, humans, animals, vehicles, construction machinery, buildings, holes, and the like. The imaging device S6 and/or other sensors may acquire (calculate) the distance from the sensor itself or from the excavator 100 to the recognized object.

For example, based on the output of the imaging device S6 and/or other sensors, the controller 30 performs control (hereinafter, referred to as "contact avoidance control") to avoid contact or the like between the excavator 100 and an object that is the monitor target when the object (e.g., a person, a truck, another construction machine, or the like) that is the monitor target is detected in a predetermined monitor region (e.g., a work region within a distance of 5 meters from the excavator 100) around the excavator 100. Specifically, the controller 30 may output a control command to the display device 40 or the sound output device 43 and output an alarm as an example of contact avoidance control. The controller 30 may output a control command to the proportional valve 31, the decompression proportional valve 33, or the control valve to limit the motion of the excavator 100 as an example of contact avoidance control. In this case, the target of the motion limitation may be all of the driven elements, or only some of the driven elements that need to be limited for avoiding contact between the object that is the monitor target with the excavator 100.

Determination by the controller 30 of the presence of a monitor target in the monitor region is performed even in the inoperable state. The excavator 100 may determine whether a monitor target is present in the monitor region of the excavator 100, and also determine whether a monitor target is present outside the monitor region of the excavator 100. The determination of whether a monitor target is present outside the monitor region of the excavator 100 may also be performed even when the excavator 100 is inoperable.

The imaging device S6 may be directly communicably connected to the controller 30.

The positioning device PP1 measures the position of the excavator 100 (the upper turning body 3). The positioning device PP1 is, for example, a GNSS (Global Navigation Satellite System) module which detects the position of the upper turning body 3, and the detection signal corresponding to the position of the upper turning body 3 is loaded into the controller 30.

The position of the excavator 100 may be acquired by using an estimation method described below. In this case, the positioning device PP1 may be omitted.

The communication device T1 is connected to a predetermined network that may include a mobile communication network having a base station as the terminal, a satellite communication network using a communication satellite, the Internet network, or the like, and communicates with an external device (for example, a management apparatus 200 to be described later). The communication device T1 is, for example, a mobile communication module compatible with a mobile communication standard such as LTE (Long Term Evolution), 4G (4th Generation), and 5G (5th Generation), or a satellite communication module for connecting to a satellite communication network.

The machine guidance unit 50 performs control of the excavator 100 with respect to, for example, the machine guidance function. The machine guidance unit 50 communicates to an operator, for example, through the display device 40 or the sound output device 43, work information such as a distance between an aim work surface and a leading end of an attachment, specifically, the working portion of an end attachment. The data relating to the aim work surface is pre-stored in the storage device 47 as described above, for example. The data relating to the aim work surface is represented, for example, by a reference coordinate system. The reference coordinate system is, for example, a local coordinate system unique to the construction site. The operator may define any point of the construction site as a reference point and set the aim work surface by the relative positional relationship with the reference point through the input device 42. The working portion of the bucket 6 is, for example, the claw tip of the bucket 6, the back surface of the bucket 6, and the like. If, for example, a breaker is employed instead of the bucket 6 as an end attachment, the leading end of the breaker corresponds to the working portion. The machine guidance unit 50 notifies an operator of work information through the display device 40, the sound output device 43, or the like, and guides the operator to operate the excavator 100 through the operation apparatus 26.

Further, the machine guidance unit 50 controls the excavator 100 with respect to, for example, the machine control function. For example, the machine guidance unit 50 causes the automatic motion of at least one of the lower traveling body 1, the upper turning body 3, the boom 4, the arm 5, and the bucket 6, so that the working portion of the bucket 6 moves along a predetermined target trajectory, in response to an operation by the operator with respect to the operation apparatus 26. Specifically, when the operator is performing a manual drilling operation, the machine guidance unit 50 may cause at least one of the boom 4, the arm 5, and the bucket 6 to be automatically operated so that the aim work surface and the leading end position of the bucket 6 (that is, the position that is the control reference in the working portion) coincide with each other. Further, the machine guidance unit 50 may cause the upper turning body 3 to be automatically operated so that the upper turning body 3 front-faces, for example, a predetermined work target (for example, a dump truck to be loaded with earth and sand, a slope to be worked on by cutting soil or rolling, etc.). Further, the machine guidance unit 50 may, for example, cause the automatic motion of the lower traveling body 1 so that the excavator 100 moves along a predetermined path.

The machine guidance unit 50 acquires information from the boom angle sensor S1, the arm angle sensor S2, the bucket angle sensor S3, the machine tilt sensor S4, the imaging device S6, the positioning device PP1, the communication device T1, and the input device 42. The machine guidance unit 50, for example, calculates the distance between the bucket 6 and the aim work surface based on the acquired information, notifies the operator of the extent of the distance between the bucket 6 and the work target (for example, the aim work surface) based on the sound from the sound output device 43 and the image displayed on the display device 40, and automatically controls the operation of the attachment so that the leading end of the attachment (specifically, the working portion such as the claw tip or the back surface of the bucket 6) coincides with the aim work surface. The machine guidance unit 50 includes a position calculating unit 51, a distance calculating unit 52, an information transmitting unit 53, an automatic control unit 54, a turning angle calculating unit 55, and a relative angle calculating unit 56, as detailed functional configurations relating to the machine guidance function and the machine control function.

The position calculating unit 51 calculates a position of a predetermined positioning target. For example, the position calculating unit 51 calculates a coordinate point in the reference coordinate system of the leading end of the attachment, specifically, the working portion such as the claw tip or the back surface of the bucket 6. Specifically, the position calculating unit 51 calculates the coordinate point of the working portion of the bucket 6 from the respective elevation angles (the boom angle, the arm angle, and the bucket angle) of the boom 4, the arm 5, and the bucket 6.

The distance calculating unit 52 calculates the distance between the two positioning targets. For example, the distance calculating unit 52 calculates the distance between the leading end of the attachment, specifically, the working portion such as the claw tip or the back surface of the bucket 6, and the aim work surface. The distance calculating unit 52 may calculate an angle (relative angle) between the back surface as a working portion of the bucket 6 and the aim work surface.

The information transmitting unit 53 transmits (notifies) various kinds of information to an operator of the excavator 100 through predetermined notification means such as the display device 40 or the sound output device 43. The information transmitting unit 53 notifies the operator of the excavator 100 of the magnitude (extent) of various distances calculated by the distance calculating unit 52. For example, the distance (magnitude) between the leading end of the bucket 6 and the aim work surface is communicated to the operator by using at least one of the visual information displayed by the display device 40 and the auditory information output by the sound output device 43. The information transmitting unit 53 may communicate to an operator the relative angle (magnitude) between the back surface of the bucket 6 as the work portion and the aim work surface using at least one of the visual information provided by the display device 40 and the auditory information provided by the sound output device 43.

Specifically, the information transmitting unit 53 transmits the magnitude of the distance (for example, the vertical distance) between the working portion of the bucket 6 and the aim work surface to the operator using an intermittent sound generated by the sound output device 43. In this case, the information transmitting unit 53 may shorten the intervals between the intermittent sounds as the vertical distance decreases and may increase the intervals between the intermittent sounds as the vertical distance increases. Further, the information transmitting unit 53 may use continuous sounds and may represent the difference in the magnitude of the vertical distance by changing the pitch, intensity, or the like of the sound. The information transmitting unit 53 may issue an alarm through the sound output device 43 when the leading end of the bucket 6 is at a position lower than the aim work surface, that is, exceeds the aim work surface. The alarm is, for example, a continuous sound that is significantly louder than an intermittent sound.

The information transmitting unit 53 may display, on the display device 40 as work information, the magnitude of the distance between the leading end of the attachment, specifically, the working portion of the bucket 6, and the aim work surface, the magnitude of the relative angle between the back surface of the bucket 6 and the aim work surface, or the like. The display device 40 displays the work information received from the information transmitting unit 53 together with image data received from the imaging device S6, for example, under the control of the controller 30. The information transmitting unit 53 may communicate the magnitude of the vertical distance to the operator using, for example, an image of an analog meter or an image of a bar graph indicator.

The automatic control unit 54 automatically assists the operator in manually operating the excavator 100 through the operation apparatus 26, by automatically moving the actuator driving the driven units of the excavator 100. Specifically, the automatic control unit 54 can control the proportional valve 31, and individually and automatically adjust the pilot pressure acting on the control valves in the control valve 17 corresponding to a plurality of hydraulic actuators. Thus, the automatic control unit 54 can automatically move the respective hydraulic actuators. The control relating to the machine control function by the automatic control unit 54 may be performed, for example, when a predetermined switch included in the input device 42 is pressed down. The predetermined switch may be, for example, a machine control switch ("MC (Machine Control) switch") and may be positioned as a knob switch at the tip of the operator's grip portion of the operation apparatus 26 (e.g., a lever device corresponding to the operation of the arm 5). Hereinafter, the explanation is based on the assumption that when the MC switch is pressed down, the machine control function is enabled.

For example, when the MC switch, or the like, is pressed down, the automatic control unit 54 automatically expands and contracts at least one of the boom cylinder 7 and the bucket cylinder 9, in accordance with the motion of the arm cylinder 8, to assist in the drilling work or the shaping work. Specifically, the automatic control unit 54 automatically expands or contracts at least one of the boom cylinder 7 and the bucket cylinder 9 so that the aim work surface coincides with a position that is the control reference of a working portion, such as the claw tip or the back surface of the bucket 6, when the operator performs a manual operation to close the arm 5 (hereinafter, an "arm closing operation"). In this case, the operator can close the arm 5 while matching the claw tip of the bucket 6 or the like to the aim work surface, for example, by simply performing an arm closing operation with respect to the lever device corresponding to the operation of the arm 5.

When the MC switch is pressed down, the automatic control unit 54 may automatically rotate the turning hydraulic motor 2A in order to cause the upper turning body 3 to front-face a predetermined work target (for example, a dump truck to be loaded with earth and sand, the aim work surface to be worked on, etc.). Hereinafter, the control in which the upper turning body 3 is caused to front-face the aim work surface by the controller 30 (the automatic control unit 54) is referred to as "front-face control" in some cases. Accordingly, the operator, or the like, can simply press a predetermined switch or operate the lever device 26C described below which corresponds to the turning operation while the switch is pressed down, so that the upper turning body 3 is caused to front-face the work target. Further, the operator may simply press the MC switch to cause the upper turning body 3 to front-face the work target and start a machine control function relating to the work of discharging soil to a dump truck or the drilling work on the aim work surface or the like.

For example, the state in which the upper turning body 3 of the excavator 100 is front-facing the dump truck that is the work target, is such that the bucket 6 at the leading end of the attachment can be moved along the longitudinal direction of the dump truck's loading platform, i.e., the front-back axis of the dump truck's loading platform.

For example, the state in which the upper turning body 3 of the excavator 100 front-faces the aim work surface that is the work target, is such that the leading end of the attachment (e.g., the claw tip or the back surface as the working portion of the bucket 6) can be moved along the inclined direction of the aim work surface (for example, the upward slope surface BS in FIG. 1) in accordance with the motion of the attachment. Specifically, the state in which the upper turning body 3 of the excavator 100 front-faces the aim work surface is a state in which the operation plane (the operation plane of the attachment) AF of the attachment vertical to a turning plane SF of the excavator 100 includes a normal line of the aim work surface corresponding to the cylindrical body CB (that is, a state in accordance with the normal line) (see FIG. 8B described below).

If the attachment operation plane AF of the excavator 100 is not in a state that includes the normal line of the aim work surface corresponding to the cylindrical body CB, the leading end of the attachment cannot move in the tilt direction of the aim work surface. As a result, the excavator 100 cannot properly perform construction work on the aim work surface (see FIG. 8A described below). On the other hand, the automatic control unit 54 automatically rotates the turning hydraulic motor 2A, so that the upper turning body 3 front-faces the aim work surface. This allows the excavator 100 to properly perform construction work on the aim work surface (see FIG. 8B described below).

In the front-face control with respect to the aim work surface (the upward slope surface), for example, when the left end vertical distance between the coordinate point at the left end of the claw tip of the bucket 6 and the aim work surface (hereinafter, simply referred to as "the left end vertical distance") is equal to the right end vertical distance between the coordinate point at the right end of the claw tip of the bucket 6 and the aim work surface (hereinafter, simply referred to as "the right end vertical distance"), the automatic control unit 54 determines that the excavator front-faces the aim work surface. Further, the automatic control unit 54 may determine that the excavator 100 front-faces the aim work surface, not when the left end vertical distance is equal to the right end vertical distance (that is, when the difference between the left end vertical distance and the right end vertical distance is zero), but when this difference is less than or equal to a predetermined value.

Further, in the front-face control with respect to the aim work surface (the upward slope surface), the automatic control unit 54 may operate the turning hydraulic motor 2A based on, for example, the difference between the left end vertical distance and the right end vertical distance. Specifically, if the lever device 26C corresponding to the turning operation is operated while the predetermined switch such as the MC switch or the like is pressed down, it is determined whether the lever device 26C is operated in a direction in which the upper turning body 3 is caused to front-face the aim work surface. For example, when the lever device 26C is operated in a direction in which the vertical distance between the claw tip of the bucket 6 and the aim work surface (the upward slope surface) is increased, the automatic control unit 54 does not perform the front-face control. On the other hand, when the turning operation lever is operated in a direction in which the vertical distance between the claw tip of the bucket 6 and the aim work surface (the upward slope surface) is reduced, the automatic control unit 54 performs front-face control. As a result, the automatic control unit 54 can operate the turning hydraulic motor 2A so that the difference between the left end vertical distance and the right end vertical distance is reduced. Thereafter, the automatic control unit 54 stops the turning hydraulic motor 2A when the difference becomes less than or equal to a predetermined value or zero. The automatic control unit 54 may set the turning angle, at which the difference is less than or equal to a predetermined value or equal to zero, as a target angle, and perform operation control of the turning hydraulic motor 2A so that the angle difference between the target angle and the present turning angle (specifically, a detected value based on a detection signal of the turning state sensor S5) becomes zero. In this case, the turning angle is, for example, the angle of the front-back axis of the upper turning body 3 relative to the reference direction.

As described above, when a turning electric motor is mounted to the excavator 100 instead of the turning hydraulic motor 2A, the automatic control unit 54 performs front-face control of the turning electric motor as a control target.

The turning angle calculating unit 55 calculates the turning angle of the upper turning body 3. This allows the controller 30 to identify the current orientation of the upper turning body 3. For example, the turning angle calculating unit 55 calculates (estimates) the turning angle of the upper turning body 3, based on the change in the position of the object that is stopped or fixed, included (appearing) in the captured image captured by the imaging device S6 (that is, the change in in the direction in which the object can be viewed), as described below. Details will be described later (with reference to FIGS. 5 to 8B).

The turning angle θxpresses the direction in which the attachment operation plane extends relative to the reference direction as viewed from the upper turning body 3 (that is, the direction in which the attachment extends in a top view of the upper turning body 3). The attachment operation plane is, for example, a virtual plane that traverses the attachment and is positioned perpendicular to the turning plane. A turning plane is, for example, a virtual plane including the bottom of a turning frame perpendicular to the turning axis. For example, the controller 30 (the machine guidance unit 50) may determine that the upper turning body 3 front-faces the aim work surface when it is determined that the attachment operation plane includes the normal line of the aim work surface.

The relative angle calculating unit 56 calculates the turning angle (hereinafter, "relative angle") necessary for causing the upper turning body 3 front-face the work target. The relative angle is a relative angle formed between the direction of the front-back axis of the upper turning body 3 when the upper turning body 3 front-faces the work target and the current direction of the front-back axis of the upper turning body 3, for example. For example, when causing the upper turning body 3 to front-face the dump truck to be loaded with earth and sand and the like, the relative angle calculating unit 56 calculates the relative angle based on the captured image captured by the imaging device S6 in which the loading platform of the dump truck is appearing, and the turning angle calculated by the turning angle calculating unit 55. For example, when causing the upper turning body 3 to front-face the aim work surface, the relative angle calculating unit 56 calculates the relative angle based on the data relating to the aim work surface stored in the storage device 47 and the turning angle calculated by the turning angle calculating unit 55.

When the lever device 26C corresponding to the turning operation is operated while the predetermined switch such as the MC switch or the like is pressed down, the automatic control unit 54 determines whether the turning operation is performed in a direction in which the upper turning body 3 is caused to front-face the work target. When the automatic control unit 54 determines that the turning operation has been performed in the direction in which the upper turning body 3 is caused to front-face the work target, the automatic control unit 54 sets the relative angle calculated by the relative angle calculating unit 56 as the target angle. When the turning angle changes after the lever device 26C is operated to reach the target angle, the automatic control unit 54 determines that the upper turning body 3 front-faces the work target and may stop the movement of the turning hydraulic motor 2A. Accordingly, the automatic control unit 54 can assist the operation by the operator with respect to the lever device 26C and allow the upper turning body 3 to front-face the work target on the basis of the configuration illustrated in FIG. 2. When a predetermined switch such as the MC switch or the like is pressed down, the automatic control unit 54 may cause the upper turning body 3 to automatically front-face the work target, regardless of the operation with respect to the lever device 26C.

[Hydraulic System of the Excavator]

Next, a hydraulic system of the excavator 100 according to the present embodiment will be described with reference to FIG. 3.

Figure 3:
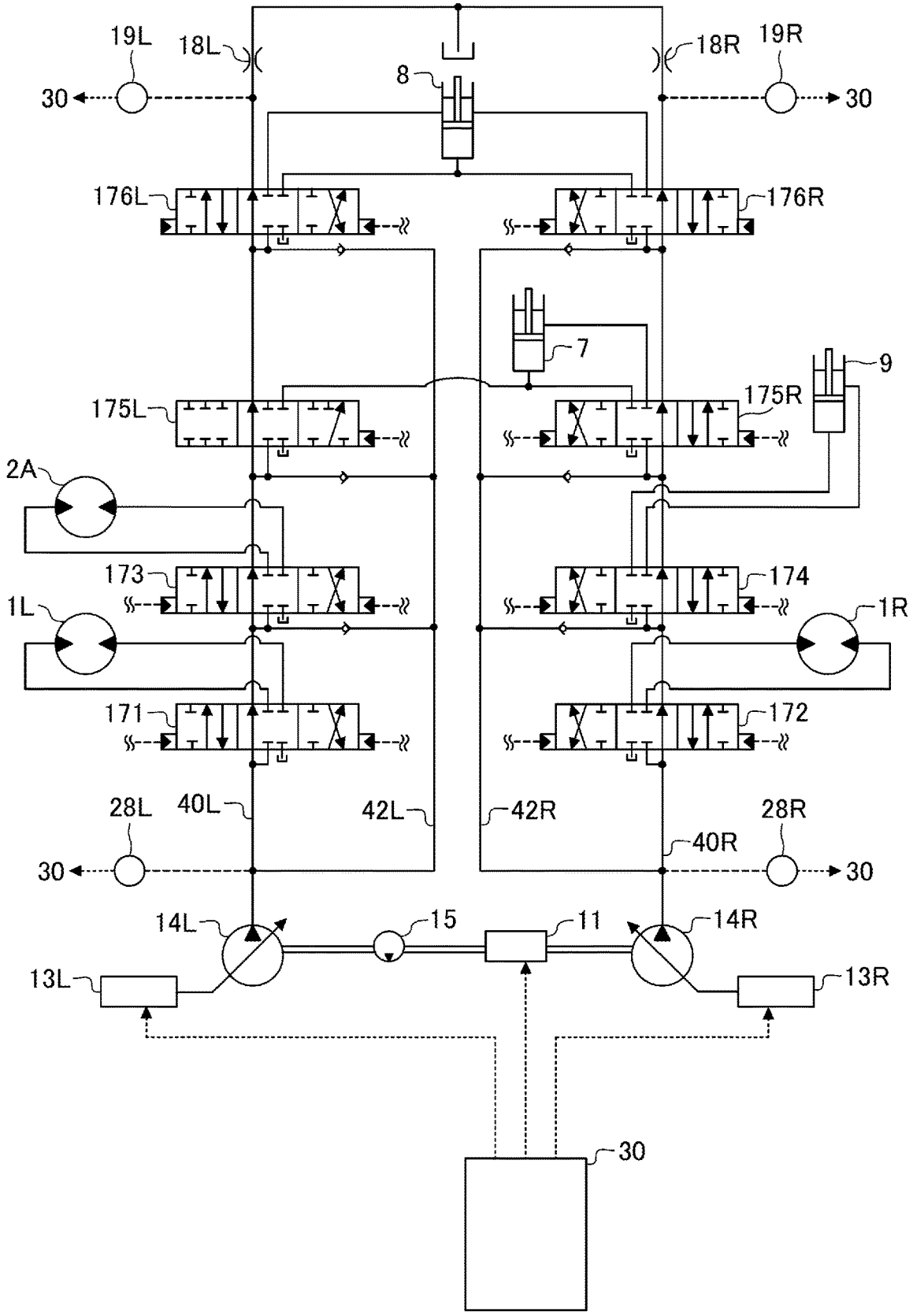
FIG. 3 is a diagram schematically illustrating an example of a configuration of a hydraulic system of an excavator.

FIG. 3 is a diagram schematically illustrating an example of the configuration of the hydraulic system of the excavator 100 according to the present embodiment.

In FIG. 3, the mechanical power system, the hydraulic oil line, the pilot line, and the electrical control system are illustrated as double, solid, dashed, and dotted lines, respectively, as in FIG. 2.

The hydraulic system realized by the hydraulic circuit circulates the hydraulic oil from each of the main pumps 14L and 14R driven by the engine 11 to the hydraulic oil tank through center bypass oil lines C1L and CIR, and parallel oil lines C2L and C2R.

The center bypass oil line CIL starts at the main pump 14L and passes through the control valves 171, 173, 175L, and 176L disposed in the control valve 17 in this order, to reach the hydraulic oil tank.

The center bypass oil line CIR starts at the main pump 14R and passes through control valves 172, 174, 175R, and 176R, which are disposed in the control valve 17 in this order, to reach the hydraulic oil tank.

The control valve 171 is a spool valve which supplies hydraulic oil discharged from the main pump 14L to the traveling hydraulic motor 1L and discharges the hydraulic oil discharged from the traveling hydraulic motor 1L to the hydraulic oil tank.

The control valve 172 is a spool valve which supplies hydraulic oil discharged from the main pump 14R to the traveling hydraulic motor 1R and discharges the hydraulic oil discharged from the traveling hydraulic motor 1R to the hydraulic oil tank.

The control valve 173 is a spool valve which supplies hydraulic oil discharged from the main pump 14L to the turning hydraulic motor 2A and discharges the hydraulic oil discharged from the turning hydraulic motor 2A to the hydraulic oil tank.

The control valve 174 is a spool valve which supplies hydraulic oil discharged from the main pump 14R to the bucket cylinder 9 and discharges the hydraulic oil in the bucket cylinder 9 to the hydraulic oil tank.

The control valves 175L and 175R are spool valves that supply the hydraulic oil discharged by the main pumps 14L and 14R to the boom cylinder 7, respectively, and discharge the hydraulic oil in the boom cylinder 7 to the hydraulic oil tank.

The control valves 176L and 176R supply the hydraulic oil discharged by the main pumps 14L and 14R to the arm cylinder 8, and discharge the hydraulic oil in the arm cylinder 8 to the hydraulic oil tank.

The control valves 171, 172, 173, 174, 175L, 175R, 176L, and 176R each adjust the flow rate of hydraulic oil supplied to and discharged from the hydraulic actuator and switch the direction of flow, depending on the pilot pressure acting on the pilot port.

The parallel oil line C2L supplies the hydraulic oil of the main pump 14L to the control valves 171, 173, 175L, and 176L in parallel with the center bypass oil line C1L. Specifically, the parallel oil line C2L branches from the center bypass oil line C1L at the upstream side of the control valve 171 and is configured to supply the hydraulic oil of the main pump 14L in parallel with each of the control valves 171, 173, 175L, and 176R. This allows the parallel oil line C2L to supply hydraulic oil to the control valve that is further downstream, when the flow of hydraulic oil passing through the center bypass oil line C1L is limited or blocked by one of the control valves 171, 173, and 175L.

The parallel oil line C2R supplies the hydraulic oil of the main pump 14R to the control valves 172, 174, 175R, and 176R in parallel with the center bypass oil line C1R. Specifically, the parallel oil line C2R branches from the center bypass oil line C1R at the upstream side of the control valve 172 and is configured to supply the hydraulic oil of the main pump 14R in parallel with each of the control valves 172, 174, 175R, and 176R. The parallel oil line C2R can supply hydraulic oil to a control valve further downstream when the flow of hydraulic oil passing through the center bypass oil line CIR is limited or blocked by one of the control valves 172, 174, and 175R.

The regulators 13L and 13R adjust the discharge amounts of the main pumps 14L and 14R by adjusting the tilt angles of the swash plates of the main pumps 14L and 14R, respectively, under the control of the controller 30.

The discharge pressure sensor 28L detects the discharge pressure of the main pump 14L, and a detection signal corresponding to the detected discharge pressure is loaded into the controller 30. The same applies to the discharge pressure sensor 28R. Thus, the controller 30 can control the regulators 13L and 13R according to the discharge pressures of the main pumps 14L and 14R.

In the center bypass oil lines C1L and C1R, negative control diaphragms (hereinafter, "negative control diaphragms") 18L and 18R are provided between the control valves 176L and 176R, which are most downstream, and the hydraulic oil tank, respectively. Accordingly, the flow of hydraulic oil discharged by the main pumps 14L and 14R is limited by the negative control diaphragms 18L and 18R. The negative control diaphragms 18L and 18R generate a control pressure (hereinafter, "negative control pressure") for controlling the regulators 13L and 13R.

Negative control pressure sensors 19L and 19R detect the negative control pressure, and the detection signal corresponding to the detected negative control pressure is loaded into the controller 30.

The controller 30 may control the regulators 13L and 13R according to the discharge pressures of the main pumps 14L and 14R detected by the discharge pressure sensors 28L and 28R to adjust the discharge amounts of the main pumps 14L and 14R. For example, the controller 30 may control the regulator 13L according to an increase in the discharge pressure of the main pump 14L to adjust the tilt angle of the swash plate of the main pump 14L to reduce the discharge amount. The same applies to the regulator 13R. Accordingly, the controller 30 can control the total horsepower of the main pumps 14L and 14R so that the suction horsepower of the main pumps 14L and 14R, which is expressed as the product of the discharge pressure and the discharge amount, does not exceed the output horsepower of the engine 11.

The controller 30 may adjust the discharge amount of the main pumps 14L and 14R by controlling the regulators 13L and 13R according to the negative control pressure detected by the negative control pressure sensors 19L and 19R. For example, the controller 30 decreases the discharge amount of the main pumps 14L and 14R as the negative control pressure increases, and increases the discharge amount of the main pumps 14L and 14R as the negative control pressure decreases.

Specifically, in the standby state in which none of the hydraulic actuators in the excavator 100 are operated (the state illustrated in FIG. 3), the hydraulic oil discharged from the main pumps 14L and 14R reaches the negative control diaphragms 18L and 18R through the center bypass oil lines CIL and CIR. The flow of hydraulic oil discharged from the main pumps 14L and 14R increases the negative control pressure generated upstream of the negative control diaphragms 18L and 18R. As a result, the controller 30 reduces the discharge amount of the main pumps 14L and 14R to the allowable minimum discharge amount and suppresses the pressure loss (pumping loss) when the discharged hydraulic oil passes through the center bypass oil lines C1L and C1R.

On the other hand, when any of the hydraulic actuators are operated through the operation apparatus 26, the hydraulic oil discharged from the main pumps 14L and 14R flows into the hydraulic actuator to be operated through a control valve corresponding to the hydraulic actuator to be operated. The flow of the hydraulic oil discharged from the main pumps 14L and 14R decreases or eliminates the amount reaching the negative control diaphragms 18L and 18R, thereby lowering the negative control pressure generated upstream of the negative control diaphragms 18L and 18R. As a result, the controller 30 can increase the discharge amount of the main pumps 14L and 14R, circulate sufficient hydraulic oil in the hydraulic actuator to be operated, and reliably drive the hydraulic actuator to be operated.

[Details of Configuration Relating to Machine Control Function of Excavator]

Figure 4A:
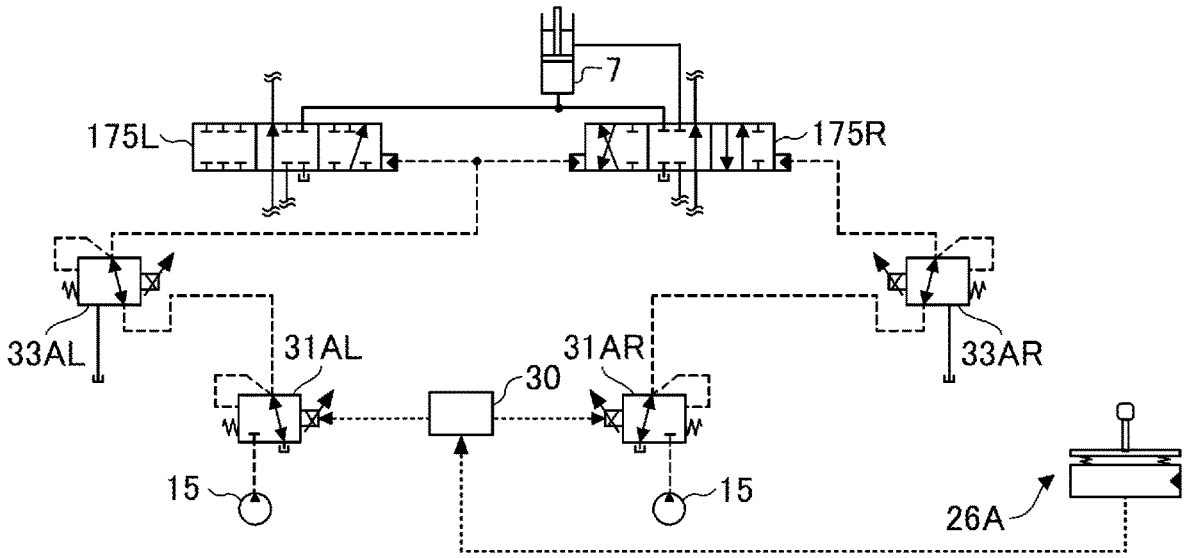
FIG. 4A is a diagram illustrating an example of a configuration of an operation system of a hydraulic system of an excavator.
Figure 4B:
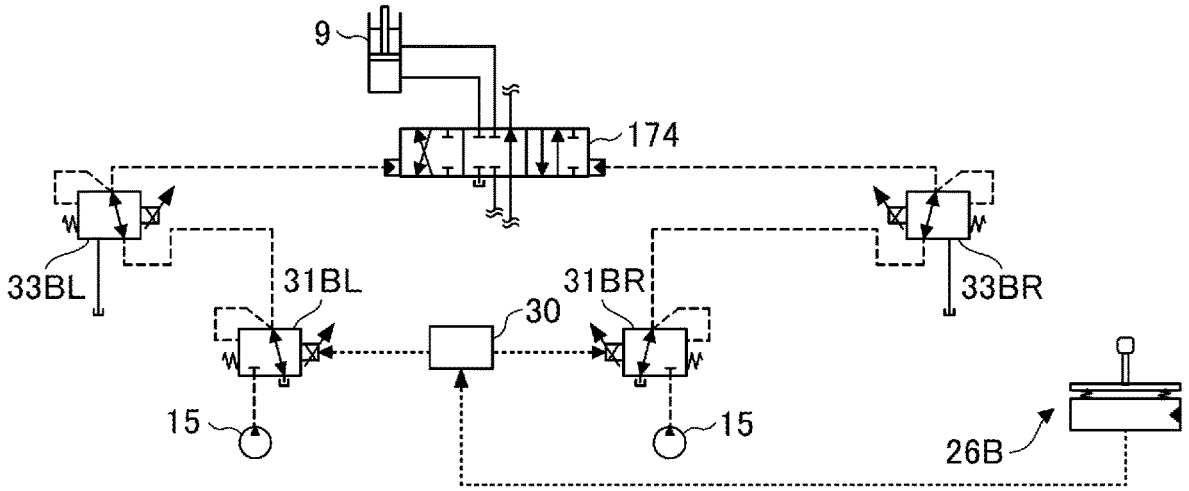
FIG. 4B is a diagram illustrating an example of a configuration of an operation system of a hydraulic system of an excavator.
Figure 4C:
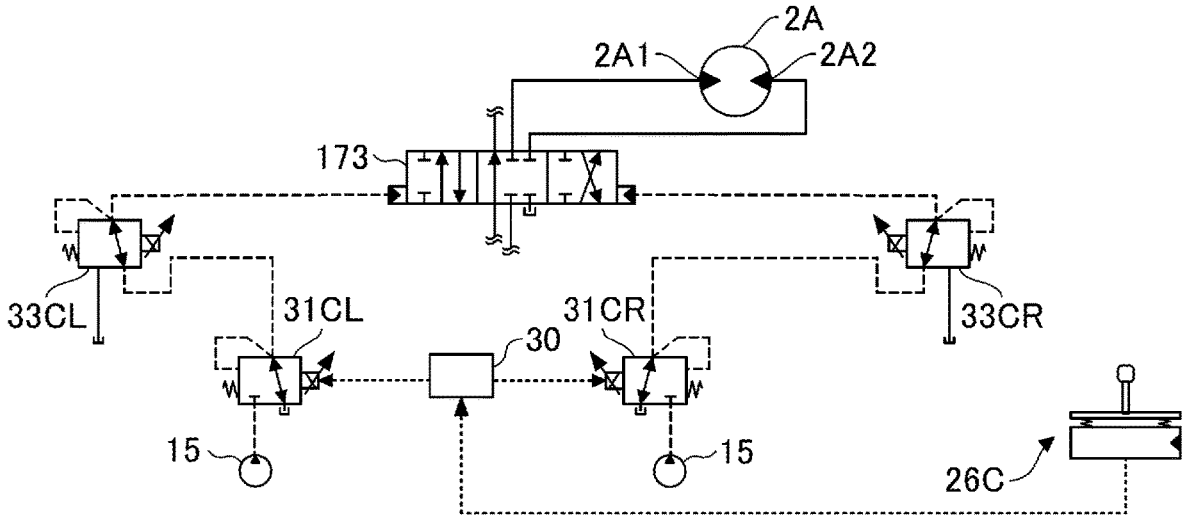
FIG. 4C is a diagram illustrating an example of a configuration of an operation system of a hydraulic system of an excavator.

Referring now to FIG. 4 (FIGS. 4A-4C), details of the configuration relating to the machine control function of the excavator 100 will be described.

FIGS. 4A to 4C schematically illustrate an example of a configuration relating to the operation system of the hydraulic system of the excavator 100 according to the present embodiment. Specifically, FIG. 4A is a diagram illustrating an example of a pilot circuit for applying pilot pressure to the control valves 175L and 175R for hydraulic control of the boom cylinder 7. FIG. 4B is a diagram illustrating an example of a pilot circuit for applying pilot pressure to the control valve 174 for hydraulic control of the bucket cylinder 9. FIG. 4C is a diagram illustrating an example of a pilot circuit for applying pilot pressure to the control valve 173 for hydraulic control of the turning hydraulic motor 2A.

For example, as illustrated in FIG. 4A, the lever device 26A is used by an operator or the like to operate the boom cylinder 7 corresponding to the boom 4. The lever device 26A outputs an electrical signal (hereinafter, an "operation content signal") according to the operation content (for example, the operation direction and the operation amount) to the controller 30.

In the controller 30, an association relationship is set in advance, with respect to the control current to the proportional valve 31 according to the operation amount of the operation apparatus 26 (e.g., the tilting angle of the lever devices 26A-26C). The proportional valve 31 corresponding to each of the individual lever devices (such as the lever devices 26A-26C) included in the operation apparatus 26, is controlled based on the association relationship that is set.

The proportional valve 31AL operates in response to a control current input from the controller 30. Specifically, the proportional valve 31AL uses the hydraulic oil discharged from the pilot pump 15 to output a pilot pressure corresponding to the control current input from the controller 30, to the pilot port on the right side of the control valve 175L and to the pilot port on the left side of the control valve 175R. This allows the proportional valve 31AL to adjust the pilot pressure acting on the pilot port on the right side of the control valve 175L and the pilot port on the left side of the control valve 175R. For example, by receiving input of a control current from the controller 30 corresponding to an operation for raising the boom 4 (hereinafter referred to as "the boom raising operation") performed on the lever device 26A, the proportional valve 31AL can apply a pilot pressure according to the operation content (the amount of operation) with respect to the lever device 26A, on the pilot port on the right side of the control valve 175L and the pilot port on the left side of the control valve 175R. Further, by inputting a predetermined control current from the controller 30 without depending on the operation content of the lever device 26A, the proportional valve 31AL can apply a pilot pressure to the pilot port on the right side of the control valve 175L and the pilot port on the left side of the control valve 175R, regardless of the operation content of the lever device 26A.

The proportional valve 31AR operates in response to a control current input from the controller 30. Specifically, the proportional valve 31AR uses the hydraulic oil discharged from the pilot pump 15 to output a pilot pressure corresponding to the control current input from the controller 30 to the pilot port on the right side of the control valve 175R. This allows the proportional valve 31AR to adjust the pilot pressure acting on the pilot port on the right side of the control valve 175R. For example, by receiving input of a control current from the controller 30 corresponding to an operation for lowering the boom 4 (hereinafter referred to as "the boom lowering operation") performed on the lever device 26A, the proportional valve 31AR can apply a pilot pressure according to the operation content (the amount of operation) with respect to the lever device 26A, on the pilot port on the right side of the control valve 175R. Further, by inputting a predetermined control current from the controller 30 without depending on the operation content of the lever device 26A, the proportional valve 31AR can apply a pilot pressure on the pilot port on the right side of the control valve 175R regardless of the operation content of the lever device 26A.

That is, when a boom raising operation is performed, the lever device 26A outputs an operation content signal according to the operation direction and the operation amount to the controller 30 to apply a pilot pressure according to the operation content on the pilot port on the right side of the control valve 175L and the pilot port on the left side of the control valve 175R via the controller 30 and the proportional valve 31AL. When a boom lowering operation is performed, the lever device 26A outputs an operation content signal according to the operation direction and the operation amount to the controller 30 to apply a pilot pressure according to the operation content on the pilot port on the right side of the control valve 175R via the controller 30 and the proportional valve 31AR.

Thus, the proportional valves 31AL and 31AR can adjust the pilot pressure output to the secondary side so that the control valves 175L and 175R can be stopped at any valve position, according to the operation state of the lever device 26A, under the control of the controller 30. The proportional valves 31AL and 31AR can also adjust the pilot pressure output to the secondary side so that the control valves 175L and 175R can be stopped at any valve position under the control of the controller 30, regardless of the operation state of the lever device 26A.

The decompression proportional valve 33AL is disposed on a pilot line between the proportional valve 31AL, and the pilot port on the right side of the control valve 175L and the pilot port on the left side of the control valve 175R. The controller 30 reduces the pilot pressure by discharging the hydraulic oil on the pilot line into the tank when the controller 30 determines that a braking operation to decelerate or stop the hydraulic actuator (the boom cylinder 7) is necessary based on a signal from the object detection device (e.g., the imaging device S6). This allows the spools of the control valves 175L and 175R to move in the neutral direction regardless of the state of the proportional valve 31AL. Therefore, the decompression proportional valve 33AL is effective where it is desired to improve the braking characteristics.

In the present embodiment, it is not necessarily needed to include the decompression proportional valve 33AL, and the decompression proportional valve 33AL may be omitted. Hereinafter, the same applies to the other decompression proportional valves 33 (the decompression proportional valves 33AR, 33BL, 33BR, 33CL, 33CR, etc.).

The decompression proportional valve 33AR is disposed on a pilot line between the proportional valve 31AR and the pilot port on the right side of the control valve 175R. The controller 30 reduces the pilot pressure by discharging the hydraulic oil on the pilot line to the tank when the controller 30 determines that a braking operation to decelerate or stop the hydraulic actuator (the boom cylinder 7) is necessary based on a signal from an object detection device (e.g., the imaging device S6). This allows the spools of the control valves 175L and 175R to move in the neutral direction regardless of the state of the proportional valve 31AR. Therefore, the decompression proportional valve 33AR is effective where it is desired to improve the braking characteristics.

The controller 30 may control the proportional valve 31AL in response to an operation content signal corresponding to a boom raising operation by the operator with respect to the lever device 26A, to supply pilot pressure according to the operation content (the operation amount) of the lever device 26A, to the pilot port on the right side of the control valve 175L and the pilot port on the left side of the control valve 175R. The controller 30 may control the proportional valve 31AR in response to an operation content signal corresponding to a boom lowering operation by the operator with respect to the lever device 26A, to supply pilot pressure according to the operation content (the operation amount) of the lever device 26A, to the pilot port on the right side of the control valve 175R. That is, the controller 30 may control the proportional valves 31AL and 31AR according to the operation content signal input from the lever device 26A to implement the operation of raising or lowering of the boom 4 according to the operation content of the lever device 26A.

The controller 30 may control the proportional valve 31AL, regardless of the boom raising operation by the operator with respect to the lever device 26A, to supply hydraulic oil discharged from the pilot pump 15 to the pilot port on the right side of the control valve 175L and the pilot port on the left side of the control valve 175R. The controller 30 may control the proportional valve 31AR regardless of the boom lowering operation by the operator with respect to the lever device 26A, to supply hydraulic oil discharged from the pilot pump 15 to the pilot port on the right side of the control valve 175R. That is, the controller 30 can automatically control the raising and lowering movement of the boom 4.

As illustrated in FIG. 4B, the lever device 26B is used by an operator or the like to operate the bucket cylinder 9 corresponding to the bucket 6. The lever device 26B outputs an operation content signal according to the operation content of the lever device 26B (e.g., the operation direction and the operation amount), to the controller 30.

The proportional valve 31BL operates in response to a control current input from the controller 30. Specifically, the proportional valve 31BL uses hydraulic oil discharged from the pilot pump 15 to output pilot pressure corresponding to the control current input from the controller 30 to the pilot port on the left side of the control valve 174. This allows the proportional valve 31BL to adjust the pilot pressure acting on the pilot port on the left side of the control valve 174. For example, by inputting a control current corresponding to the operation of the bucket 6 in the closing direction (hereinafter, "bucket closing operation") from the controller 30 to the lever device 26B, the proportional valve 31BL can apply, to the pilot port on the left side of the control valve 174, a pilot pressure according to the operation content (the operation amount) of the lever device 26B. Further, by inputting a predetermined control current from the controller 30 without depending on the operation content of the lever device 26B, the proportional valve 31BL can apply a pilot pressure to the pilot port on the left side of the control valve 174 regardless of the operation content of the lever device 26B.

The proportional valve 31BR operates in response to the control current output by the controller 30. Specifically, the proportional valve 31BR uses hydraulic oil discharged from the pilot pump 15 to output a pilot pressure corresponding to the control current input from the controller 30, to the pilot port on the right side of the control valve 174. This allows the proportional valve 31BR to adjust the pilot pressure acting on the pilot port on the right of the control valve 174 via the shuttle valve 32BR. For example, by inputting a control current corresponding to an operation in the direction of the opening the bucket 6 (hereinafter referred to as "the bucket opening operation"), from the controller 30 to the lever device 26B, the proportional valve 31BR can apply a pilot pressure corresponding to the operation content (the operation amount) of the lever device 26B, to the pilot port on the right side of the control valve 174. Further, by inputting a predetermined control current from the controller 30 without depending on the operation content of the lever device 26B, the proportional valve 31BR can apply a pilot pressure on the pilot port on the right side of the control valve 174 regardless of the operation content of the lever device 26B.

That is, when a bucket closing operation is performed, the lever device 26B outputs an operation content signal according to the operation direction and the operation amount to the controller 30 and causes the pilot port on the left side of the control valve 174 to apply a pilot pressure according to the operation content via the controller 30 and the proportional valve 31BL. When a bucket opening operation is performed, the lever device 26B outputs an operation content signal according to the operation direction and the operation amount to the controller 30, and applies a pilot pressure according to the operation content on the pilot port on the right side of the control valve 174 via the controller 30 and the proportional valve 31BR.

Thus, the proportional valves 31BL, 31BR can adjust the pilot pressure output to the secondary side so that the control valve 174 can be stopped at any valve position, according to the operation state of the lever device 26B, under the control of the controller 30. Further, the proportional valves 31BL, 31BR can adjust the pilot pressure output to the secondary side so that the control valve 174 can be stopped in any valve position, regardless of the operation state of the lever device 26B.

The decompression proportional valve 33BL is disposed on a pilot line between the proportional valve 31BL and the pilot port on the left side of the control valve 174. The controller 30 reduces the pilot pressure by discharging the hydraulic oil on the pilot line into the tank, when the controller 30 determines that a braking operation to decelerate or stop the hydraulic actuator (the bucket cylinder 9) is necessary, based on a signal from an object detection device (e.g., the imaging device S6). This allows the spool of the control valve 174 to move in the neutral direction regardless of the state of the proportional valve 31BL. Therefore, the decompression proportional valve 33BL is effective where it is desired to improve the braking characteristics.

The decompression proportional valve 33BR is disposed on a pilot line between the proportional valve 31BR and the pilot port on the right side of the control valve 174. The controller 30 reduces the pilot pressure by discharging the hydraulic oil on the pilot line to the tank, when the controller 30 determines that a braking operation to decelerate or stop the hydraulic actuator (the bucket cylinder 9) is necessary based on a signal from an object detection device (e.g., the imaging device S6). This allows the spool of the control valve 174 to move in the neutral direction regardless of the state of the proportional valve 31BR. Therefore, the decompression proportional valve 33BR is effective where it is desired to improve the braking characteristics.

The controller 30 can control the proportional valve 31BL in response to an operation content signal corresponding to a bucket closing operation by the operator with respect to the lever device 26B to supply pilot pressure according to the operation content (the operation amount) of the lever device 26B, to the pilot port on the left side of the control valve 174. Further, the controller 30 can control the proportional valve 31BR in response to an operation content signal corresponding to an operation of opening the bucket by the operator with respect to the lever device 26B to supply pilot pressure according to the operation content (the operation amount) of the lever device 26B, to the pilot port on the right side of the control valve 174. That is, the controller 30 can control the proportional valves 31BL and 31BR according to an operation content signal input from the lever device 26B to implement the opening/closing operation of the bucket 6 according to the operation content of the lever device 26B.

Further, the controller 30 can control the proportional valve 31BL, regardless of the bucket closing operation by the operator with respect to on the operator lever device 26B, to supply hydraulic oil discharged from the pilot pump 15 to the pilot port on the left side of the control valve 174. Further, the controller 30 can control the proportional valve 31BR, regardless of the bucket opening operation by the operator with respect to the operator lever device 26B, to supply hydraulic oil discharged from the pilot pump 15 to the pilot port on the right side of the control valve 174. That is, the controller 30 can automatically control the opening/closing operation of the bucket 6.

For example, as illustrated in FIG. 4C, the lever device 26C is used to operate the turning hydraulic motor 2A corresponding to the upper turning body 3 (the turning mechanism 2) by an operator or the like. The lever device 26C outputs an operation content signal according to the operation content thereof (e.g., the operation direction and the operation amount) to the controller 30.

The proportional valve 31CL operates in response to a control current input from the controller 30. Specifically, the proportional valve 31CL uses hydraulic oil discharged from the pilot pump 15 to output pilot pressure corresponding to the control current input from the controller 30 to the pilot port on the left side of the control valve 173. This allows the proportional valve 31CL to adjust the pilot pressure acting on the pilot port on the left side of the control valve 173. For example, by inputting a control current corresponding to the turning operation in the left direction of the upper turning body 3 (hereinafter referred to as "left turning operation"), from the controller 30 to the lever device 26C, the proportional valve 31CL can apply a pilot pressure according to the operation content (the operation amount) of the lever device 26C to the pilot port on the left side of the control valve 173. Further by inputting a predetermined control current from the controller 30 without depending on the operation content of the lever device 26C, the proportional valve 31CL can apply a pilot pressure on the pilot port on the left side of the control valve 173 regardless of the operation content of the lever device 26C.

The proportional valve 31CR operates in response to the control current output by the controller 30. Specifically, the proportional valve 31CR uses hydraulic oil discharged from the pilot pump 15 to output pilot pressure corresponding to the control current input from the controller 30 to the pilot port on the right side of the control valve 173. This allows the proportional valve 31CR to adjust the pilot pressure acting on the pilot port on the right side of the control valve 173. For example, by inputting a control current corresponding to a turning operation in the right direction of the upper turning body 3 (hereinafter referred to as "right turning operation"), from the controller 30 to the lever device 26C, the proportional valve 31CR can apply a pilot pressure to the pilot port on the right side of the control valve 173 according to the operation content (the operation amount) of the lever device 26C. Further, by inputting a predetermined control current from the controller 30 without depending on the operation content of the lever device 26C, the proportional valve 31CR can apply a pilot pressure on the pilot port on the right side of the control valve 173 regardless of the operation content of the lever device 26C.

That is, when a left turning operation is performed, the lever device 26C outputs an operation content signal according to the operation direction and the operation amount to the controller 30 and applies a pilot pressure according to the operation content on the pilot port on the left side of the control valve 173 via the controller 30 and the proportional valve 31CL. When a right turning operation is performed, the lever device 26C outputs an operation content signal according to the operation direction and the operation amount to the controller 30 and applies a pilot pressure according to the operation content on the pilot port on the right side of the control valve 173 via the controller 30 and the proportional valve 31CR.

Thus, the proportional valves 31CL and 31CR can adjust the pilot pressure output to the secondary side so that the control valve 173 can be stopped at any valve position according to the operation state of the lever device 26C, under the control of the controller 30. Further, the proportional valves 31CL and 31CR can adjust the pilot pressure output to the secondary side so that the control valve 173 can be stopped at any valve position, regardless of the operation state of the lever device 26C.

The decompression proportional valve 33CL is positioned on a pilot line between the proportional valve 31CL and the pilot port on the left side of the control valve 173. The controller 30 reduces the pilot pressure by discharging the hydraulic oil on the pilot line into the tank when the controller 30 determines that a braking operation to decelerate or stop the hydraulic actuator (the turning hydraulic motor 2A) is necessary based on a signal from an object detection device (e.g., the imaging device S6, etc.). This allows the spool of the control valve 173 to move in the neutral direction regardless of the state of the proportional valve 31CL. Therefore, the decompression proportional valve 33CL is effective where it is desired to improve the braking characteristics.

The decompression proportional valve 33CR is disposed on a pilot line between the proportional valve 31CR and the pilot port on the right side of the control valve 173. The controller 30 reduces the pilot pressure by discharging the hydraulic oil on the pilot line to the tank when the controller 30 determines that a braking operation to decelerate or stop the hydraulic actuator (the turning hydraulic motor 2A) is necessary based on a signal from an object detection device (e.g., the imaging device S6, etc.). This allows the spool of the control valve 173 to move in the neutral direction regardless of the state of the proportional valve 31CR. Therefore, the decompression proportional valve 33CR is effective where it is desired to improve the braking characteristics.

The controller 30 can control the proportional valve 31CL in response to an operation content signal corresponding to a left turning operation by the operator with respect to the lever device 26C to supply pilot pressure according to the operation content (the operation amount) of the lever device 26C, to the pilot port on the left side of the control valve 173. Further, the controller 30 can control the proportional valve 31CR in response to an operation content signal corresponding to a right turning operation by the operator with respect to the lever device 26C to supply a pilot pressure corresponding to an operation content (the operation amount) of the lever device 26C to the pilot port on the right side of the control valve 173. That is, the controller 30 can control the proportional valves 31CL and 31CR according to an operation content signal input from the lever device 26C to implement the opening/closing operation of the bucket 6 according to the operation content of the lever device 26C.

The controller 30 controls the proportional valve 31CL regardless of the left turning operation by the operator with respect to the lever device 26C to supply hydraulic oil discharged from the pilot pump 15 to the pilot port on the left side of the control valve 173. Further, the controller 30 can control the proportional valve 31CR regardless of a right turning operation by the operator with respect to the lever device 26C, to supply hydraulic oil discharged from the pilot pump 15 to the pilot port on the right side of the control valve 173. That is, the controller 30 can automatically control the turning motion of the upper turning body 3 in the right and left directions.

The excavator 100 may further include a configuration for automatically opening and closing the arm 5 and a configuration for automatically moving forward and backward the lower traveling body 1 (specifically, the right and left crawlers). In this case, in the hydraulic system, the configuration portions relating to an operation system of the arm cylinder 8, the configuration portions relating to an operation system of the traveling hydraulic motor 1L, and the configuration portions relating to an operation of the traveling hydraulic motor 1R may be configured in the same manner as the configuration portions relating to the operation system of the boom cylinder 7 (FIGS. 4A to 4C).

[Estimation Method of Turning Angle (First Example)]

Figure 5:
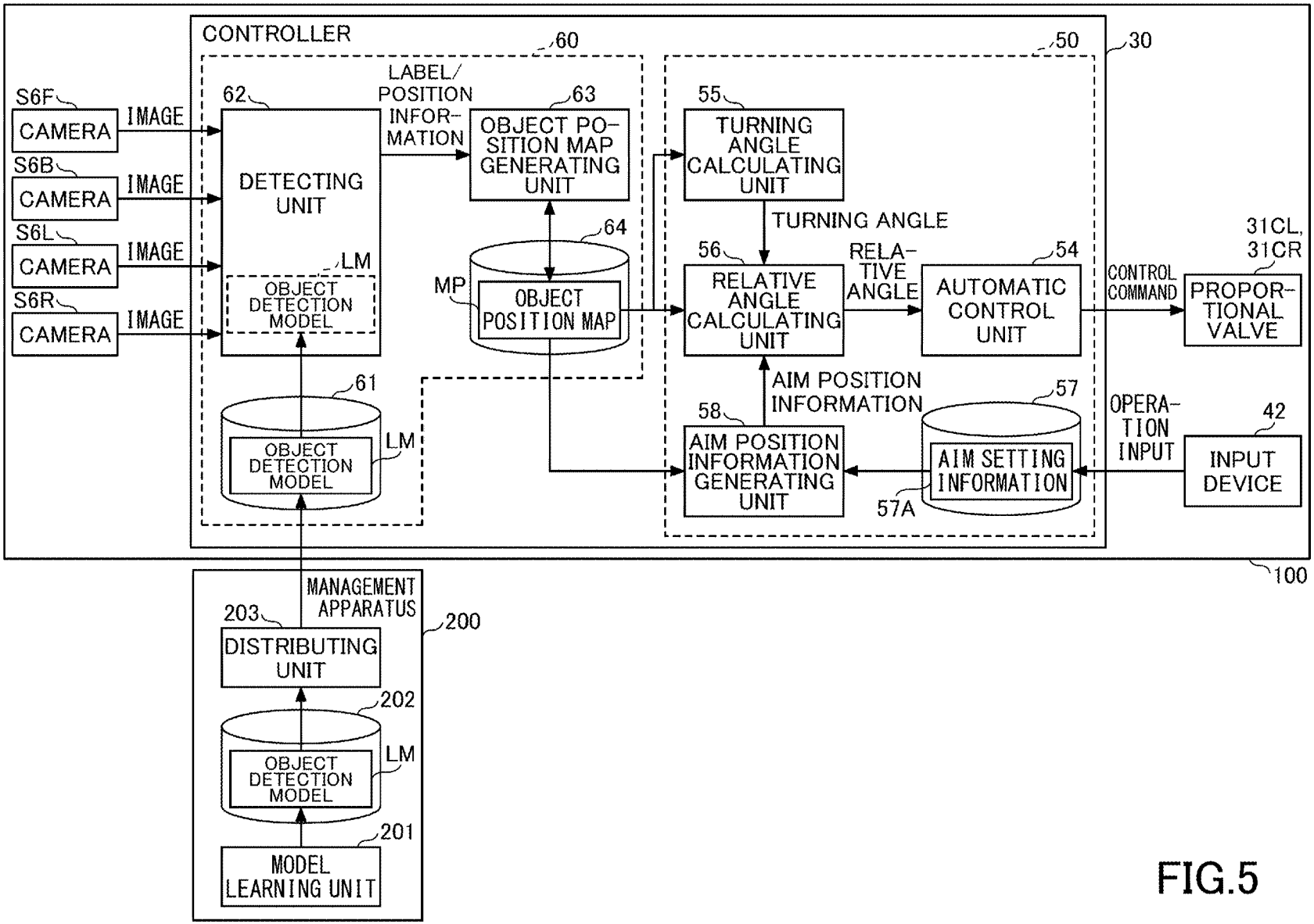
FIG. 5 is a diagram illustrating a first example of an estimation method of a turning angle of an excavator.
Figure 6A:
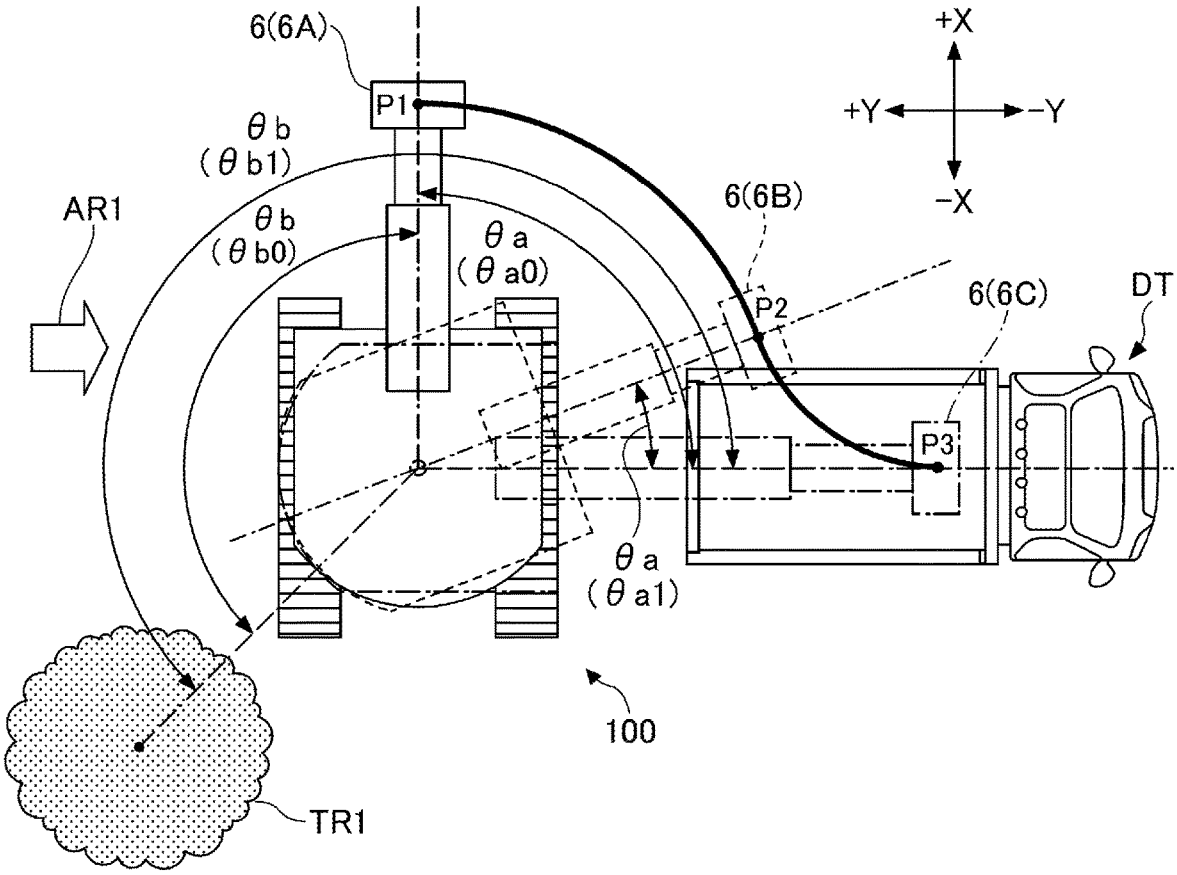
FIG. 6A is a diagram illustrating a first example of an estimation method of a turning angle of an excavator.
Figure 6B:
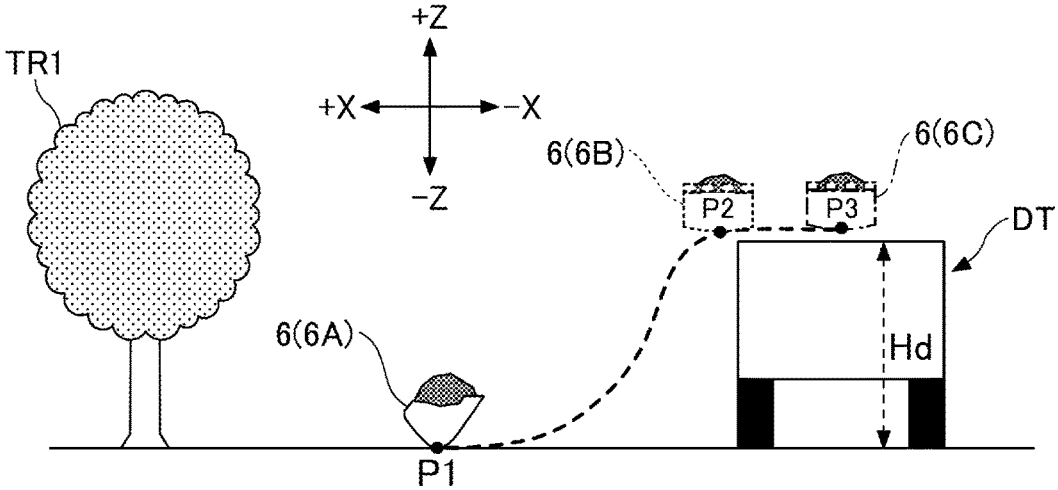
FIG. 6B is a diagram illustrating a first example of an estimation method of a turning angle of an excavator.

Next, a first example of a method for estimating a turning angle by the controller 30 (the turning angle calculating unit 55) will be described with reference to FIGS. 5 and 6 (FIGS. 6A and 6B).

<Functional Configuration Relating to Estimation of Turning Angle>

FIG. 5 is a functional block diagram illustrating the first example of functional configurations relating to the estimation of a turning angle of the excavator 100 according to the present embodiment.

As illustrated in FIG. 5, in the present example, the excavator 100 is communicatively connected to the management apparatus 200 using the communication device T1.

The functions of the management apparatus 200 may be implemented by any hardware or a combination of hardware and software. For example, the management apparatus 200 is configured mainly as a server computer including a processor such as a CPU, a memory device such as a RAM, an auxiliary storage device such as a ROM, and an interface device for communication with external devices. The management apparatus 200 includes a model learning unit 201 and a distributing unit 203 as functional units that are implemented by executing, for example, a program installed in the auxiliary storage device on the CPU. The management apparatus 200 uses a learning result storage unit 202 or the like. The learning result storage unit 202 or the like can be implemented by, for example, an auxiliary storage device of the management apparatus 200 or an external storage device capable of communication.

The model learning unit 201 performs machine learning with respect to a learning model by using a predetermined teaching dataset and outputs a learned model (an object detection model LM) as a result of what is known as supervised learning. The generated object detection model LM is stored in the learning result storage unit 202 upon being subjected to accuracy verification by using a verification dataset prepared in advance. Further, the model learning unit 201 may generate an additional learned model by performing additional learning with respect to the object detection model LM by using a teaching dataset for additional learning. The additional learned model may be subjected to the accuracy verification using the pre-prepared verification dataset, and the object detection model LM in the learning result storage unit 202 may be updated with the additional learned model that has undergone the accuracy verification.

The object detection model LM determines the presence or absence of a predetermined object (e.g., a person, a vehicle, another work machine, a building, a pylon, a utility pole, a tree, etc.) (hereinafter referred to as a "target object") in a captured image of the worksite, by using a captured image of the worksite captured by the object detection device, point group data, etc., as input information, and determines the type of the target object, the position of the target object, and the size of the target object, or the like. The object detection model LM outputs information on the determination result (for example, label information representing the type of the target object or position information representing the position of the target object). That is, when the object detection model LM is applied to the excavator 100, the object detection model LM can determine the presence or absence of a target object around the excavator 100, the type of the target object, and the position of the target object, based on the captured image captured by the imaging device S6. The base learning model and the object detection model LM generated as a result of learning the base learning model may be configured, for example, mainly as a known deep neural network (DNN).

Note that the teaching dataset and the accuracy verification dataset may be generated, for example, based on captured images of various worksites captured by the imaging device S6, uploaded from the excavator 100 from time to time. Further, the teaching dataset and the accuracy verification dataset may be generated based on an image of a worksite that is artificially generated using, for example, techniques associated with computer graphics.

The learning result storage unit 202 stores the object detection model LM generated by the model learning unit 201. The object detection model LM in the learning result storage unit 202 may be updated by an additional learned model generated by the model learning unit 201.

The distributing unit 203 distributes the latest object detection model LM stored in the learning result storage unit 202 to the excavator 100.

In the present example, the excavator 100 includes the imaging device S6 (the cameras S6F, S6B, S6L, and S6R), the controller 30, the proportional valves 31CL and 31CR, and the input device 42 as configurations relating to the estimation of the turning angle.

The controller 30 includes a surrounding status recognizing unit 60 and the machine guidance unit 50 as described above as configurations relating to the estimation of the turning angle.

The surrounding status recognizing unit 60 includes, for example, a model storage unit 61, a detecting unit 62, an object position map generating unit 63, and a map storage unit 64.

The model storage unit 61 stores the latest object detection model LM received from the management apparatus 200 through the communication device T1.

The detecting unit 62 detects a target object around the upper turning body 3 based on a captured image input from the imaging device S6 (the cameras S6F, S6B, S6L, and S6R). Specifically, the detecting unit 62 reads the object detection model LM from the model storage unit 61 and makes determinations relating to the target object around the upper turning body 3 using the object detection model LM (for example, determines the presence or absence of a target object, the type of the target object, the position of the target object, the size of the target object, or the like). The detecting unit 62 outputs, for example, label information indicating the type of the detected target object, position information of the target object, information relating to the size of the target object, and the like. When no target object is detected, the detecting unit 62 may output label information indicating that a target object is not detected. In the present example, captured images captured by a plurality of cameras (the cameras S6F, S6B, S6L, and S6R) can be used, so that the detecting unit 62 can detect a target object across the entire surrounding area of the upper turning body 3, that is, a target object within a wider target range. Although an example in which the imaging device S6 is used is described, the detecting unit 62 may receive a reflected signal of an output signal (e.g., laser, infrared ray, electromagnetic wave, ultrasonic wave, or the like) output to the surroundings of the excavator 100 and calculate the distance to the object around the excavator 100 by using point group data or the like. Further, the detecting unit 62 can obtain label information representing the type of the target object and position information representing the position of the target object according to the shape of the point group and the distance to the point group or the like based on the received reflected signal.

The object position map generating unit 63 generates map information (an object position map MP) representing the position of the target object detected by the detecting unit 62, and the generated object position map MP is stored in the map storage unit 64. The object position map MP includes the position information of the excavator 100, the position information of each detected target object, and information on the type of the target object and the size of the target object associated with the position information of each object. For example, the object position map generating unit 63 may create an object position map MP according to the detection cycle of the detecting unit 62 from the activation to the stop of the excavator 100 and sequentially update the object position map MP in the map storage unit 64 with the latest object position map MP.

The distance range in which the target object can be detected by the detecting unit 62 with reference to the excavator 100 (the upper turning body 3) is limited, and, therefore, for example, if the excavator 100 travels by the lower traveling body 1, the position of the target object included in the object position map MP may become a position outside the detection range. That is, if the excavator 100 moves by the lower traveling body 1, the controller 30 may not be able to identify whether an object at a position relatively distant from the excavator 100 is remaining at that position or whether this object has moved from that position. Accordingly, at the time of the updating, the object position map generating unit 63 may delete information on the target object located a certain distance from the excavator 100 (own machine) included in the object position map MP, or may leave the information to remain in the map information upon appending a flag or the like indicating that this information is of low accuracy, for example.

The map storage unit 64 stores the latest object position map MP generated by the object position map generation unit 63.

The machine guidance unit 50 includes the automatic control unit 54, the turning angle calculating unit 55, the relative angle calculating unit 56, a storage unit 57, and an aim position information generating unit 58 as functional configurations relating to the estimation of the turning angle.

As described above, the automatic control unit 54 controls the proportional valves 31CL and 31CR based on the relative angle calculated (estimated) by the relative angle calculating unit 56 to cause the upper turning body 3 to front-face a work target around the excavator 100 (own machine). That is, the automatic control unit 54 controls the turning motion of the upper turning body 3 so that the upper turning body 3 front-faces the work target based on the relative angle calculated by the relative angle calculating unit 56. In the present example, as will be described later, the automatic control unit 54 causes the upper turning body 3 to front-face the target object corresponding to the work target selected by the operator among the one or more target objects recognized in the object position map MP.

The turning angle calculating unit 55 recognizes a target object that is in a stopped state (hereinafter, a "stopped target object") or a target object that is fixed (hereinafter, a "fixed target object") around the excavator 100 based on a captured image captured by the imaging device S6. A stopped target object means a target object that is in a stopped state without moving (e.g., a dump truck that is in a stopped state and waiting for earth and sand to be loaded) among movable target objects. A fixed target object means a target object (e.g., a tree, a utility pole, etc.) that is fixed at a certain position without moving. Specifically, the turning angle calculating unit 55 recognizes (extracts) a stopped target object or a fixed target object around the excavator 100 based on the object position map MP stored in the map storage unit 64 and determines a target object to be a reference object (hereinafter, a "reference target object") among the recognized target objects. For example, as described below, the turning angle calculating unit 55 may determine, as the reference target object, a stopped target object or a fixed target object corresponding to a selected work target, among a plurality of target objects included in the object position map MP, based on an operation input through the input device 42. The turning angle calculating unit 55 estimates (calculates) the turning angle based on a change in the position of the reference target object viewed from the upper turning body 3 as a result of the updating of the object position map MP (that is, a change in the position of the reference target object in the captured image captured by the imaging device S6). This is because when the upper turning body 3 turns, the direction in which the reference target object can be viewed from the upper turning body 3 changes.

As described above, the relative angle calculating unit 56 calculates the relative angle as the turning angle, that is required for front-facing the work target. Specifically, the relative angle calculating unit 56 calculates (estimates) the relative angle based on the turning angle of the upper turning body 3 calculated by the turning angle calculating unit 55 and information on the position of the work target as the aim of the work (hereinafter, referred to as "aim position information") generated by the aim position information generating unit 58. When the work target is set as the reference target object, the relative angle calculating unit 56 may use the turning angle calculated by the turning angle calculating unit 55 as the relative angle. This is because, as described above, the turning angle calculating unit 55 calculates the turning angle (orientation of the upper turning body 3) based on the work target.

In the storage unit 57, aim setting information 57A is stored.

The aim setting information 57A is setting information concerning a work target that is the aim of the work (for example, a dump truck for loading earth and sand at the time of work) set by an operation input from a user such as an operator through the input device 42.

For example, by operating a predetermined operation screen (hereinafter, "aim selection screen") displayed on the display device 40 using the input device 42, an operator or the like can select a target object corresponding to the work target from among one or more target objects identified from the object position map MP, and set the selected target object as the aim of the work. Specifically, an image representing the appearance of the surroundings of the excavator 100 (hereinafter, "surrounding image") is displayed on the aim selection screen of the display device 40 based on the captured image captured by the imaging device S6. Then, on the aim selection screen of the display device 40, a marker or information representing the type of the target object is displayed in a superimposed manner at a position corresponding to the target object in the surroundings of the excavator 100 identified from the object position map MP in the surrounding image. An operator or the like can identify and select (set) a work target by confirming the position and type of the target object on the aim selection screen.

The aim position information generating unit 58 generates aim position information based on the object position map MP and the aim setting information 57A.

<Specific Example of Method for Estimating Turning Angle>

FIGS. 6A and 6B are diagrams illustrating a first example of an operation relating to estimation of a turning angle of the excavator 100 according to the present embodiment. Specifically, FIGS. 6A and 6B illustrate a situation in which the excavator 100 turns so as to front-face a dump truck DT that is the work target, while estimating the turning angle under the control of the controller 30, when performing the work of loading earth and sand or the like into the dump truck DT that is the work target. More specifically, FIG. 6A is a top view of the excavator 100 during work, and FIG. 6B is a view of the excavator 100 (specifically, the bucket 6) during work viewed in the direction of an arrow AR1 of FIG. 6A.

In FIGS. 6A and 6B, the excavator 100 (the bucket 6) illustrated with solid lines indicates the state when the bucket 6 has finished scooping earth and sand, and a bucket 6A indicates the bucket 6 in this state (position P1). In FIGS. 6A and 6B, the excavator 100 (the bucket 6) illustrated with dashed lines indicates a state during a combined operation in which the upper turning body 3 is turning in a direction toward the position front-facing the dump truck DT while the boom 4 is being raised with the earth and sand held in the bucket 6, and a bucket 6B indicates the bucket 6 in this state (position P2). Further, in FIGS. 6A and 6B, the excavator 100 (the bucket 6) illustrated with dash-dot-dash lines indicates a state where the upper turning body 3 is front-facing the dump truck DT that is the work target, before starting the operation of discharging the earth and sand held in the bucket 6, and a bucket 6C indicates the bucket 6 in this state (position P3).

In the present example, the controller 30 (the turning angle calculating unit 55) estimates (calculates) the turning angle θa using the dump truck DT that is the work target as the reference target object. That is, as illustrated in FIG. 6A, the controller 30 estimates (calculates) the turning angle θa of the upper turning body 3 by using, as the reference, the axis in the longitudinal direction of the loading platform of the dump truck DT, that is, the front-back axis of the dump truck DT.

For example, the controller 30 (the turning angle calculating unit 55) estimates (calculates) that the turning angle θa is an angle value θa0, using the dump truck DT as a reference target object, in a state where the bucket 6 is at the position P1. Further, the controller 30 (the relative angle calculating unit 56) can use the turning angle θa (the angle value θa0) as the relative angle, because the dump truck DT that is the work target is the reference target object. When the operator performs a right turning operation with respect to the lever device 26C while pressing down a predetermined switch such as the MC switch, that is, when the operator performs a turning operation in a direction toward the position front-facing the dump truck DT, the controller 30 (the automatic control unit 54) controls the proportional valve 31CR so that the upper turning body 3 front-faces the dump truck DT, that is, so that the turning angle θa corresponding to the relative angle changes from the angle value θa0 to zero.

While the bucket 6 moves from the position P1, passes through the position P2, toward the position P3 corresponding to a state in which the upper turning body 3 front-faces the dump truck DT, the controller 30 (the turning angle calculating unit 55) controls the turning operation of the upper turning body 3 through the proportional valve 31CR while estimating the turning angle θa. For example, when the bucket 6 is at the position P2, the controller 30 (the turning angle calculating unit 55) estimates (calculates) that the turning angle θa is the angle value θa1 using the dump truck DT as the reference target object. The controller 30 (the automatic control unit 54) stops the operation of the turning hydraulic motor 2A when the relative angle based on the estimated turning angle θa, that is, the turning angle θa, becomes zero. Thus, the controller 30 assists the operator in operating the lever device 26C and allows the upper turning body 3 to front-face the dump truck DT. When the operator presses down the predetermined switch such as the MC switch, the controller 30 can automatically cause the upper turning body 3 to front-face the dump truck DT while estimating the turning angle θa using the dump truck DT that is the work target as a reference target object. In this case, the controller 30 may perform automatic control of the raising of the boom 4 in conjunction with automatic control of the upper turning body 3 and perform the entire combined operation of the excavator 100 automatically.

Further, the controller 30 (the turning angle calculating unit 55) may calculate the turning angle θb by using, as a reference target object, a tree TR1 that is a fixed target object around the excavator 100, in addition to the turning angle θa that uses the dump truck DT as the reference target object. For example, the controller 30 (the turning angle calculating unit 55) estimates that the turning angle θb that uses the tree TR1 as the reference target object is the angle value θb0, in a state where the bucket 6 is at the position P1. The controller 30 (the turning angle calculating unit 55) estimates that the turning angle θb that uses the tree TR1 as the reference target object is the angle value θb1, in a state where the bucket 6 is at the position P3. Thus, the controller 30 (the relative angle calculating unit 56) can estimate (calculate) the relative angle using both the turning angle θa that uses the dump truck DT as the reference target object and the turning angle θb that uses the tree TR1 as the reference target object. Accordingly, the controller 30 can improve the accuracy of the estimation of the relative angle and consequently improve the accuracy of the control for causing the upper turning body 3 to front-face the dump truck DT.

[Estimation Method of Turning Angle (Second Example)]

Figure 7:
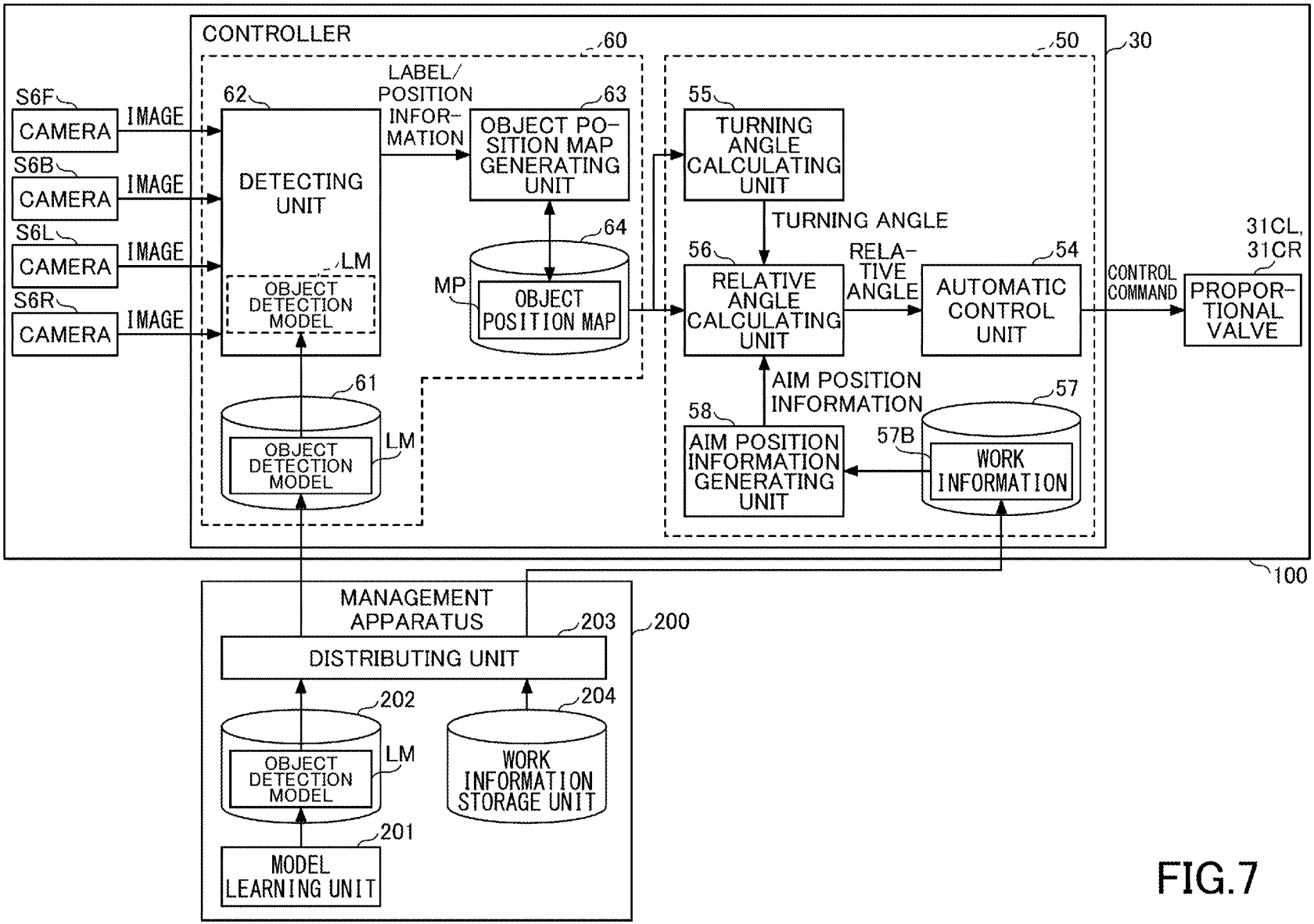
FIG. 7 is a diagram illustrating a second example of an estimation method of a turning angle of an excavator.
Figure 8A:
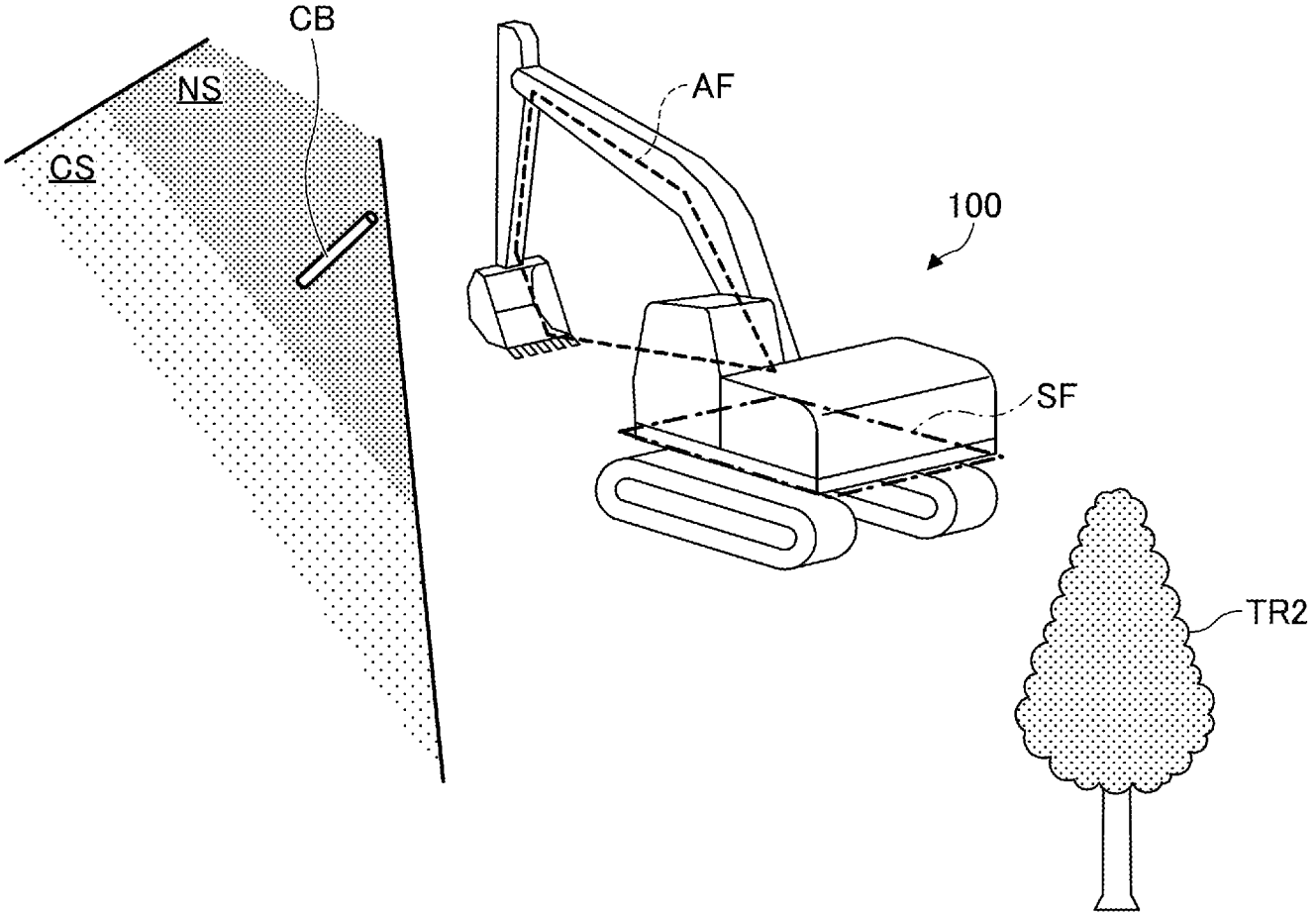
FIG. 8A is a diagram illustrating a second example of an estimation method of a turning angle of an excavator.
Figure 8B:
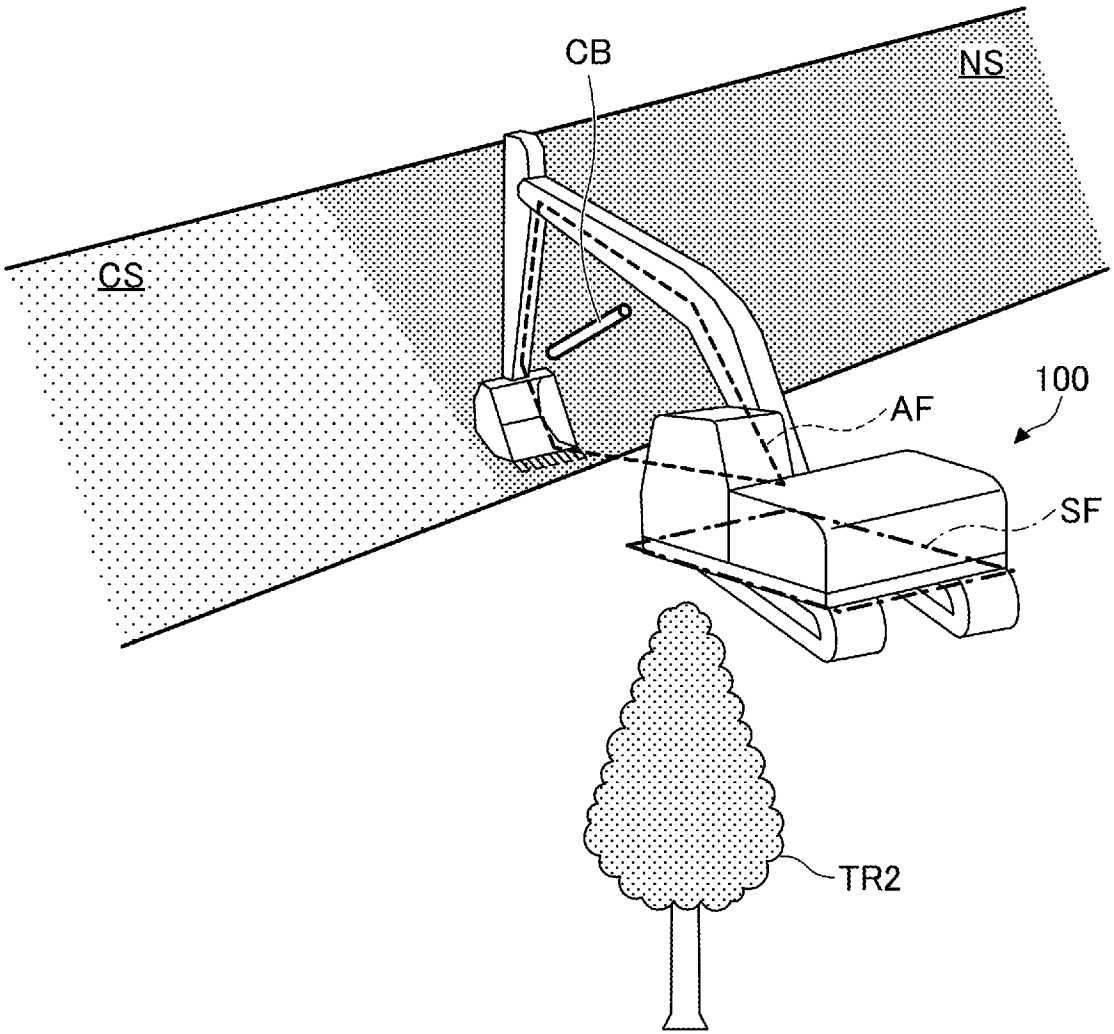
FIG. 8B is a diagram illustrating a second example of an estimation method of a turning angle of an excavator.

Next, a second example of a method for estimating a turning angle by the controller 30 (the turning angle calculating unit 55) will be described with reference to FIGS. 7 and 8 (FIGS. 8A and 8B).

<Functional Configuration Relating to Estimation of Turning Angle>

FIG. 7 is a functional block diagram illustrating the second example of functional configurations relating to the estimation of a turning angle of the excavator 100 according to the present embodiment. Hereinafter, in the present example, the portions that are different from those of the above-described FIG. 5 will be mainly described.

As illustrated in FIG. 7, in the present example, similar to the first example of FIG. 5, the excavator 100 is communicatively connected to the management apparatus 200 using the communication device T1.

The management apparatus 200 includes the model learning unit 201 and the distributing unit 203 as functional units that are implemented by executing, for example, a program installed in an auxiliary storage device on a CPU. The management apparatus 200 uses the learning result storage unit 202 and a work information storage unit 204. The learning result storage unit 202, the work information storage unit 204, or the like, can be implemented by, for example, an auxiliary storage device of the management apparatus 200, an external storage device capable of communication, or the like.

In the work information storage unit 204, a work information database including work information of a plurality of worksites including the worksite of the excavator 100 is constructed. The work information includes information on the aim of work (e.g., aim work surface data, etc.).

The distributing unit 203 extracts the work information of the worksite of the excavator 100 from the work information database and distributes the information to the excavator 100. In the present example, the excavator 100 includes the imaging device S6 (the camera S6F, S6B, S6L, and S6R), the controller 30, and the proportional valves 31CL and 31CR as the configuration relating to the estimation of the turning angle, similar to the first example of FIG. 5.

Similar to the first example of FIG. 5, the controller 30 includes the machine guidance unit 50 and the surrounding status recognizing unit 60 as configurations relating to the estimation of the turning angle.

Similar to the first example in FIG. 5, the machine guidance unit 50 includes the automatic control unit 54, the turning angle calculating unit 55, the relative angle calculating unit 56, the storage unit 57, and the aim position information generating unit 58 as functional configurations relating to the estimation of the turning angle.

The storage unit 57 stores work information 57B distributed from the management apparatus 200.

The aim position information generating unit 58 generates aim position information relating to the aim work surface that is a work target based on the aim work surface data included in the work information.

The relative angle calculating unit 56 calculates (estimates) the relative angle based on the turning angle of the upper turning body 3 calculated by the turning angle calculating unit 55 and the aim position information corresponding to the aim work surface of the work target.

The automatic control unit 54 controls the proportional valves 31CL and 31CR based on the relative angle calculated (estimated) by the relative angle calculating unit 56 and causes the upper turning body 3 to front-face the aim work surface corresponding to the work information 57B. When an object is detected within a predetermined range, the automatic control unit 54 controls the decompression proportional valve 33 based on the positional relationship with the detected object to perform a braking operation (deceleration or stopping).

<Specific Example of Method for Estimating Turning Angle>

FIGS. 8A and 8B are diagrams illustrating a second example of an operation relating to the estimation of a turning angle of the excavator 100 according to the present embodiment. Specifically, FIGS. 8A and 8B illustrate the state where the excavator 100 performs work on the slope surface NS that has not yet been worked on, starting from a portion near the boundary between a slope surface CS on which work has been completed and the slope surface NS that is an example of the aim work surface corresponding to a tilt surface that has not yet been worked on. FIG. 8A illustrates a state in which the upper turning body 3 is not front-facing the slope surface NS that is the work target, and FIG. 8B illustrates a state in which the excavator 100 has turned the upper turning body 3 from the state of FIG. 8A and the upper turning body 3 is front-facing the slope surface NS that is the work target.

As illustrated in FIGS. 8A and 8B, in the present example, the controller 30 (the turning angle calculating unit 55) calculates the turning angle by using, as a reference target object, the tree TR2 that is a fixed target object around the excavator 100 (own machine).

For example, in the state of FIG. 8A, the controller 30 (the turning angle calculating unit 55) estimates (calculates) the turning angle using the tree TR2 as the reference target object. The controller 30 (the relative angle calculating unit 56) estimates (calculates) the relative angle based on the estimated turning angle and aim position information corresponding to the slope surface NS that is the aim work surface. The controller 30 (the automatic control unit 54) controls the proportional valve 31CL so that the upper turning body 3 front-faces the slope surface NS while estimating the turning angle by using the tree TR2 as a reference target object when the operator performs a left turning operation with respect to the lever device 26C while pressing down a predetermined switch such as the MC switch. Thus, as illustrated in FIG. 8B, the controller 30 can assist the operator's operation of the lever device 26C to front-face the slope surface NS that is the work target. When the operator presses down a predetermined switch such as the MC switch, the controller 30 may automatically cause the upper turning body 3 to front-face the slope surface NS while estimating the turning angle by using the tree TR2 as the reference target object.

[Estimation Method of Turning Angle (Third Example)]

Next, a third example of a method for estimating a turning angle by the controller 30 (the turning angle calculating unit 55) will be described with reference to FIGS. 9 to 11.

Note that, as the functional block diagram representing the functional configuration relating to the estimation of the turning angle of the excavator 100 according to the present example, the functional block diagram (FIG. 5 or FIG. 7) of the first example or the second example can be used, and thus, the drawing is omitted.

<Detection Method of Fixed Target Object>

Figure 9:
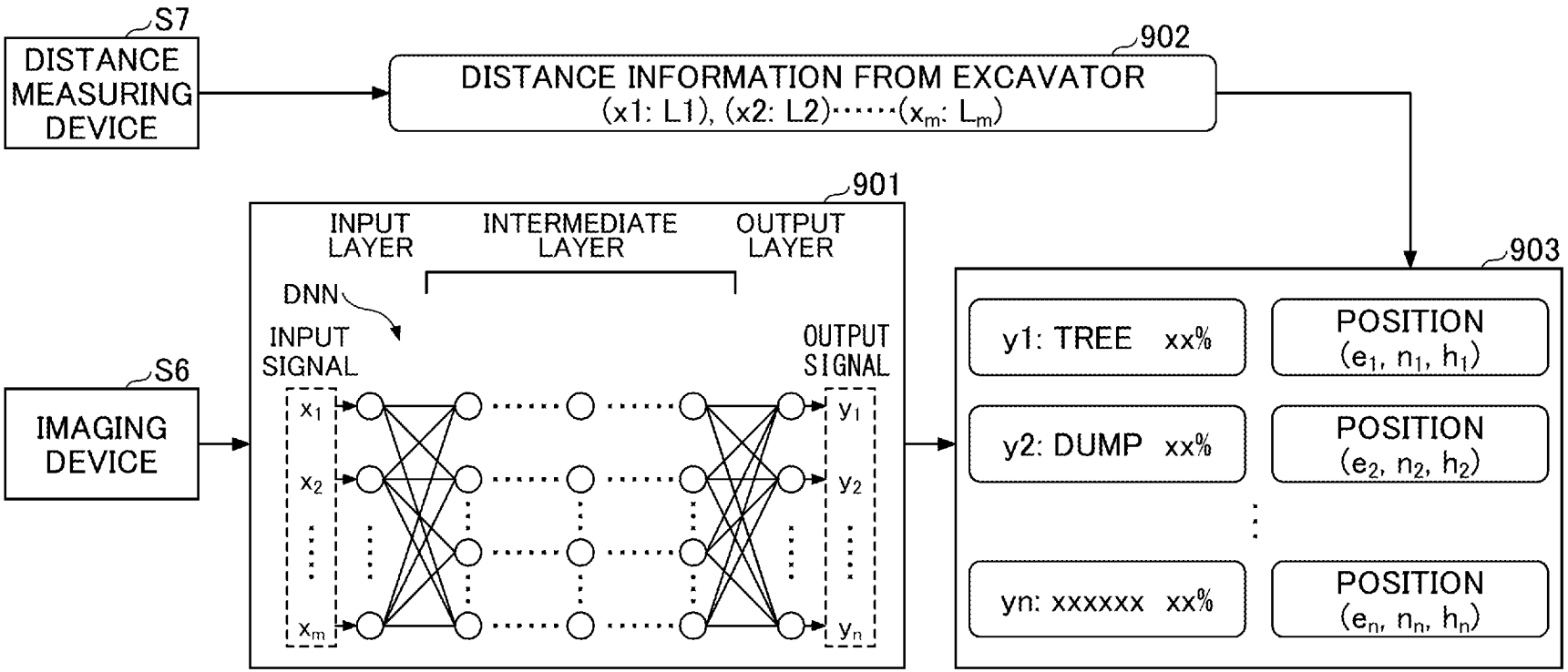
FIG. 9 is a diagram illustrating third example of an estimation method of a turning angle of an excavator.

FIG. 9 is a diagram illustrating the third example of an estimation method of a turning angle of the excavator 100. Specifically, FIG. 9 is a diagram illustrating an example of a method of detecting an object (for example, a fixed target object) around the excavator 100 according to the present example, and a series of processes relating to detection of an object around the excavator 100 by the detecting unit 62 is illustrated.

<<Object Detection Process>>

The detecting unit 62 performs a process (an object detection process 901) of detecting a target object around the excavator 100 (the upper turning body 3) using the learned object detection model LM based on the output (captured image) of the imaging device S6.

In the present example, the object detection model LM is configured mainly as a neural network DNN.

In the present example, the neural network DNN is what is known as a deep neural network with more than one intermediate layer (hidden layer) between the input layer and the output layer. In the neural network DNN, a weighting parameter representing the strength of the connection with the lower layer, is defined for each of the plurality of neurons configuring each of the intermediate layers. The neurons of each layer outputs, to the neurons of a lower layer through a threshold function, a sum of values obtained by multiplying each of the input values from the plurality of neurons from an upper layer by the weighting parameter defined for each of the neurons of the upper layer, thereby configuring the neural network DNN.

With respect to the neural network DNN, machine learning, specifically, deep learning, is performed by the management apparatus 200 (the model learning unit 201) as described below, to optimize the weighting parameters described above. Accordingly, to the neural network DNN, a captured image captured by the imaging device S6 is input as input signals x (x1 to xm), and the neural network DNN can output, as output signals y (y1 to yn), a probability (predictive probability) that an object of each object type corresponding to a predetermined target object list (in the present example, "tree", "dump", . . . ), is present. Here, m represents an integer of two or more, and corresponds to, for example, the number of sections of the captured image divided into two or more image regions. Further, n is an integer of two more, and corresponds to the number of types of target objects included in the target object list.

The neural network DNN is, for example, a convolutional neural network (CNN). CNN is a neural network using existing image processing technologies (convolution process and pooling process). Specifically, the CNN repeats the combination of the convolution process and the pooling process for the captured image captured by the imaging device S6 to extract feature amount data (feature map) having a smaller size than the captured image. Then, the pixel value of each pixel of the extracted feature map is input to a neural network configured by a plurality of fully connected layers, and the output layer of the neural network can output, for example, a predictive probability that an object exists for each object type.

The neural network DNN may be configured such that a captured image captured by the imaging device S6 is input as an input signal x, and the position and size of the object in the captured image (that is, the region occupied by the object in the captured image) and the type of the object can be output as an output signal y. That is, the neural network DNN may be configured to detect an object in the captured image (determine the portion of the region occupied by the object in the captured image) and to determine the classification of the object. In this case, the output signal y may be configured by an image data format in which information on the region occupied by the object and the classification of the object is added, in a superimposed manner, to the captured image that is the input signal x. Accordingly, the detecting unit 62 can identify a relative position (distance or direction) of the object from the excavator 100 based on the position and size of the region occupied by the object in the captured image captured by the imaging device S6 output from the object detection model LM (neural network DNN). This is because the imaging device S6 (the camera S6F, the camera S6B, the camera S6L, and the camera S6R) is fixed to the upper turning body 3 and the imaging range (image angle) is predefined (fixed). When the position of the object detected by the object detection model LM is in the monitor region and is classified into an object in a monitor target list, the detecting unit 62 can determine that the object that is the monitor target is detected in the monitor region.

For example, the neural network DNN may be configured to include a neural network corresponding to each of a process of extracting an occupied region (window) in which an object is present in the captured image, and a process of identifying the type of object in the extracted region. That is, the neural network DNN may be configured to perform detection of an object and classification of the object in a stepwise manner. For example, the neural network DNN may be configured to include a neural network corresponding to each of a process of defining the classification of an object and the region occupied by the object (bounding box) for each grid cell obtained by dividing the entire region of the captured image into a predetermined number of subregions, and a process of combining the regions occupied by objects for each type based on the classification of the object for each grid cell and validating the final region occupied by objects. That is, the neural network DNN may be configured to perform detection of an object and classification of an object in parallel.

The detecting unit 62, for example, calculates the predictive probability for each type of object in the captured image, by using the neural network DNN, in each predetermined control cycle. When calculating the predictive probability, the detecting unit 62 may further increase the predictive probability of the current time when the current determination result matches the previous determination result. For example, when an object appearing in a predetermined region in the captured image is determined to be "dump" (y2) by a predictive probability in the previous determination, and it is continuously determined that the object is "dump" (y2) in the current determination, the predictive probability that the object is determined to be "dump" (y2) in the current determination may be further increased with respect to the predictive probability of the previous determination. Thus, for example, when the determination result relating to the classification of an object with respect to the same image region is continuously matched, the predictive probability is calculated to be relatively high. Therefore, the detecting unit 62 can reduce erroneous determinations.

Further, the detecting unit 62 may make a determination with respect to an object in the captured image by taking into consideration the motions of the excavator 100 such as travelling and turning. Even when the object around the excavator 100 is stationary, the position of the object in the captured image may move as the excavator 100 travels or turns, and the object may not be recognized as the same object any longer. For example, there may be cases where an image region determined to be "tree" (y1) in the current process and an image region determined to be "tree" (y1) in the previous process are different, due to the travelling or turning of the excavator 100. In this case, if the image region determined to be "tree" (y1) in the current process is within a predetermined range from the image region determined to be "tree" (y1) in the previous process, the detecting unit 62 may regard these objects to be the same object, and make a determination that the object is continuously matching (i.e., determination that the same object is continuously being detected) (continuously matching determination). When making the continuously matching determination, the detecting unit 62 may add the image region used in the current determination to the image region used in the previous determination, and include the image region within a predetermined range from this image region. This allows the detecting unit 62 to make the continuously matching determination with respect to the same object around the excavator 100, even if the excavator 100 travels or turns.

Also in the cases of the above-described first and second examples, the object detection model LM may be configured mainly as the neural network DNN, similar to the present example.

The detecting unit 62 may also detect objects around the excavator 100 using an object detection method based on any kind of machine learning other than the method using the neural network DNN.

For example, it is possible to generate, by supervised learning, the object detection model LM that represents the boundary between a range of objects of a certain type and a range of objects of types other than the certain type, for each of the object types in a multivariable space, with respect to multivariable local feature quantities acquired from a captured image captured by the imaging device S6. The techniques of machine learning (supervised learning) applied to the generation of information relating to boundary may be, for example, support vector machine (SVM), a k-Neighborhood technique, a mixed Gaussian distribution model, and the like. Accordingly, the detecting unit 62 can detect an object on the basis of whether the local feature quantity acquired from the captured image captured by the imaging device S6 is in the range of a predetermined type of object or in the range of an object that is not the predetermined type, based on the object detection model LM.

<<Distance Calculation Process>>

In addition to the object detection process 901, the detecting unit 62 performs a process of calculating the distance from the excavator 100 to a surrounding object based on the output of the distance measuring device S7 mounted on the excavator 100 (a distance calculation process 902). In the present example, the detecting unit 62 calculates distances L1 to Lm to an object for each direction viewed from the excavator 100 (the imaging device S6) corresponding to image regions x1 to xm obtained by dividing a captured image captured by the imaging device S6 into a plurality of image regions.

The distance measuring device S7 is mounted to the upper turning body 3 and acquires information concerning the distance to an object around the excavator 100. The distance measuring device S7 may include, for example, an ultrasonic sensor, a millimeter wave radar, a LIDAR, an infrared sensor, or the like. The distance measuring device S7 may be, for example, an imaging device such as a monocular camera, a stereo camera, a distance image camera, a depth camera, or the like. In the case of a monocular camera, the detecting unit 62 can calculate the distance based on an image captured when the excavator 100 is travelling or turning.

<<Target Object Information Generation Process>>

The detecting unit 62 combines the output of the object detection process 901 with the output of the distance calculation process 902 to perform a process of generating target object information including the predictive probability and the position for each of a plurality of target objects (a target object information generation process 903). Specifically, the detecting unit 62 may generate the target object information including the predictive probability and the position of each target object, based on the predictive probability and the occupied region in the captured image with respect to each of a plurality of types of target objects included in the target object list, and the distance information (distances L1 to Lm) for each of the image regions x1 to xm in the captured image. In the present example, the target object information indicates that the "tree" corresponding to the output signal y1 is positioned at the "coordinates" ($e_1$, $n_1$, $h_1$) by a predictive probability of "xx %". In the present example, the target object information indicates that the "dump (truck)" corresponding to the output signal y2 is positioned at the "coordinates" ($e_2$, $n_2$, $h_2$) by the predictive probability of "xx %". In the present example, the target object information indicates that the "xxxxxx" corresponding to the output signal yn is positioned at the "coordinates" ($e_n$, $n_n$, $h_n$) by the predictive probability of "xx %". Accordingly, the detecting unit 62 can detect a target object within the imaging range of the imaging device S6 or identify the position of the detected target object, based on the target object information and the predictive probability for each of a plurality of types of target objects in the target object list.

Note that, as described above, the detecting unit 62 may identify the position of each target object by using only the position and size of the occupied region of each target object. In this case, the distance calculation process 902 may be omitted, and the distance measuring device S7 may be omitted.

<Specific Example of Method for Estimating Turning Angle>

Figure 10:
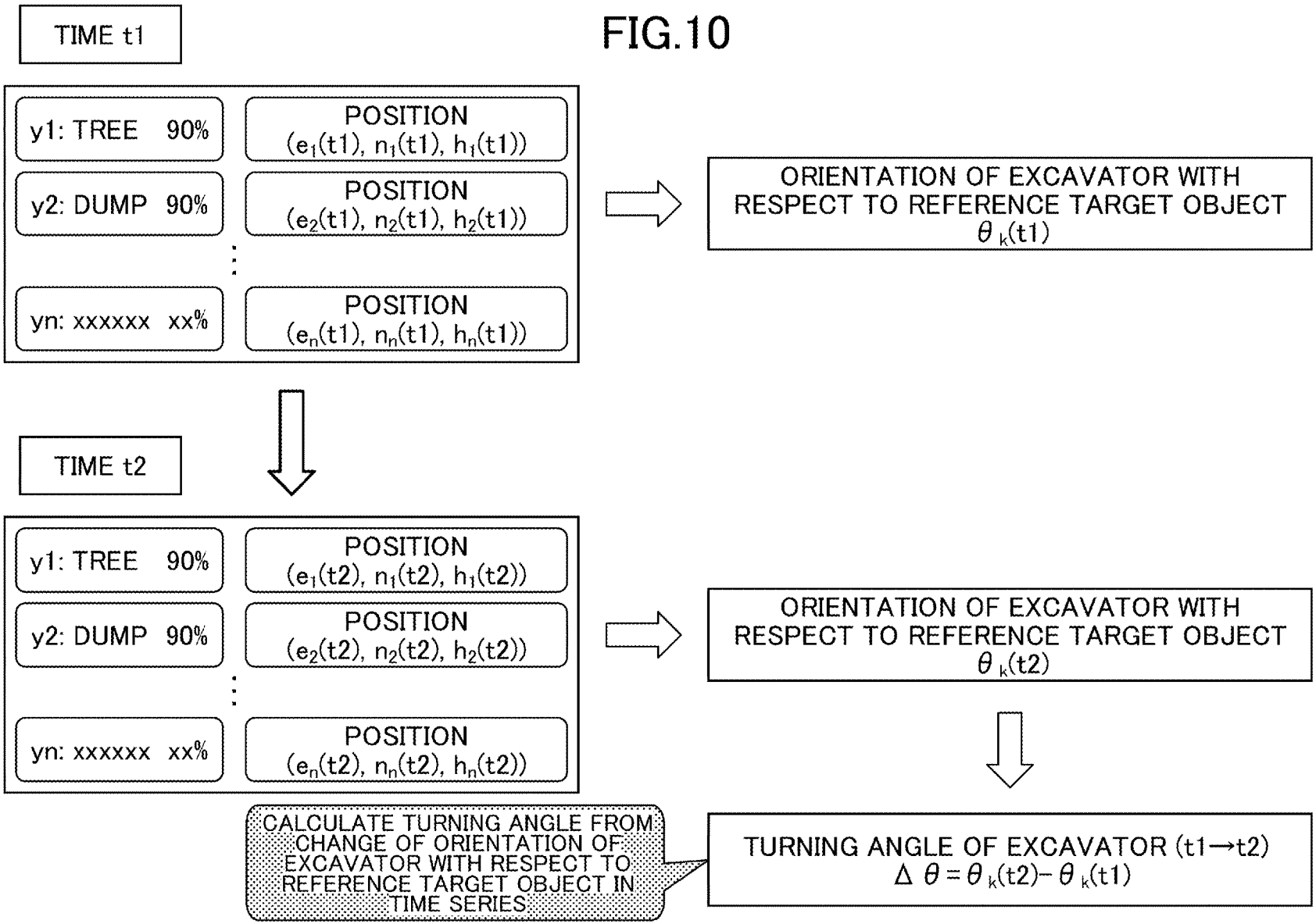
FIG. 10 is a diagram illustrating third example of an estimation method of a turning angle of an excavator.
Figure 11:
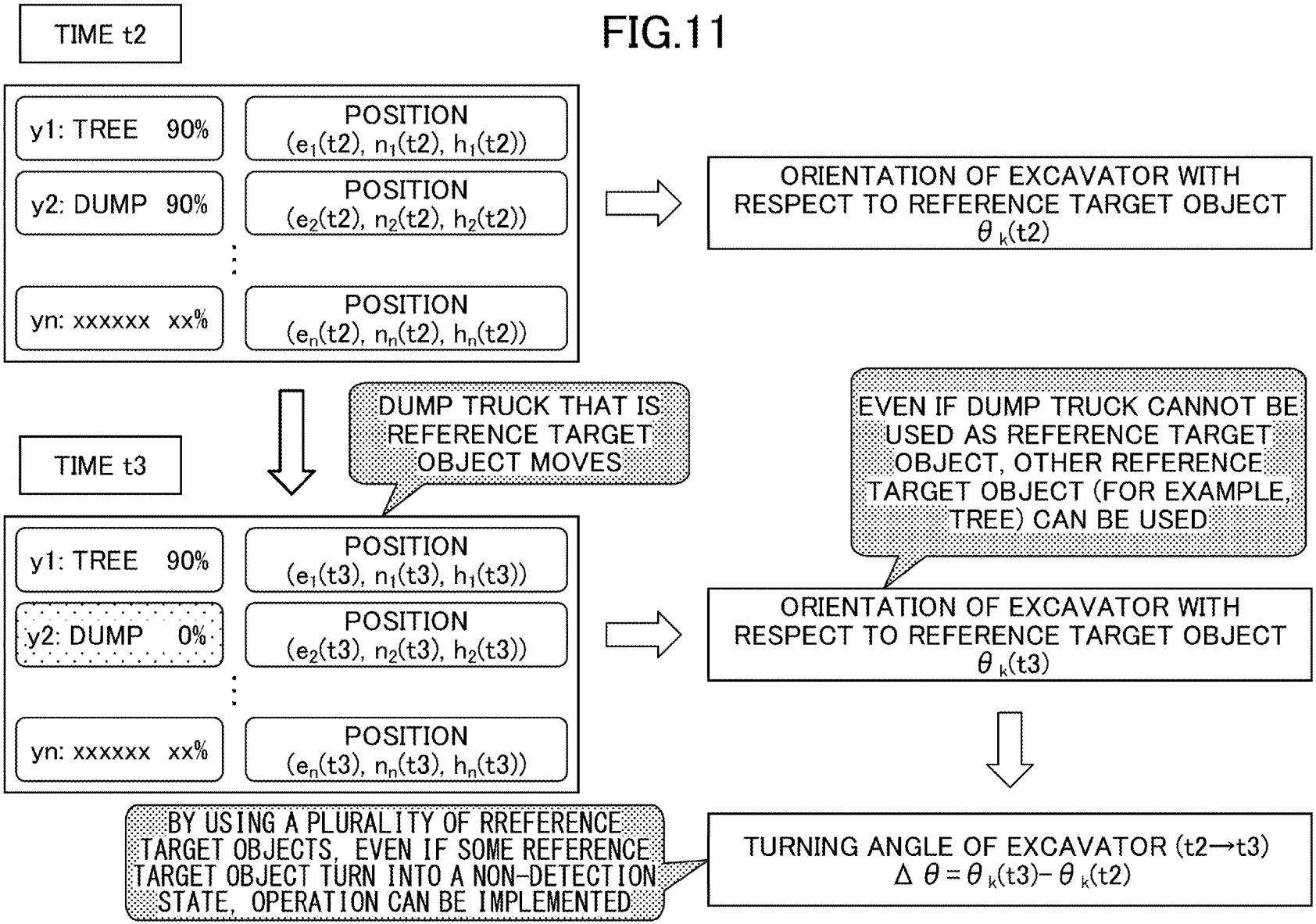
FIG. 11 is a diagram illustrating third example of an estimation method of a turning angle of an excavator.

FIGS. 10 and 11 are diagrams illustrating the third example of an estimation method of a turning angle of the excavator 100.

In the present example, the controller 30 determines a reference target object around the excavator 100 based on the target object information generated by the above-described target object information generation process 903 and calculates the orientation of the reference target object viewed from the excavator 100. Then, the controller 30 estimates the turning angle of the excavator 100 based on a change in time series of the orientation of the target object viewed from the excavator 100.

Figure 12:
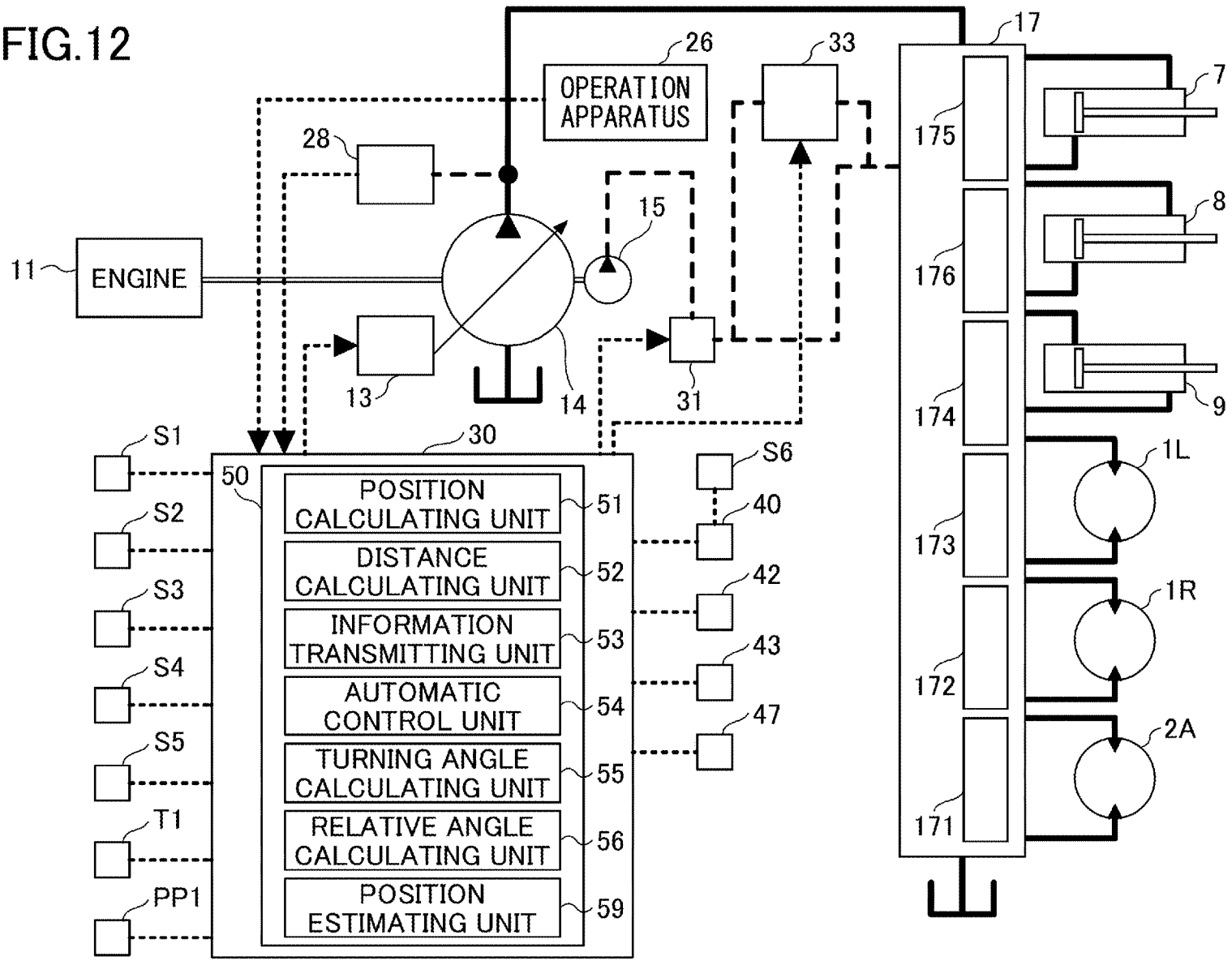
FIG. 12 is a diagram schematically illustrating another example of a configuration of an excavator.

For example, as illustrated in FIG. 12, at time t1, the target object information indicates that the predictive probability of "tree" and "dump" is 90%. Accordingly, the controller 30 determines a plurality of reference target objects, including at least the tree and the dump truck, and calculates the orientation (angular direction) θk(t1) (k being an integer of 1 to n) of the reference target object viewed from the excavator 100, for each of the reference target objects.

Further, at time t2, the target object information continues to indicate that the predictive probability of "tree" and "dump" is very high at 90%. Accordingly, the controller 30 determines a plurality of reference target objects including at least the tree and the dump truck and calculates the orientation θk(t2) of the reference target object viewed from the excavator 100, for each of the reference target objects.

With respect to each reference target object, the controller 30 can calculate the turning angle Δθ between time t1 and time t2 according to the following formula (1), based on the orientation θk(t1) and θk(t2) of the reference target object viewed from the excavator 100 at time t1 and time t2, respectively.

$$\Delta\theta = \theta k(t2) - \theta k(t1) \quad (1)$$

The controller 30 determines the turning angle of the excavator 100 between time t1 and time t2 based on the turning angle Δθ calculated with respect to each of a plurality of reference target objects. The controller 30 may determine the turning angle of the excavator 100 between time t1 and time t2, for example, by performing statistical processing such as obtaining the average turning angle of the turning angles 40 with respect to the plurality of reference target objects.

Note that, when only one target object (reference target object) is present around the excavator 100 based on the target object information, the controller 30 may determine the turning angle Δθ corresponding to the one reference target object, as the turning angle of the excavator 100.

Thus, in the present example, the controller 30 can determine a reference target object around the excavator 100 based on the target object information and estimate the turning angle of the excavator 100 based on the change in time series in the orientation of the reference target object viewed from the excavator 100. In the present example, with respect to each of a plurality of reference target objects, the controller 30 estimates the turning angle of the excavator 100 based on the change in time series of the orientation of the reference target object viewed from the excavator 100, and determines the turning angle of the excavator 100 based on a plurality of estimation values of the turning angle. Therefore, it is possible to improve the estimation accuracy of the turning angle.

For example, as illustrated in FIG. 12, at time t3, the dump truck, which has been the reference target object up to time t2, moves, and in the target object information, the predictive probability of "dump" is changed to 0%. Therefore, at time t3, the controller 30 cannot use the dump truck as a reference target object.

On the other hand, at time t3, the target object information continues to indicate that the predictive probability of "tree" is very high at 90%. Accordingly, the controller 30 determines one or more reference target objects including at least the tree, and calculates the orientation θk(t3) of the reference target object viewed from the excavator 100 for each reference target object.

With respect to each reference target object, the controller 30 can calculate the turning angle Δθ between time t2 and time t3 according to the following formula (2), based on the orientation θk(t2) and θk(t3) of the reference target object viewed from the excavator 100 at time t2 and time t3, respectively.

$$\Delta\theta=\theta k(t3)-\theta k(t2) \quad (2)$$

Thus, in the present example, even when some of the reference target objects cannot be detected, the controller 30 can estimate the turning angle of the excavator 100 based on the change in the orientation of the other reference target objects viewed from the excavator 100, if other reference target objects that can be detected are present. That is, by using a plurality of reference target objects, the controller 30 can stably continue the estimation process of the turning angle of the excavator 100 even in a situation in which some reference target objects cannot be detected.

[Another Example of Configuration of Excavator]

Next, another example of a specific configuration of the excavator 100 according to the present embodiment will be described with reference to FIG. 12 in addition to FIG. 1. Specifically, a description is given of a specific example of the configuration concerning an estimation method of the position of the excavator 100 (own machine) described below. Hereinafter, the portions that are different from the above-described example (FIG. 2) will be mainly described, and the same or corresponding contents may be omitted from the description.

FIG. 12 is a schematic diagram illustrating another example of the configuration of the excavator 100 according to the present embodiment.

The control system of the excavator 100 according to the present embodiment includes the controller 30, the discharge pressure sensor 28, an operation pressure sensor 29, the proportional valve 31, the display device 40, the input device 42, the sound output device 43, the storage device 47, the boom angle sensor S1, the arm angle sensor S2, the bucket angle sensor S3, the machine tilt sensor S4, a turning state sensor S5, the imaging device S6, and the communication device T1.

The turning state sensor S5 outputs detection information concerning the turning state of the upper turning body 3. The turning state sensor S5 detects, for example, the turning angle speed and the turning angle of the upper turning body 3. The turning state sensor S5 may include, for example, a gyro sensor, a resolver, a rotary encoder, or the like. The detection signal corresponding to the turning angle and the turning angle speed of the upper turning body 3 output by the turning state sensor S5 is loaded into the controller 30.

The controller 30 includes the machine guidance unit 50.

The machine guidance unit 50 acquires information from the boom angle sensor S1, the arm angle sensor S2, the bucket angle sensor S3, the machine tilt sensor S4, the turning state sensor S5, the imaging device S6, the communication device T1, and the input device 42. The machine guidance unit 50, for example, calculates the distance between the bucket 6 and the aim work surface based on the acquired information, notifies the operator of the extent of the distance between the bucket 6 and the work target (for example, the aim work surface) based on the sound from the sound output device 43 and the image displayed on the display device 40, and automatically controls the operation of the attachment so that the leading end of the attachment (specifically, the working portion such as the claw tip or the back surface of the bucket 6) coincides with the aim work surface. The machine guidance unit 50 includes the position calculating unit 51, the distance calculating unit 52, the information transmitting unit 53, the automatic control unit 54, the turning angle calculating unit 55, the relative angle calculating unit 56, and a position estimating unit 59, as detailed functional configurations relating to the machine guidance function and the machine control function.

The turning angle calculating unit 55 calculates the turning angle of the upper turning body 3. This allows controller 30 to identify the current orientation of upper turning body 3. The turning angle calculating unit 55 calculates the turning angle based on the detection signal of the turning state sensor S5. When a reference point is set at the worksite, the turning angle calculating unit 55 may set the direction in which the reference point is viewed from the turning axis, as the reference direction. For example, the turning angle calculating unit 55 may calculate (estimate) the turning angle of the upper turning body 3 based on a change in the position of an object (orientation in which the object can be seen) that is stopping or fixed, included in (appearing in) the captured image captured by the imaging device S6, by using the above-described estimation method (see FIGS. 5 to 11). In this case, the turning state sensor S5 may be omitted.

The position estimating unit 59 estimates the position of the excavator 100. The position estimating unit 59, for example, recognizes an object around the excavator 100 (own machine) based on a captured image captured by the imaging device S6, and calculates (estimates) the relative position of the excavator 100 with respect to the recognized object. Details are given below (see FIGS. 13-18).

[Estimation Method of Position of Excavator (First Example)]

Next, a first example of the method of estimating the position of the excavator 100 (own machine) by the controller 30 will be described with reference to FIGS. 13 and 14.

<Functional Configuration Relating to Estimation of Excavator Position>

Figure 13:
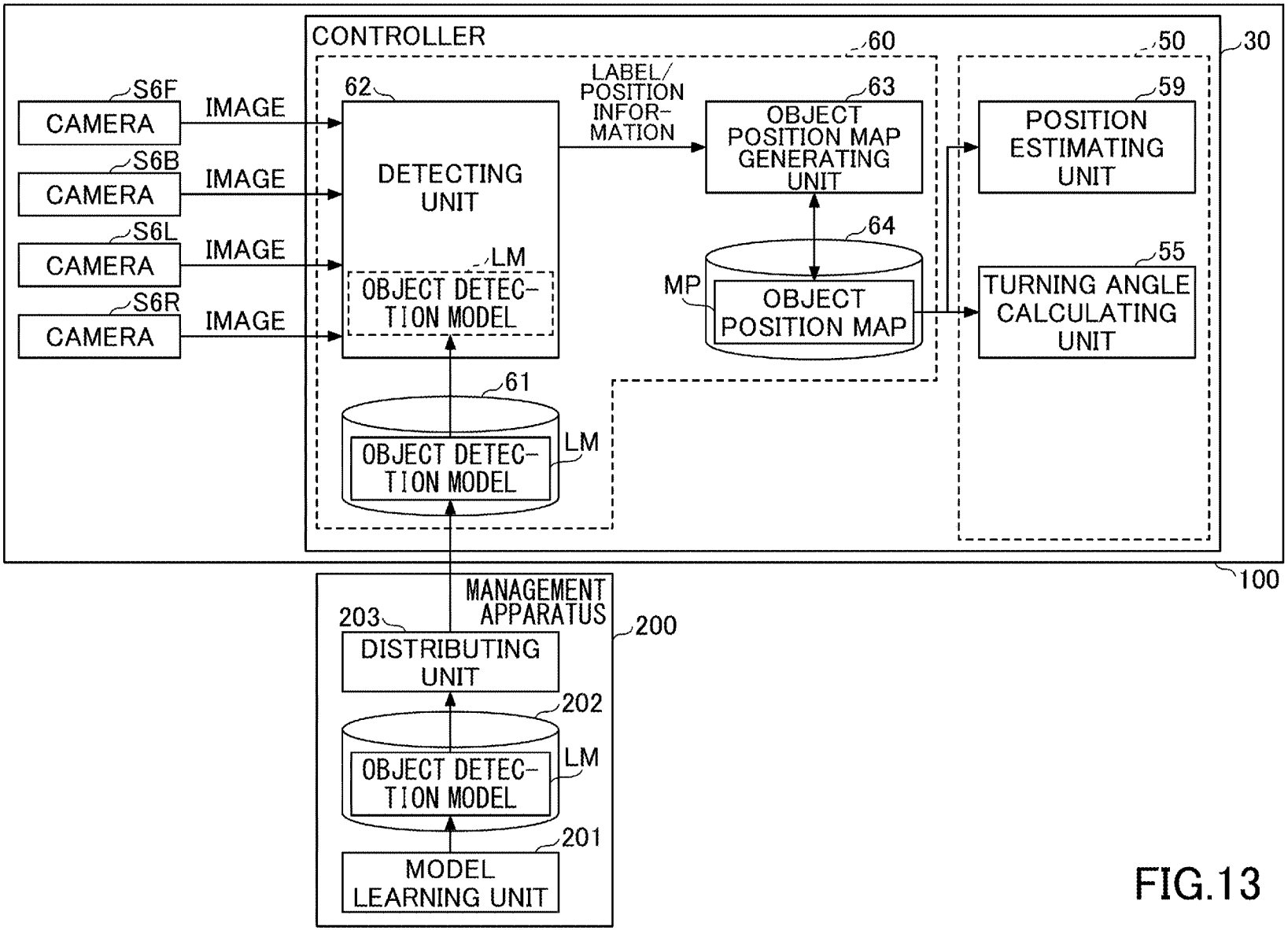
FIG. 13 is a diagram illustrating a first example of an estimation method of the position of an excavator.

FIG. 13 is a functional block diagram illustrating the first example of functional configurations relating to the estimation of a position of the excavator 100 according to the present embodiment.

As illustrated in FIG. 13, in the present example, the excavator 100 is communicatively connected to the management apparatus 200 using the communication device T1.

The functions of the management apparatus 200 may be implemented by any hardware or a combination of hardware and software. For example, the management apparatus 200 is configured mainly as a server computer including a processor such as a CPU, a memory device such as a RAM, an auxiliary storage device such as a ROM, and an interface device for communication with external devices. The management apparatus 200 includes a model learning unit 201 and a distributing unit 203 as functional units that are implemented by executing, for example, a program installed in the auxiliary storage device on the CPU. The management apparatus 200 uses a learning result storage unit 202 or the like. The learning result storage unit 202 or the like can be implemented by, for example, an auxiliary storage device of the management apparatus 200 or an external storage device capable of communication.

The model learning unit 201 performs machine learning with respect to a learning model by using a predetermined teaching dataset and outputs a learned model (an object detection model LM) as a result of what is known as supervised learning. The generated object detection model LM is stored in the learning result storage unit 202 upon being subjected to accuracy verification by using a verification dataset prepared in advance. Further, the model learning unit 201 may generate an additional learned model by performing additional learning with respect to the object detection model LM by using a teaching dataset for additional learning. The additional learned model may be subjected to the accuracy verification using the pre-prepared verification dataset, and the object detection model LM in the learning result storage unit 202 may be updated with the additional learned model that has undergone the accuracy verification.

The object detection model LM determines the presence or absence of a predetermined object (e.g., a person, a vehicle, another work machine, a building, a pylon, a utility pole, a tree, etc.) (hereinafter referred to as a "target object") in a captured image of the worksite, by using a captured image of the worksite captured by the object detection device, point group data, etc., as input information, and determines the type of the target object, the position of the target object, and the size of the target object, or the like. The object detection model LM outputs information on the determination result (for example, label information representing the type of the target object or position information representing the position of the target object). That is, when the object detection model LM is applied to the excavator 100, the object detection model LM can determine the presence or absence of a target object around the excavator 100, the type of the target object, and the position of the target object, based on the captured image captured by the imaging device S6. The base learning model and the object detection model LM generated as a result of learning the base learning model may be configured, for example, mainly as a known deep neural network (DNN).

Note that the teaching dataset and the accuracy verification dataset may be generated, for example, based on captured images of various worksites captured by the imaging device S6, uploaded from the excavator 100 from time to time. Further, the teaching dataset and the accuracy verification dataset may be generated based on an image of a worksite that is artificially generated using, for example, techniques associated with computer graphics.

The learning result storage unit 202 stores the object detection model LM generated by the model learning unit 201. The object detection model LM in the learning result storage unit 202 may be updated by an additional learned model generated by the model learning unit 201.

The distributing unit 203 distributes the latest object detection model LM stored in the learning result storage unit 202 to the excavator 100.

In the present example, the excavator 100 includes the imaging device S6 (the cameras S6F, S6B, S6L, and S6R), and the controller 30 as configurations relating to the estimation of the position of the own machine.

The controller 30 includes a surrounding status recognizing unit 60 and the machine guidance unit 50 as described above as configurations relating to the estimation of the position of the excavator 100 (own machine).

The surrounding status recognizing unit 60 includes, for example, a model storage unit 61, a detecting unit 62, an object position map generating unit 63, and a map storage unit 64.

The model storage unit 61 stores the latest object detection model LM received from the management apparatus 200 through the communication device T1.

The detecting unit 62 detects a target object around the upper turning body 3 based on a captured image input from the imaging device S6 (the cameras S6F, S6B, S6L, and S6R). Specifically, the detecting unit 62 reads the object detection model LM from the model storage unit 61 and makes determinations relating to the target object around the upper turning body 3 using the object detection model LM (for example, determines the presence or absence of a target object, the type of the target object, the position of the target object, the size of the target object, or the like). The detecting unit 62 outputs, for example, label information indicating the type of the detected target object, position information of the target object, information relating to the size of the target object, and the like. When no target object is detected, the detecting unit 62 may output label information indicating that a target object is not detected. In the present example, captured images captured by a plurality of cameras (the cameras S6F, S6B, S6L, and S6R) can be used, so that the detecting unit 62 can detect a target object across the entire surrounding area of the upper turning body 3, that is, a target object within a wider target range. Although an example in which the imaging device S6 is used is described, the detecting unit 62 may receive a reflected signal of an output signal (e.g., laser, infrared ray, electromagnetic wave, ultrasonic wave, or the like) output to the surroundings of the excavator 100 and calculate the distance to the object around the excavator 100 by using point group data or the like. Further, the detecting unit 62 can obtain label information representing the type of the target object and position information representing the position of the target object according to the shape of the point group and the distance to the point group or the like based on the received reflected signal.

The object position map generating unit 63 generates map information (hereinafter, "object position map") representing the position of the excavator 100 (own machine) with respect to a surrounding object (target object). The generated object position map MP is stored in the map storage unit 64. The object position map MP includes three-dimensional shape data (specifically, an assembly of three-dimensional feature points) of an object in the surroundings of the excavator 100 based on a captured image captured by the imaging device S6, including the target object detected by the detecting unit 62, and information representing the current position of the excavator 100 and the current orientation of the upper turning body 3 relative to the three-dimensional shape data. The object position map MP includes a position for each target object detected by the detecting unit 62. The object position map MP includes accompanying information such as information on the type of the target object (hereinafter referred to as "type information") and information on the size of the target object (hereinafter referred to as "size information") associated with the position of each target object. Specifically, the object position map generating unit 63 generates local map information (hereinafter, a "local map") including the three-dimensional shape of an object (target object) around the excavator 100 at present time based on a captured image (detection result of the detecting unit 62) captured by the imaging device S6, at every predetermined processing cycle. The local map is map information that uses, as a reference, the current position of the excavator 100 and the current orientation of the upper turning body 3. The object position map generating unit 63 identifies that the three-dimensional shape of an object is the same in the generated local map and in a past object position map MP created in the preceding processing cycle, and generates the latest object position map MP. At this time, in the process of identifying that the three-dimensional shape in the local map that uses, as a reference, the current position of the excavator 100 and the current orientation of the upper turning body 3 is the same as the three-dimensional shape in the past object position map MP, the object position map generating unit 63 simultaneously identifies the position of the excavator 100 and the orientation of the upper turning body 3 in the object position map MP. For example, the object position map generating unit 63 may create an object position map MP in accordance with the detection cycle by the detecting unit 62, from the activation to the stop of the excavator 100, and sequentially update the object position map MP in the map storage unit 64 with the latest object position map MP.

Note that when a distance sensor (an example of a distance information acquisition device) capable of acquiring the distance to an object in the imaging range of the imaging device S6 is mounted to the upper turning body 3 in addition to the imaging device S6, the object position map generating unit 63 may generate an object position map MP based on the captured image captured by the imaging device S6 and the detection information of the distance sensor. That is, the controller 30 may estimate the position of the excavator 100 (own machine) or estimate the orientation (turning angle) of the upper turning body 3 based on the captured image captured by the imaging device S6 and the detection information of the distance sensor (i.e., information on the distance to the object around the excavator 100). Specifically, the object position map generating unit 63 may generate data corresponding to a three-dimensional shape around the excavator 100 based on the detection information of the distance sensor, and generate an object position map MP by applying, on the generated data, the information relating to the target object detected by the detecting unit 62 based on the captured image captured by the imaging device S6. Accordingly, the distance sensor can directly acquire the detection information relating to the distance to an object around the excavator 100, and, therefore, the processing load can be reduced and the processing time can be shortened compared to when the distance is calculated from the captured image captured by the imaging device S6. Further, the accuracy of the distance corresponding to the detected information acquired by the distance sensor, is generally higher than the accuracy of the distance calculated from the captured image captured by the imaging device S6, and, therefore, the accuracy of the object position map MP can be improved. Further, the distance range within which an object can be detected by the detecting unit 62 is limited with reference to the excavator 100 (the upper turning body 3), and, therefore, for example, if the excavator 100 travels by the lower traveling body 1, the position of a certain target object included in the object position map MP may become a position outside the detection range. That is, if the excavator 100 moves by the lower traveling body 1, the controller 30 may not be able to identify the movement of an object at a position relatively distant from the excavator 100 or changes according to work on the landform at a position relatively distant from the excavator 100. Accordingly, at the time of updating the object position map MP, the object position map generating unit 63 may delete information on the three-dimensional shape including the target object at a position that is relatively distant from the excavator 100 (own machine) included in the object position map MP, or may leave this information in the map information, for example, upon linking this information with a flag indicating that this information has low accuracy.

The map storage unit 64 stores the latest object position map MP generated by the object position map generation unit 63.

The machine guidance unit 50 includes the turning angle calculating unit 55 and the position estimating unit 59 as functional configurations relating to the estimation of the position of the excavator 100 (own machine).

The turning angle calculating unit 55 recognizes a target object that is stopping around the excavator 100 (hereinafter, "stopped target object") or a target object that is fixed (hereinafter, "fixed target object") based on the captured image captured by the imaging device S6 and estimates (calculates) the turning angle of the upper turning body 3 (that is, the orientation of the upper turning body 3) with respect to the stopped target object or the fixed target object. A stopped target object means a target object that is stopping without moving (e.g., a dump truck that is stopping) among movable target objects. A fixed target object means a target object that is fixed to a position and does not move (e.g., a tree, a utility pole, various devices fixedly installed in a scrap yard as described below, etc.). Specifically, the turning angle calculating unit 55 estimates (calculates) the orientation of the upper turning body 3 in the latest object position map MP stored in the map storage unit 64, that is, the orientation (turning angle) of the upper turning body 3 viewed from the stopped target object or the fixed target object identified from the object position map MP. More specifically, the turning angle calculating unit 55 may estimate (calculate) the turning angle of the upper turning body 3 with respect to the direction in which the turning axis is viewed from the stopped target object or the fixed target object in the object position map MP.

The position estimating unit 59 recognizes (estimates) a target object (specifically, a stopped target object or a fixed target object) around the excavator 100 and identifies (estimates) the position of the excavator 100 (own machine) with respect to the recognized target object, based on the captured image captured by the imaging device S6. Specifically, the position estimating unit 59 identifies (estimates) the position of the excavator 100 in the object position map MP stored in the map storage unit 64, that is, the position of the excavator 100 with respect to the stopped target object or the fixed target object identified from the object position map MP. This allows the excavator 100 to identify the position of the own machine without using GNSS.

<Specific Example of Estimation Method of Position of Excavator>

Figure 14A:
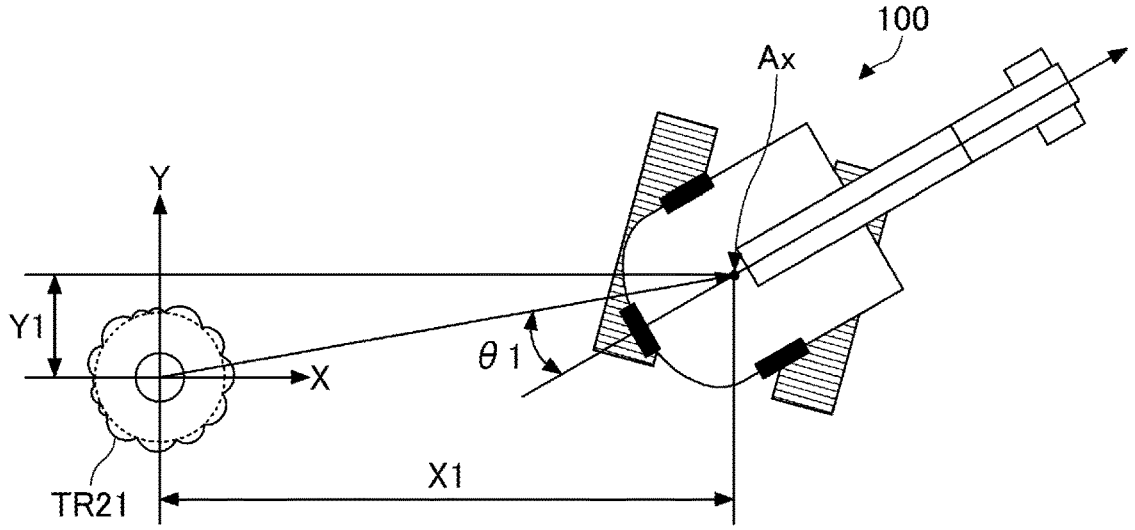
FIG. 14A is a diagram illustrating a first example of an estimation method of the position of an excavator.
Figure 14B:
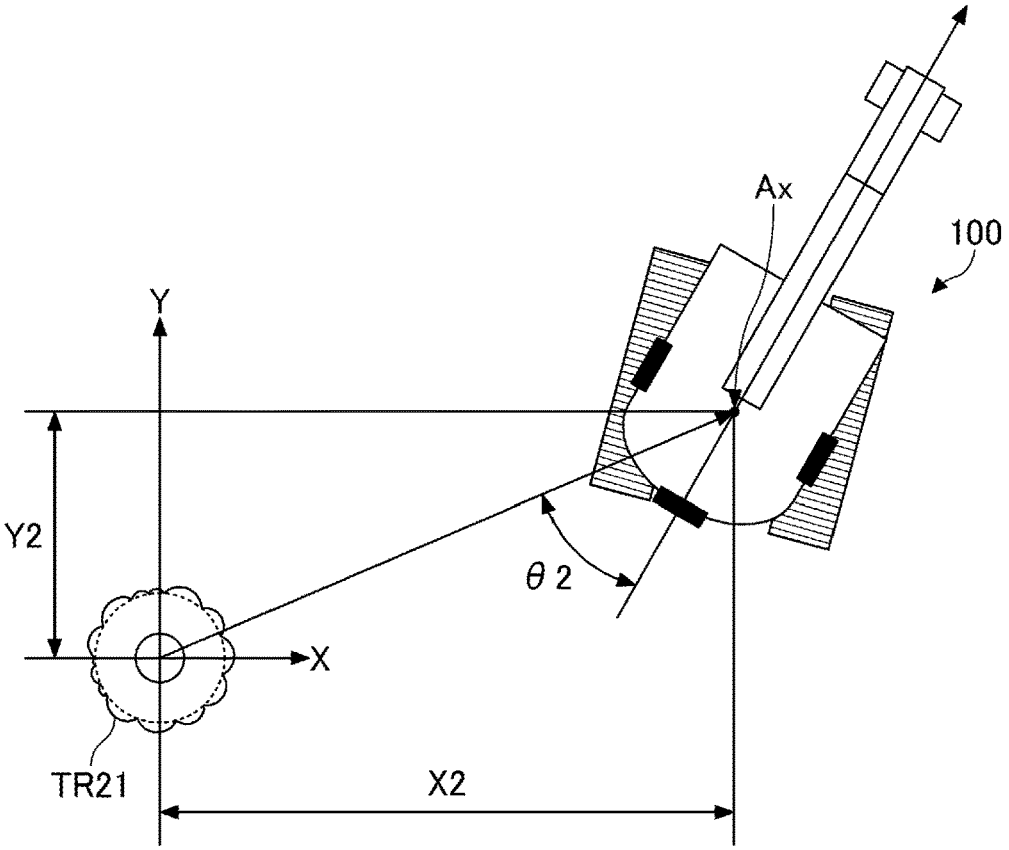
FIG. 14B is a diagram illustrating a first example of an estimation method of the position of an excavator.

FIG. 14 (FIGS. 14A and 14B) illustrates a first example of an operation relating to estimation of a position of the excavator 100 according to the present embodiment.

As illustrated in FIG. 14, the position estimating unit 59 estimates (calculates) the position of the excavator 100 in the XY coordinate system having the tree TR21 that is the fixed target object around the excavator 100 (own machine) as the reference (the origin), identified from the object position map MP. The turning angle calculating unit 55 estimates (calculates) the turning angle of the upper turning body 3 with respect to the direction of the excavator 100 (turning axis) viewed from the tree TR21.

For example, in the work status of FIG. 14A, the position estimating unit 59 calculates the position of the excavator 100 in the XY coordinate system using the tree TR21 as a reference, such that the X coordinate is a predetermined value X1 (>0) and the Y coordinate is a predetermined value Y1 (>0). Further, the position estimating unit 59 calculates that the turning angle of the upper turning body 3 is a predetermined value θ1 (>0), with respect to the direction of the excavator 100 (the turning axis AX) as viewed from the tree TR21.

Then, the excavator 100 transitions from the work status of FIG. 14A to the work status of FIG. 14B, that is, the excavator 100 moves away from the tree TR21 by the lower traveling body 1 and causes the upper turning body 3 to turn left. In this case, in the working status of FIG. 14B, the position estimating unit 59 calculates the position of the excavator 100 in the XY coordinate system using the tree TR21 as a reference, such that the X coordinate is a predetermined value X2 (>X1>0) and the Y coordinate is a predetermined value Y2 (>Y1>0). The turning angle calculating unit 55 calculates that the turning angle of the upper turning body 3 with respect to the direction of the excavator 100 (turning axis AX) as viewed from the tree TR21, is a predetermined value θ2 (>θ1>0).

Thus, in the present example, the position estimating unit 59 estimates the position of the excavator 100 with respect to the tree TR21 around the excavator 100 (own machine). Thus, the controller 30 can continue to identify the position of the excavator 100 with respect to the tree TR21 in accordance with the movement of the excavator 100, in a situation where the excavator 100 performs work while moving around the tree TR21. The turning angle calculating unit 55 estimates the turning angle of the upper turning body 3 with respect to the direction in which the excavator 100 (turning axis) is viewed from the tree TR21. This allows the controller 30 to continue to identify the orientation of the upper turning body 3 (i.e., the orientation of the attachment) with respect to the tree TR21 in a situation where the excavator 100 is working while moving around the tree TR21 and turning the upper turning body 3.

[Estimation Method of Position of Excavator (Second Example)]

Next, a second example of the method of estimating the position of the excavator 100 (own machine) by the controller 30 will be described with reference to FIG. 15. Hereinafter, the functional configuration relating to the estimation of the position of the excavator 100 according to the present example is illustrated in FIG. 13, and, therefore, a figure of the functional configuration will be omitted.

<Functional Configuration Relating to Estimation of Excavator Position>

In the present example, the portions that are different from the above-described first example will be mainly described.

As illustrated in FIG. 13, in the present example, the excavator 100 includes the imaging device S6 (the camera S6F, S6B, S6L, and S6R) and the controller 30 as a configuration relating to the estimation of the position of the own machine.

The controller 30 includes the machine guidance unit 50 and the surrounding status recognizing unit 60 as configurations relating to the estimation of the position of the excavator 100.

The object position map generating unit 63 generates an object position map MP representing the position of the excavator 100 (own machine) with respect to a surrounding object (target object) similar to the above-described first example. In the present example, the object position map MP includes accompanying information such as type information of the target object, size information of the target object, information indicating the accuracy of the position of the target object (hereinafter referred to as "accuracy information") and the like associated with the position of each target object. Accordingly, the object position map generating unit 63 can refer to the accuracy information and identify the accuracy of the position of the target object included in the object position map MP. For this reason, the object position map generating unit 63 may, for example, compare the accuracy information of a certain target object in the local map corresponding to the current position of the excavator 100 with the accuracy information of the same target object in a past object position map MP generated in the most recent processing cycle, and generate the latest object position map MP so as to apply the position with higher accuracy. That is, the object position map generating unit 63 may update the object position map MP based on information relating to a relatively highly accurate object (target object) acquired by the imaging device S6. Accordingly, the object position map generating unit 63 can improve the accuracy of the object position map MP.

Figure 15:
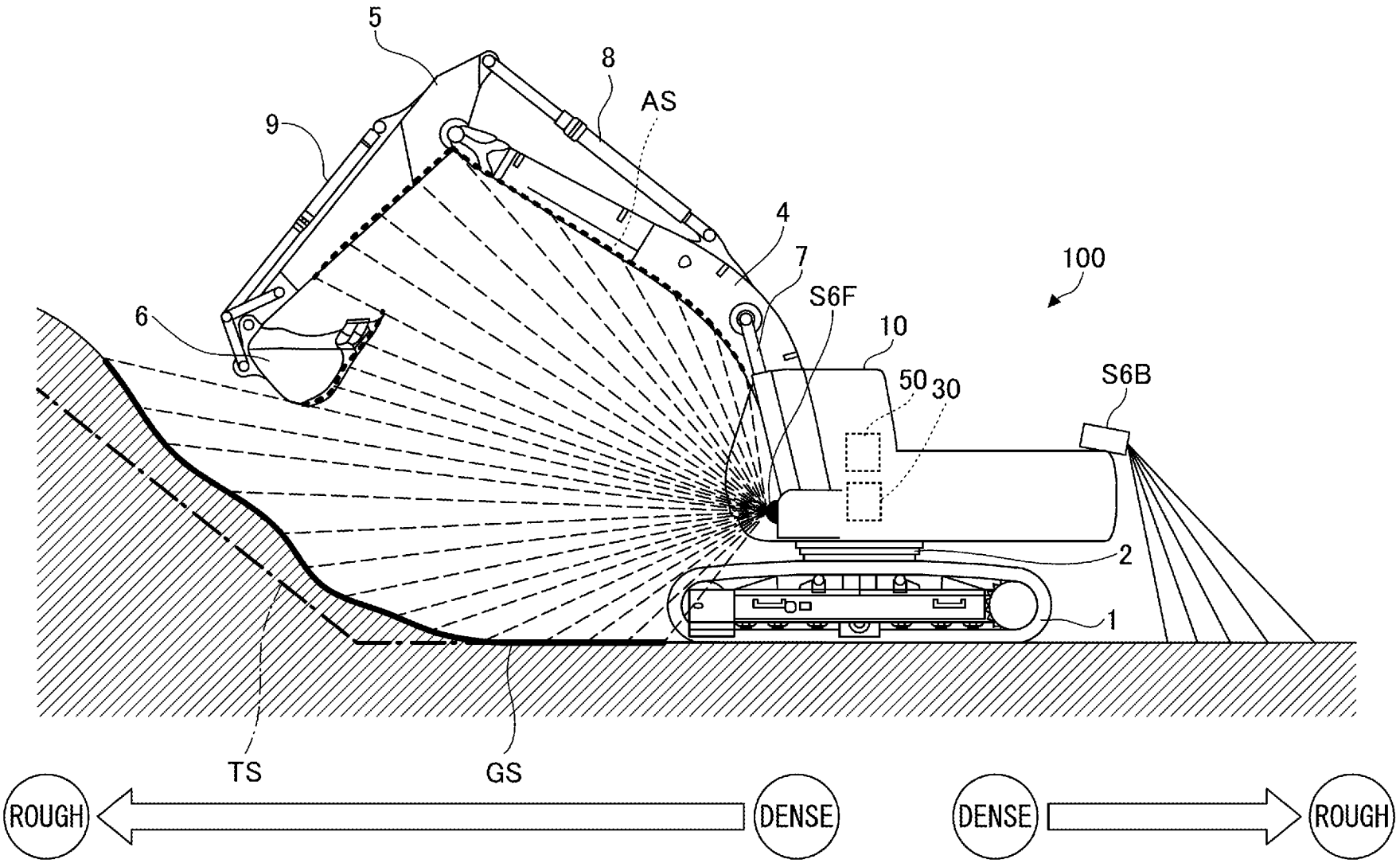
FIG. 15 is a diagram illustrating a second example of an estimation method of the position of an excavator.

As illustrated in FIG. 15, it can be understood that the distance range in which the imaging device S6 (the cameras S6F and S6B) can perform imaging at a constant angle in the vertical direction, becomes relatively short as the region is closer to the excavator 100 and becomes relatively long as the region is distant from the excavator 100. That is, the imaging device S6 can acquire relatively highly dense pixel information for a region relatively close to the excavator 100, while the imaging device S6 can only acquire relatively rough pixel information for a region relatively distant from the excavator 100. Therefore, as the distance between the excavator 100 and the target object becomes the longer, the position of the target object is estimated from relatively rough pixel information, and the accuracy becomes relatively low. Accordingly, the accuracy information may be generated based on the distance from the excavator 100 when a target object is detected by the detecting unit 62. In this case, the accuracy information is generated in such a manner that the longer the distance from the excavator 100 when the target object is detected by the detecting unit 62, the lower the accuracy of the position of the target object.

Further, the accuracy information may be generated, for example, based on the elapsed time from the last time the target object is detected. This is because, when the distance between the excavator 100 and a certain target object becomes relatively long and the target object can no longer be detected by the detecting unit 62, thereafter, it is not possible to determine whether the target object is present at the position in the same shape. In this case, the accuracy information may be generated in such a manner that the longer the elapsed time, the lower the accuracy of the target object.

The accuracy information may be generated based on the recognition probability of a target object by the detecting unit 62 (object detection model LM). In this case, the accuracy information may be generated in such a manner that as the recognition probability of the target object output by the object detection model LM relatively decreases, the accuracy of the target object becomes lower.

The machine guidance unit 50 includes the turning angle calculating unit 55 and the position estimating unit 59 as functional configurations relating to the estimation of the position of the excavator 100.

The turning angle calculating unit 55 estimates (calculates) the orientation (turning angle) of the upper turning body 3 based on a target object whose position is relatively highly accurate, among the stopped target objects or the fixed target objects around the excavator 100, identified from the object position map MP stored in the map storage unit 64. For example, the turning angle calculating unit 55 may automatically select a target object to be used as a reference of the orientation of the upper turning body 3, according to a predetermined condition (for example, "the distance from the excavator 100 is closest" or the like), from among the target objects whose positions are relatively highly accurate (specifically, greater than or equal to a predetermined reference), among the stopped target objects or the fixed target objects around the excavator 100. Further, for example, the turning angle calculating unit 55 may use, as a reference of the orientation of the upper turning body 3, a stopped target object or a fixed target object selected from among target objects whose positions are relatively highly accurate, among a plurality of target objects identified in an object position map MP based on an operation input through the input device 42. Accordingly, the turning angle calculating unit 55 can estimate the turning angle of the upper turning body 3 on the basis of the target object whose position is relatively highly accurate. Therefore, it is possible to improve the estimation accuracy of the turning angle.

The position estimating unit 59 estimates (calculates) the position of the excavator 100 (own machine) on the basis of a target object whose position is relatively highly accurate, among target objects around the excavator 100 identified from the object position map MP stored in the map storage unit 64. For example, the position estimating unit 59 may automatically select a target object that is used as a reference of the position of the excavator 100 according to a predetermined condition (for example, "the distance from the excavator 100 is the closest" or the like) from among target objects whose positions are relatively highly accurate (specifically, greater than or equal to a predetermined reference) among stopped target objects or fixed target objects around the excavator 100. For example, the position estimating unit 59 may use, as a reference of the position of the excavator 100, a stopped target object or a fixed target object selected from among target objects whose positions are relatively highly accurate among a plurality of target objects identified from the object position map MP based on an operation input through the input device 42. Accordingly, the position estimating unit 59 can estimate the position of the excavator 100 (own machine) based on a target object whose position is relatively highly accurate. Therefore, the accuracy of estimating the position of the excavator 100 can be improved.

[Estimation Method of Position of Excavator (Third Example)]

Next, a third example of the method of estimating the position of the excavator 100 (own machine) by the controller 30 will be described with reference to FIG. 16 and FIG. 8 (FIGS. 8A and 8B). In the present embodiment, the excavator 100 is configured to automatically advance and reverse the right and left crawlers of the lower traveling body 1. Specifically, a configuration portion relating to the operation system of the traveling hydraulic motor 1L and a configuration portion relating to the operation system of the traveling hydraulic motor 1R are configured in the same manner as the configuration portion relating to the operation system of the boom cylinder 7 (FIGS. 4A to 4C). Hereinafter, in the configuration portion relating to the operation system of the traveling hydraulic motor 1L and the configuration portion relating to the operation system of the traveling hydraulic motor 1R, the configurations corresponding to the proportional valves 31AL and 31AR illustrated in FIG. 4A, are referred to as proportional valves 31DL and 31DR and proportional valves 31EL and 31ER, respectively.

<Functional Configuration Relating to Estimation of Excavator Position>

Figure 16:
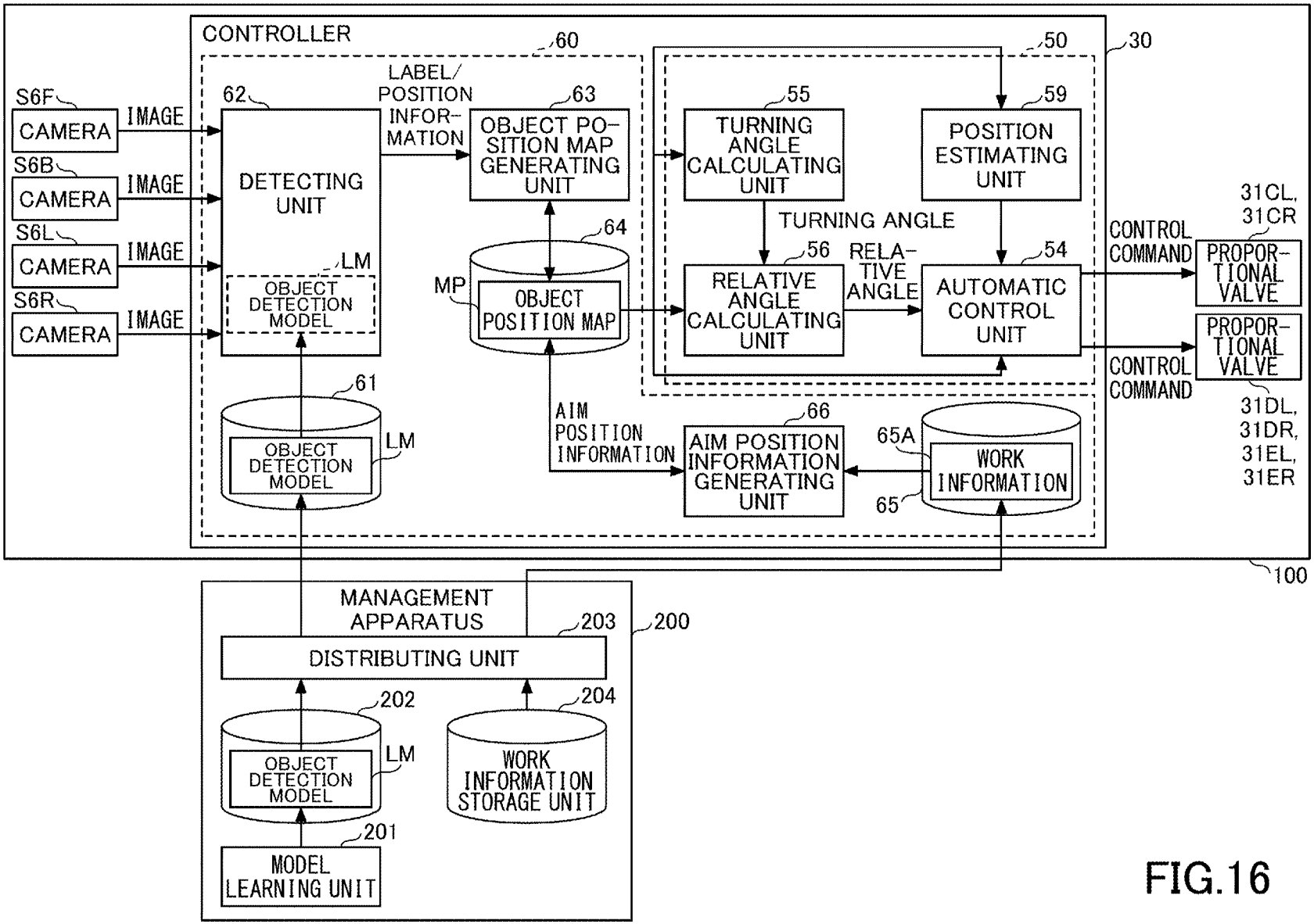
FIG. 16 is a diagram illustrating a third example of an estimation method of the position of an excavator.

FIG. 16 is a functional block diagram illustrating a third example of functional configurations relating to the estimation of a position of the excavator 100 according to the present embodiment. Hereinafter, the portions of the present example that are different from the above-described example in FIG. 13 will be mainly described. In the present example, the excavator 100 is configured to automatically advance and reverse the lower traveling body 1 (specifically, the right and left crawlers).

As illustrated in FIG. 16, in the present example, similar to the case of FIG. 13, the excavator 100 is communicatively connected to the management apparatus 200 using the communication device T1.

The management apparatus 200 includes the model learning unit 201 and the distributing unit 203 as functional units that are implemented by executing, for example, a program installed in an auxiliary storage device on a CPU. The management apparatus 200 uses the learning result storage unit 202 and the work information storage unit 204. The learning result storage unit 202 and the work information storage unit 204 can be implemented by, for example, an auxiliary storage device of the management apparatus 200 or an external storage device capable of communication.

In the work information storage unit 204, a database of work information including work information of a plurality of worksites including the worksite of the excavator 100 is constructed. The work information includes information on the aim of work (e.g., aim work surface data, etc.).

The distributing unit 203 extracts the work information of the worksite of the excavator 100 from the work information database and distributes the information to the excavator 100.

In the present example, the excavator 100 includes the imaging device S6 (the camera S6F, S6B, S6L, and S6R), the controller 30, and the proportional valves 31CL, 31CR, 31DL, 31DR, 31EL, and 31ER as configurations relating to the estimation of the position of the own machine.

Similar to the case of FIG. 13, the controller 30 includes the machine guidance unit 50 and the surrounding status recognizing unit 60 as configurations relating to the estimation of the position of the excavator 100.

The surrounding status recognizing unit 60 includes the model storage unit 61, the detecting unit 62, the object position map generating unit 63, the map storage unit 64, the storage unit 65, and an aim position information generating unit 66 as functional configurations relating to the estimation of the position of the excavator 100.

The storage unit 65 stores the work information 65A distributed from the management apparatus 200.

The aim position information generating unit 66 generates information (hereinafter, referred to as "aim position information") relating to the position of the work target that is the aim when performing work, and registers the information onto the object position map MP. In the present example, the aim position information generating unit 66 generates aim position information relating to the aim work surface that is the work target based on the work information 65A, specifically, aim position information defining the position of the aim work surface on the object position map MP and the three-dimensional shape of the aim work surface, and registers the aim position information on the object position map MP. That is, the aim position information generating unit 66 generates an object position map MP for associating the position of the aim of work (the aim work surface) corresponding to the work information 65A, with the position of the excavator 100 (own machine) with respect to an object around the excavator 100 (the target object), and holds the generated object position map MP in the map storage unit 64. Accordingly, the controller 30 (the automatic control unit 54) can identify the position of the excavator 100 and the positional relationship between the position of the excavator 100 and the aim of work (the aim work surface), on the object position map MP.

The machine guidance unit 50 includes the automatic control unit 54, the turning angle calculating unit 55, the relative angle calculating unit 56, and the position estimating unit 59 as functional configurations relating to the estimation of the position of the excavator 100.

The relative angle calculating unit 56 calculates (estimates) the relative angle based on the orientation (turning angle) of the upper turning body 3 on the object position map MP calculated by the turning angle calculating unit 55, and the position and three-dimensional shape of the aim work surface that is the work target identified from the object position map MP. Specifically, the relative angle calculating unit 56 may calculate (estimate) the relative angle based on the orientation (turning angle) of the upper turning body 3 viewed from a certain target object calculated by the turning angle calculating unit 55, and the orientation of the aim work surface viewed from the same target object on the object position map MP.

The automatic control unit 54 controls the proportional valves 31DL, 31DR, 31EL, and 31ER based on the position of the excavator 100 with respect to a target object around the excavator 100 (own machine) calculated (estimated) by the position estimating unit 59, and causes the lower traveling body 1 to travel, to move the excavator 100 to the front of the aim work surface corresponding to the work information 65A (specifically, the non-worked portion (portion not yet subjected to work) on the aim work surface). Specifically, the automatic control unit 54 may control the lower traveling body 1 to travel, based on the position of the excavator 100 on the object position map MP estimated by the position estimating unit 59 and the position of the aim work surface on the object position map MP. The automatic control unit 54 controls the proportional valves 31CL, 31CR, 31DL, 31DR, 31EL, and 31ER based on the relative angle calculated (estimated) by the relative angle calculating unit 56 to cause the upper turning body 3 to front-face the aim work surface corresponding to the work information 65A. The automatic control unit 54 may turn the upper turning body 3 so that the upper turning body 3 front-faces the aim work surface after the excavator 100 is moved to the front of the non-worked portion of the aim work surface. The automatic control unit 54 may control the travelling path of the lower traveling body 1 so that the upper turning body 3 front-faces the aim work surface when the excavator 100 approaches a certain distance to the aim work surface. When an object is detected within a predetermined range, the automatic control unit 54 may control the decompression proportional valve 33 based on the positional relationship with the detected object and perform a braking operation (deceleration or stop).

<Specific Example of Estimation Method of Position of Excavator>

As illustrated in FIG. 8A, in the present example, the controller 30 (the position estimating unit 59) estimates the position of the excavator 100 with respect to the tree TR2 that is a fixed target object around the excavator 100 (own machine), which is identified on the object position map MP.

For example, the controller 30 (the position estimating unit 59) sequentially calculates (estimates) the position of the excavator 100 with respect to the tree TR2. Then, when the operator operates the lower traveling body 1 (specifically, the left and right crawlers) through the operation apparatus 26 while pressing a predetermined switch such as the MC switch or the like, the controller 30 (the position estimating unit 59) the controls the lower traveling body 1 to travel, via the proportional valves 31DL, 31DR, 31EL, and 31ER based on the difference between the position of the excavator 100 and the position of the slope surface NS with respect to the tree TR2. Thus, as illustrated in FIG. 8A, the controller 30 can assist the operator in performing operations with respect to the operation apparatus 26 for operating the lower traveling body 1, to move the excavator 100 to the front of the slope surface NS. When a predetermined switch, such as a MC switch, is pressed down, the controller 30 may automatically control the lower traveling body 1 through the proportional valves 31DL, 31DR, 31EL, and 31ER and automatically move the excavator 100 to the front of the slope surface NS, regardless of the operation to the operation apparatus 26.

As illustrated in FIGS. 8A and 8B, the controller 30 (the turning angle calculating unit 55) calculates a turning angle using the tree TR2 that is a fixed target object around the excavator 100 (own machine) as a reference target object, which is identified on the object position map MP. Specifically, the controller 30 calculates a turning angle with respect to the direction in which the excavator 100 (turning axis) is viewed from the tree TR2.

For example, in the state of FIG. 8A, the controller 30 (the turning angle calculating unit 55) estimates (calculates) the turning angle using the tree TR2 as the reference target object. The controller 30 (the relative angle calculating unit 56) estimates (calculates) the relative angle based on the estimated turning angle and aim position information corresponding to the slope surface NS that is the aim work surface. When the operator performs a left turning operation with respect to the lever device 26C while pressing down a predetermined switch such as the MC switch, the controller 30 (the automatic control unit 54) controls the proportional valve 31CL so that the upper turning body 3 front-faces the slope surface NS while estimating the turning angle using the tree TR2 as the reference target object. Thus, as illustrated in FIG. 8B, the controller 30 can assist the operator's operation of the lever device 26C to front-face the slope surface NS that is the work target. When the operator presses down a predetermined switch such as the MC switch, the controller 30 may automatically cause the upper turning body 3 to front-face the slope surface NS while estimating the turning angle using the tree TR2 as the reference target object.

[Estimation Method of Position of Excavator (Fourth Example)]

Next, a fourth example of the method of estimating the position of the excavator 100 (own machine) by the controller 30 will be described with reference to FIGS. 17 and 18.

<Functional Configuration Relating to Estimation of Excavator Position>

Figure 17:
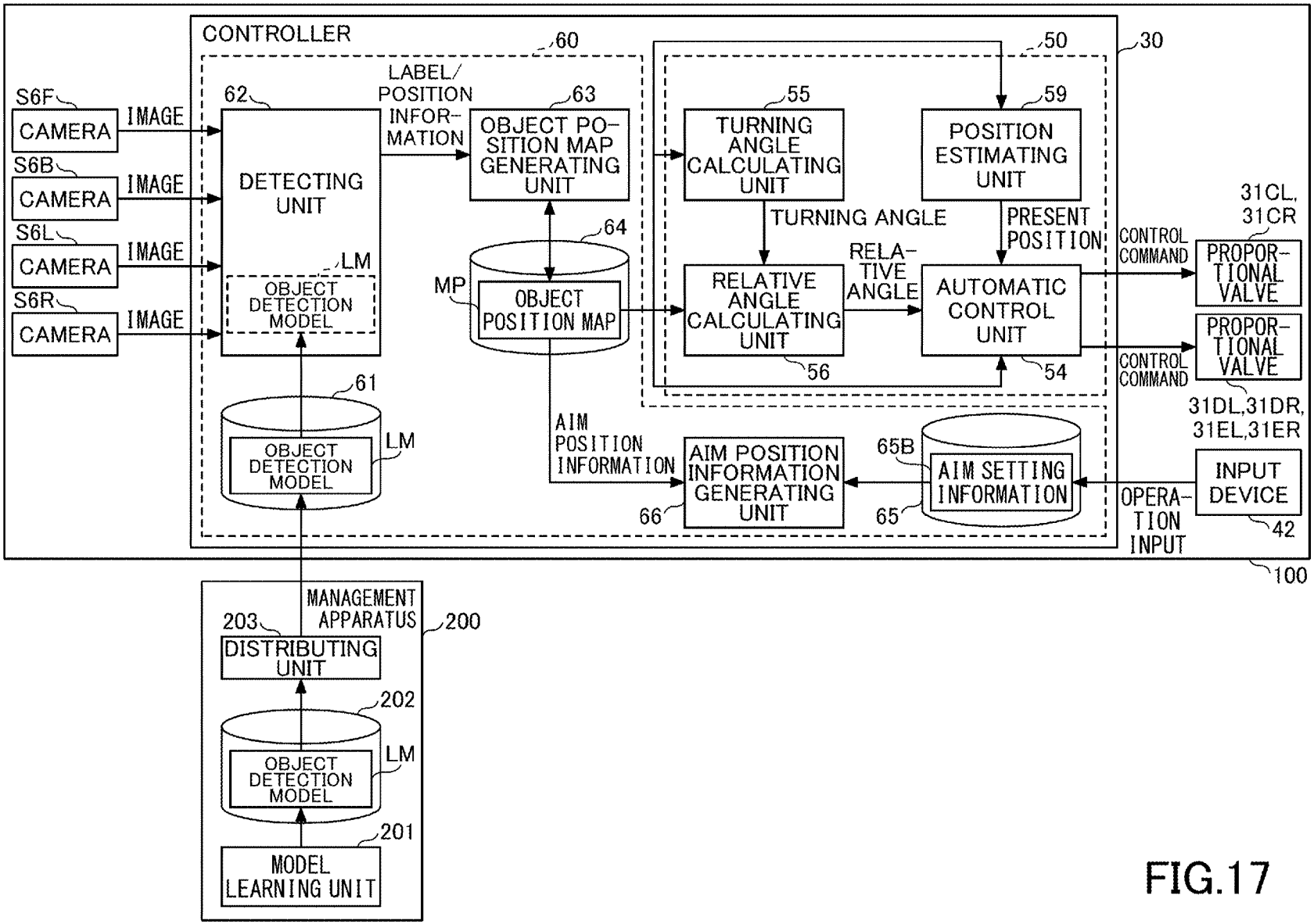
FIG. 17 is a diagram illustrating a fourth example of an estimation method of the position of an excavator.

FIG. 17 is a functional block diagram illustrating a fourth example of functional configurations relating to the estimation of the position of the excavator 100 according to the present embodiment. Hereinafter, the portions of the present example that are different from the above-described FIG. 13 will be mainly described.

In the present example, the excavator 100 includes the imaging device S6 (the camera S6F, S6B, S6L, and S6R), the controller 30, and the proportional valves 31CL, 31CR, 31DL, 31DR, 31EL, and 31ER as configurations relating to the estimation of the position of the own machine.

Similar to the case of FIG. 13, the controller 30 includes the machine guidance unit 50 and the surrounding status recognizing unit 60 as a configuration relating to the estimation of the position of the excavator 100.

The surrounding status recognizing unit 60 includes the model storage unit 61, the detecting unit 62, the object position map generating unit 63, the map storage unit 64, the storage unit 65, and the aim position information generating unit 66 as functional configurations relating to the estimation of the position of the excavator 100.

Aim setting information 65B is stored in the storage unit 65.

The aim setting information 65B is setting information relating to a work target that is the aim of the work (for example, a dump truck that has come to unload to a scrap yard STP to be described later, various devices in the scrap yard STP, the storage place of scrap, etc.) set by an operation input from a user such as an operator through the input device 42.

For example, by operating a predetermined operation screen (hereinafter, "aim selection screen") displayed on the display device 40 using the input device 42, an operator or the like can select a target object corresponding to the work target from one or more target objects identified in the object position map MP and set the selected target object as the aim of the work. Specifically, an image representing the appearance of the surroundings of the excavator 100 (hereinafter, "surrounding image") is displayed on the aim selection screen of the display device 40 based on the captured image captured by the imaging device S6. Then, on the aim selection screen of the display device 40, information representing a marker or the type of the target object is displayed in a superimposed manner at a position corresponding to a target object around the excavator 100 identified by the object position map MP, on the surrounding image. An operator or the like can identify and select (set) a work target by confirming the position and type of the target object on the aim selection screen.

The aim position information generating unit 66 generates aim position information corresponding to a work target set (selected) by an operator or the like based on the aim setting information 65B and registers the aim position information on the object position map. In the present example, the aim position information generating unit 66 generates, based on the aim setting information 65B, aim position information identifying a target object corresponding to a work target set by an operator or the like among the target objects on the object position map MP, and registers the aim position information in the object position map MP. Specifically, the aim position information generating unit 66 registers the aim position information on the object position map MP, at the position of the target object that is the work target corresponding to the aim setting information 65B on the object position map MP, upon linking this information with accompanying information such as flag information indicating this information is a work target, identification information for distinguishing the work target from other work targets, and the like. That is, the aim position information generating unit 66 generates the object position map MP that associates the position of a predetermined work target corresponding to the aim setting information 65B with the position of the excavator 100 (own machine) with respect to a surrounding object (target object), and holds the object position map MP in the map storage unit 64. Accordingly, the controller 30 (the automatic control unit 54) can identify the positional relationship between the position of the excavator 100 and the position of the work target set by an operation input from an operator or the like, on the object position map MP.

The machine guidance unit 50 includes the automatic control unit 54, the turning angle calculating unit 55, the relative angle calculating unit 56, and the position estimating unit 59 as functional configurations relating to the estimation of the position of the excavator 100.

The relative angle calculating unit 56 calculates (estimates) the relative angle based on the orientation (turning angle) of the upper turning body 3 on the object position map MP calculated by the turning angle calculating unit 55, and the position and three-dimensional shape of the aim work surface that is the work target identified from the object position map MP. Specifically, the relative angle calculating unit 56 may calculate (estimate) the relative angle based on the orientation (turning angle) of the upper turning body 3 viewed from a certain target object calculated by the turning angle calculating unit 55, and the orientation of the aim work surface viewed from the same target object on the object position map MP.

The automatic control unit 54 controls the proportional valves 31DL, 31DR, 31EL, and 31ER based on the position of the excavator 100 with respect to the target object corresponding to a work target around the excavator 100 (own machine), calculated (estimated) by the position estimating unit 59, and causes the lower traveling body 1 to travel. Specifically, the automatic control unit 54 may control the lower traveling body 1 to travel, based on the position of the excavator 100 on the object position map MP estimated by the position estimating unit 59 and the position of the target object corresponding to the work target on the object position map MP. Accordingly, the automatic control unit 54 can control the lower traveling body 1 by assisting the operator in performing operations with respect to the operation apparatus 26 or regardless of the operation with respect to the operation apparatus 26, to move the excavator 100 to the front of the work target or to move between a plurality of work targets, so as not to collide with any work targets. Further, the automatic control unit 54 controls the proportional valves 31CL and 31CR based on the relative angle calculated (estimated) by the relative angle calculating unit 56 to cause the upper turning body 3 to front-face the target object corresponding to the work target.

<Specific Example of Estimation Method of Position of Excavator>

Figure 18:
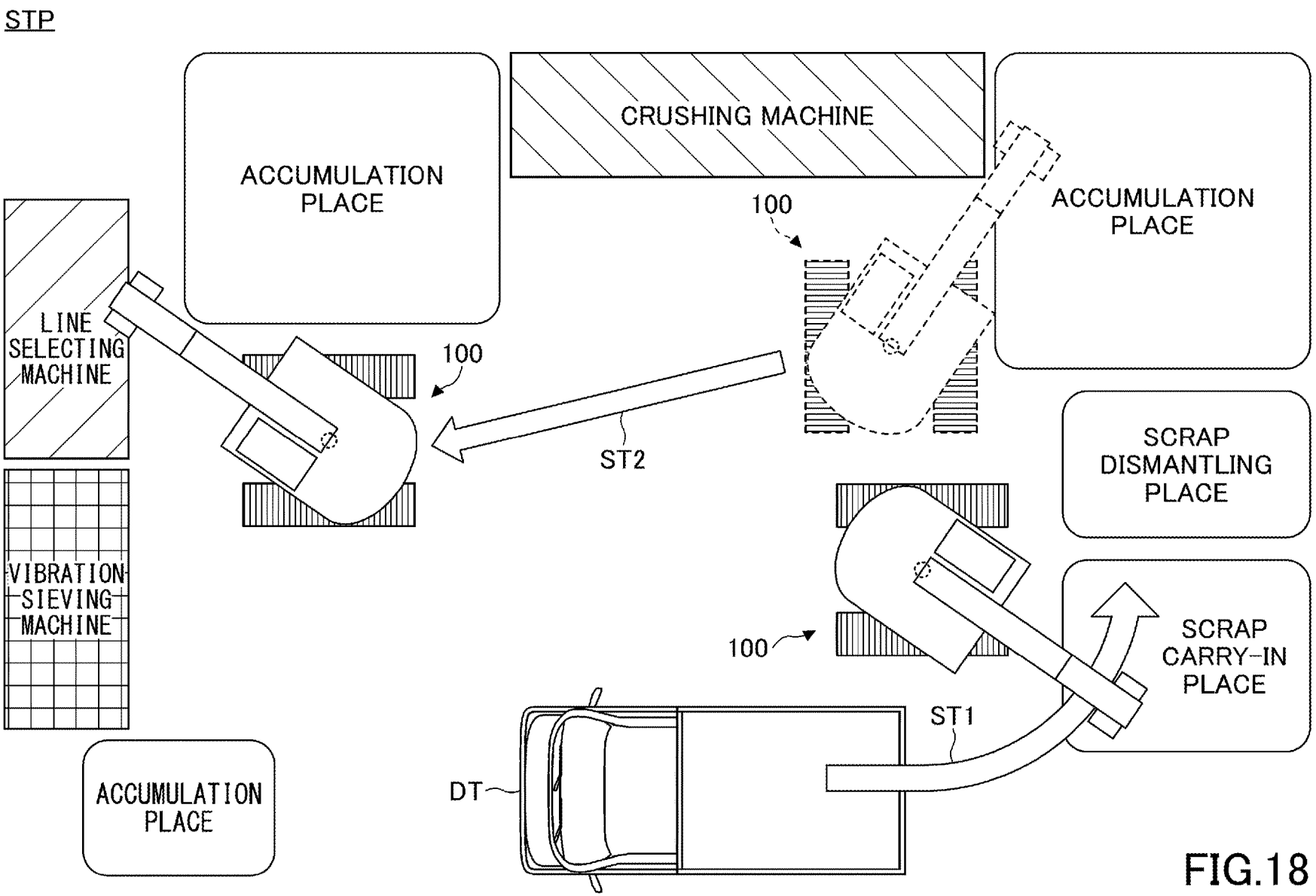
FIG. 18 is a diagram illustrating a fourth example of an estimation method of the position of an excavator.

FIG. 18 is a diagram illustrating a fourth example of an operation relating to the estimation of the turning angle of the excavator 100 according to the present embodiment. Specifically, FIG. 18 is a top view illustrating a situation in which work is performed while moving between a plurality of work targets in a scrap yard STP. The work targets in the present example are the dump truck DT that has come to unload scrap, a scrap storage place specified in the scrap yard STP (a scrap carry-in place, a scrap dismantling place, accumulation places that are located before and after various devices), and various devices in the scrap yard STP (a crushing machine, a line selecting machine, and a vibration sieving machine).

The excavator 100 identifies various devices under the control of the controller 30 to determine whether there is a possibility of contact (with another object). Under the control of the controller 30, the excavator 100 determines whether a braking operation is possible and generates an aim trajectory of an end attachment or the lower traveling body 1 based on the determination result of whether there is a possibility of contact.

In the present example, the excavator 100 performs a work ST1 for extracting scrap from the loading platform of the dump truck DT that is a work target, under the control of the controller 30. The work ST1 may be performed in a manner that assists the operation to the operation apparatus 26 by an operator and the like, or may be performed automatically regardless of the operation to the operation apparatus 26 by an operator and the like. The same applies hereinafter to a work ST2. The controller 30 monitors the position of the excavator 100 and the orientation (turning angle) of the upper turning body 3 with respect to a predetermined work target (such as the dump truck DT and a pile of scrap at the scrap carry-in place) while sequentially updating the object position map MP. Accordingly, the excavator 100 may operate an attachment or rotate the upper turning body 3 so as to move back and forth between the loading platform of the dump truck DT and the scrap carry-in place under the control of the controller 30, so that the own machine does not contact the dump truck DT, the scrap at the scrap carry-in place, and the like.

Further, under the control of the controller 30, the excavator 100 continuously performs the work ST2 of loading, into the crushing machine, the scrap in the accumulation place that has undergone the dismantling work, and then moving to the line selecting machine, and loading, into the line selecting machine from the accumulation place, the scrap that has been crushed by the crushing machine. The controller 30 monitors the position of the excavator 100 and the orientation (turning angle) of the upper turning body 3 with respect to a predetermined work target (such as a pile of scrap at the accumulation place, the crushing machine, the line selecting machine, and the like) while sequentially updating the object position map MP. Accordingly, the excavator 100 may operate an attachment or may turn the upper turning body 3 back and forth between the accumulation place and the loading port of the crushing machine under the control of the controller 30 so that the own machine does not contact a pile of scrap in the accumulation place or the crushing machine. Further, the excavator 100 may travel by the lower traveling body 1 from the front of the crushing machine to the front of the line selecting machine under the control of the controller 30 so that the excavator 100 does not contact a pile of scrap in the accumulation place, the crushing machine, the line selecting machine, or the like. Further, the excavator 100 may operate the attachment or may turn the upper turning body 3 back and forth between the accumulation place and the loading port of the line selecting machine under the control of the controller 30 to prevent the own machine from contacting a pile of scrap at the accumulation place or the line selecting machine.

As described above, in the present example, a plurality of work targets in the scrap yard STP are set in advance (registered) in the object position map MP, and, therefore, the excavator 100 can safely proceed with work under the control of the controller 30 such that the own machine does not contact various devices in the scrap yard STP.

[Estimation Method of Position of Excavator (Fifth Example)]

Next, a fifth example of the method of estimating the position of the excavator 100 (own machine) by the controller 30 will be described.

Note that, as the functional block diagram representing the functional structure relating to the estimation of the position of the excavator 100 according to the present example, any of the functional block diagrams (FIG. 13 or FIG. 17) of the first to fourth examples described above can be used, and thus, the drawing is omitted.

The controller 30 may estimate (calculate) a movement distance and a movement direction of the excavator 100 based on the change in time series of the position of a reference target object viewed from the excavator 100, similar to case of the above-described third example of the method for estimating a turning angle (FIG. 10 and FIG. 11). The controller 30 may estimate (calculate) the position of the excavator 100 by accumulating the movement distance and the movement direction in the time series with respect to a certain time, based on the change in time series of the position of the reference target object viewed from the excavator 100. Accordingly, the controller 30 can calculate (estimate) the movement distance, the movement direction, the position and the like of the excavator 100 by identifying the track records of positions of the reference target object viewed from the excavator 100.

The controller 30 may estimate (calculate) the movement distance, the movement direction, the position, or the like of the excavator 100 by using a plurality of reference target objects around the excavator 100, similar to the case of the above-described third example of the method for estimating a turning angle (FIGS. 10 and 11). Accordingly, even when some of the reference target objects cannot be detected, as long as there is another reference target object that can be detected, the controller 30 may estimate the movement distance, the movement direction, the position, etc., of the excavator 100 based on a change in the position of the other reference target object viewed from the excavator 100. That is, by using a plurality of reference target objects, the controller 30 can stably continue estimating the movement distance, the movement direction, the position, and the like of the excavator 100 even in a situation where some of the reference target objects cannot be detected.

[Modifications/Changes]

While the embodiments have been described in detail above, the disclosure is not limited to such particular embodiments, and various modifications and variations are possible within the scope of the appended claims.

For example, in the above described embodiments, the function of estimating the turning angle and position of the excavator 100 may be transferred to a predetermined external device (e.g., the management apparatus 200) that is communicatively connected with the excavator 100. In this case, the output of the imaging device S6, the distance measuring device S7, or the like is transmitted from the excavator 100 to the management apparatus 200. Accordingly, the management apparatus 200 can identify the positional relationship between the excavator 100 and an object around the excavator 100 while estimating the turning angle and the position based on the information received from the excavator 100, and transmit the result to the excavator 100 as feedback. Therefore, the processing load on the excavator 100 side (the controller 30) can be reduced.

In the above described embodiment, information relating to a monitor target detected inside or outside of the monitor region of the excavator 100 may be transmitted from the excavator 100 to the management apparatus 200. In this case, in the management apparatus 200, information relating to the type of the monitor target, the position of the monitor target, and the like, inside or outside the monitor region of the excavator 100 is stored in a predetermined storage unit in time series. The information relating to the monitor target stored in the storage unit of the management apparatus 200 may include information relating to the type of the monitor target, the position of the monitor target, etc., outside the monitor region of the target excavator 100 and within the monitor target of another excavator 100 (in the same worksite).

According to an aspect of the present invention, a technique in an excavator, by which the positional relationship between the own machine and an object around the own machine can be reliably identified, can be provided.

What is claimed is:

1. An excavator comprising:

a lower traveling body;

an upper turning body turnably mounted to the lower traveling body;

a sensor mounted to the upper turning body and configured to acquire information including a status around the excavator; and processing circuitry configured to detect one or more objects around the excavator based on the information acquired by the sensor, obtain position information of the detected one or more objects, generate map information representing a positional relationship between the excavator and the detected one or more objects, the map information including the obtained position information of the detected one or more objects, recognize a plurality of reference objects based on the generated map information, the plurality of reference objects each being in a stopped state or at a fixed position around the excavator, determine a first reference object as a reference and a second reference object as a reference among the recognized plurality of reference objects, and calculate a turning angle of the upper turning body required for the upper turning body to face the determined first reference object using a change in a position of the determined first reference object due to turning of the upper turning body and a change in a position of the determined second reference object due to the turning of the upper turning body as viewed from the upper turning body.

2. The excavator according to claim 1, wherein the processing circuitry is configured to control a turning motion of the upper turning body to face the determined first reference object, based on the calculated turning angle.

3. The excavator according to claim 2, wherein information relating to the first reference object is included in work information.

4. The excavator according to claim 2, further comprising:

an input device configured to accept an operation input of a selection of the first reference object and the second reference object from among the recognized plurality of reference objects.

5. The excavator according to claim 4, wherein the processing circuitry is configured to cause the upper turning body to face the first reference object while calculating the turning angle of the upper turning body.

6. The excavator according to claim 1, wherein the sensor includes a plurality of sensors, and the processing circuitry is configured to recognize a change in a position of one of the plurality of reference objects, based on output information of two or more of the plurality of sensors configured to acquire information relating to the one of the plurality of reference objects.

7. An excavator comprising:

a lower traveling body;

an upper turning body turnably mounted to the lower traveling body;

a sensor mounted to the upper turning body and configured to acquire information including a status around the excavator; and processing circuitry configured to recognize a plurality of objects around the excavator based on the information acquired by the sensor, and identify a position of the excavator relative to an object serving as a reference among the plurality of objects based on the plurality of objects recognized based on the information acquired by the sensor.

8. The excavator according to claim 7, wherein the processing circuitry is configured to generate and hold map information representing the position of the excavator relative to the object.

9. The excavator according to claim 8, wherein the processing circuitry is configured to update the map information based on information relating to the object acquired by the sensor, the information relating to the object acquired by the sensor being more accurate with respect to a position of the object around the excavator than the map information currently held by the processing circuitry.

10. The excavator according to claim 7, wherein the processing circuitry is configured to generate and hold information associating the position of the excavator relative to the object with a position of an aim of work corresponding to work information.

11. The excavator according to claim 7, wherein the processing circuitry is configured to generate and hold information associating the position of the excavator relative to the object with a position of a predetermined work target.

12. The excavator according to claim 7, wherein the sensor includes a first sensor configured to acquire an image of an area around the excavator, and a second sensor configured to acquire distance information representing a distance to the object within an imaging range of the first sensor, and wherein the processing circuitry is configured to recognize the plurality of objects around the excavator and identify the position of the excavator relative to the object, based on the image and the distance information.

13. The excavator according to claim 7, wherein the processing circuitry is further configured to detect one or more objects around the excavator based on the information acquired by the sensor, obtain position information of the detected one or more objects, generate map information representing a positional relationship between the excavator and the detected one or more objects, without using information on absolute positions of the excavator and the one or more objects around the excavator in a worksite, the map information including the obtained position information of the detected one or more objects, and recognize the plurality of objects around the excavator and identify the position of the excavator relative to the object, based on the generated map information.

14. The excavator according to claim 1, further comprising:

a display, wherein the processing circuitry is further configured to display the generated map information on the display and determine an object selected on the displayed map information as one of the plurality of reference objects.

15. The excavator according to claim 1, wherein the processing circuitry is further configured to estimate a first turning angle of the upper turning body relative to the determined first reference object using the change in the position of the determined first reference object due to the turning of the upper turning body as viewed from the upper tuning body and estimate a second turning angle of the upper turning body relative to the determined second reference object using the change in the position of the determined second reference object due to the turning of the upper turning body as viewed from the upper turning body, and calculate the turning angle of the upper turning body required for the upper turning body to face the determined first reference object, using the estimated first turning angle and the estimated second turning angle.

16. The excavator according to claim 13, wherein each of the plurality of reference objects is in a stopped state or at a fixed position around the excavator, and the processing circuitry is further configured to determine a first reference object as a reference and a second reference object as a reference among the recognized plurality of reference objects, estimate a first turning angle of the upper turning body relative to the determined first reference object using a change in a position of the determined first reference object due to turning of the upper turning body as viewed from the upper tuning body and estimate a second turning angle of the upper turning body relative to the determined second reference object using a change in a position of the determined second reference object due to the turning of the upper turning body as viewed from the upper turning body, and calculate a turning angle of the upper turning body required for the upper turning body to face the determined first reference object, using the estimated first turning angle and the estimated second turning angle.

* * * * *